United States Patent [19]

Schrieber

[11] Patent Number: 4,623,977

[45] Date of Patent: Nov. 18, 1986

[54] METHOD AND APPARATUS FOR LINEAR INTERPOLATION

[75] Inventor: Ricky J. Schrieber, Great Neck, N.Y.

[73] Assignee: Allied Corporation, Morris Township, Morris County, N.J.

[21] Appl. No.: 649,095

[22] Filed: Sep. 10, 1984

[51] Int. Cl.[4] ..... G06G 7/30

[52] U.S. Cl. ..... 364/577; 340/728

[58] Field of Search ..... 364/521, 523, 577; 354/7; 340/728, 730, 731

[56] References Cited

U.S. PATENT DOCUMENTS

Re. 30,679 7/1981 Evans et al. ..... 364/523

*Primary Examiner*—Michael L. Gellner

*Attorney, Agent, or Firm*—Anibal Jose Cortina; Joel Rosenblatt

[57] ABSTRACT

Disclosed is a method and system for linear interpolation of coordinate points between first and second end points, to produce coordinates on a straight line outline and where said coordinates are located on a coordinate system having a first coordinate direction and second coordinate direction and encoded in machine readable data words a radix "r", corresponding to the order of values for designated positions in said data words by increasing the scale of the incremented value in the first coordinate direction to avoid floating point math and to increase its accuracy.

18 Claims, 15 Drawing Figures

EDITING OVERIDE CONTROL CODE 8

EDITING OVERIDE CONTROL CODE 9

EDITING OVERIDE CONTROL CODE 9

EDITING OVERIDE CONTROL CODE 10

METHOD AND APPARATUS FOR LINEAR INTERPOLATION

This application is related to applications with Ser. Nos. 649,040, 649,011, 649,041, 649,012, 649,021, 649,088, and 649,098, all filed on the same day as this application and all assigned to Allied Corporation.

FIELD OF THE INVENTION

This invention relates to the field of encoding data related to a variable size character for access and display, and particularly, to the encoding of display points projected in the shape of a continuous smooth curve. The field of this invention is the field of character and symbol generation with continuous and smooth outline curves.

DESCRIPTION OF THE PRIOR ART

The prior art contains many examples of character generating methods and systems. One such example is U.S. Pat. No. 4,029,947 ('947) which generates characters from a single encoded master but uses straight line interpolation to approximate curves between a set of given points. Other encoding systems are shown in U.S. Pat. No. 4,298,945 ('945) and U.S. Pat. No. 4,199,815 ('815) which also show a system of encoding straight lines using the end points and then interpolating points on the locus of straight lines between the end points and about the outline of a character. A further patent is U.S. Pat. No. 4,338,673 ('673), which stores a character in a single size by encoding straight line outlines of the character and then uses that encoding to generate points along straight line approximations of the outline at a desired size, as in the '945 patent and the '815 patent.

However, these and other curve generation techniques do not use a system whereby the coordinate points on the outline of a character are encoded in a single master and then, by utilizing a parametric cubic expression of a single variable, a series of signals describing nodes on the locus of a smooth continuous curve between those points, are generated for display of the character at any variable size.

Parametric cubic curves are known and shown in "Fundamentals of Interactive Computer Graphics", J. D. Foley and Andries Van Dam; Addison Wesley, Reading Mass, 1982. Shown therein are parametric cubic curves, as functions of a single variable, used to represent curve surfaces.

Further, TEX and METAFONT, Donald E. Knuth; American Math Society, Digital Press, Bedford, Mass., 1979, shows the use of a parametric cubic curve wherein, given the coordinate positions of a set of end points and the first derivative (slope) of a curve at the end points, a parametric cubic polynomial (a function of a single parameter t), can be used to generate the locus of points on a smooth continuous curve segment between those end points. As shown by Knuth, the locus of each curve segment depends on the location of the two end points of that segment, for example, $Z_1$ and $Z_2$, and the angle of the curve at $Z_1$, determined by the location of adjacent points $Z_0$, $Z_2$ and $Z_3$. In fitting the curve between two end points, the angles at $Z_1$ and $Z_2$ are predetermined by Knuth. For example, where the curve is from $Z_0$ to $Z_1$ to $Z_2$, Knuth assumes, as a rule, the direction the curve takes through $Z_1$ is the same as the direction of the arc of a circle from $Z_0$ to $Z_1$ to $Z_2$. However, not all curved outlines will satisfy this rule and, in many cases, Knuth requires a further adaptation of that foregoing process to produce the desired shape, namely of a curve representing the actual smooth curved outline of a character.

Knuth's process starts using the rule described above specifying a circle when fitting a curve between three given points $Z_1$, $Z_2$, $Z_3$. Knuth does show that a parametric cubic curve as a function of a single parameter t, as also shown in "Fundamentals of Interactive Computer Graphics", can be modified, as shown on page 20 of Knuth, to include "velocities" specified as "r" and "s" and which are functions of the entrance angle and exit angle of the curve segment at the given end points. The velocities' values determine how the resulting curve will vary as a function of t, either slowly describing a longer curve distance or more quickly describing a shorter curve distance. The r and s formulas are arbitrary and, in the case shown by Knuth, are chosen to provide excellent approximations to circles and ellipses when $\theta$ equals $\phi$ and $\theta+\phi$ equals 90 degrees. Additional properties chosen to be satisfied by Knuth's arbitrary formulas for r and s are further described in TEX and METAFONT.

In addition to Knuth's internal requirement to specify an entrance and exit angle at the curve end points, where no previous angle or curve history is given, Knuth also must use the circle approximation rule, specified above, for each of the end points on the curve. This means that where the actual curve to be generated is not accurately produced by the Knuth circle approximation, an adjustment must be made. Knuth makes this adjustment by manipulating adjoining points. For example, where the curve is to be fit between points $Z_1$, $Z_2$ and $Z_3$. Knuth may manipulate the locations of $Z_0$ or $Z_1$ or $Z_3$ or $Z_4$ to obtain accurate fit. A further problem in Knuth occurs when the sign of $\theta$ is the same as the sign of 100 implying (a) the curve entrance angle at point $Z_1$ is in the same quadrant as the curve exit angle at $Z_2$, (b) a sine wave between $Z_1$ and $Z_2$ and (c) an inflection point. Knuth must resort to a manipulation of point locations to obtain a desired smooth curve around the inflection point.

In summary, the processes described above for producing outlines and showing the use of a parametric cubic curve expressed as a polynomial capable of generating a series of points along the locus of a curve between two given points can only do so with the disadvantages noted above. In the following summary of the invention, the method and system for using a parametric cubic curve which accurately reproduces a curve section between given points is shown and described and which method and system avoids the disadvantages discussed above.

SUMMARY OF THE INVENTION

This invention has as its object the generation, encoding and display of a series of points (nodes) along the locus of a curve segment between two given end points which are defined as "knots". It has been specifically developed to generate the locus of points (nodes) along the smooth curved outline of characters or symbols between given knots (i.e., $Z_{a-1}, Z_a, Z_{a+1} \ldots Z_{n-1}, Z_n$), but it should be understood that its use is not necessarily limited to that purpose but may be used to generate and display smooth continuous curves between any end points, regardless of the application.

In the case of the applicant's preferred embodiment, the knots are coordinate points along the outline of a character, which may be an alphanumeric or any other character or symbol and which coordinate points may be representative of a master size encoded character at a normalized size, on a dimensionless normalized encoding grid. The coordinate points may be decoded for display at a predetermined normalized display size or at an expanded or reduced size. The knots may be along any outline or surface whether two or three dimensional, although the applicant's preferred embodiment is shown in a two-dimensional model for use in smooth continuous curve generation. Using the method and system of applicant, the nodes along a two-dimensional curve or three-dimensional surface locus may be generated. The system shown herein generates the nodes using the encoded knot positions and the slopes of the curve at the knots. The process generates signals representing the nodes' coordinate values and is based upon the length (Z) between the knots and the angular interrelationship (B) of each of the knots with respect to a reference angle on the encoding grid.

In the preferred embodiment, the knots' coordinates are encoded in a closed data loop and represent dimensionless coordinates about the closed outline loop of the character or symbol. The method described herein enters the closed data loop at a set of encoded coordinates representing a knot on the closed outline loop and initiates the node generating process by using the angular interrelationships of the knots about that entry knot. However, other methods may be used to initiate the process without departing from the inventive concept. In applicant's preferred embodiment, once having entered the encoded closed data loop, the analysis may proceed in a clockwise or counterclockwise direction around the closed data loop.

It should be understood that the principles of this invention are not limited to a closed outline loop or closed data loop, but may be applied to open outline loops and to open data loops.

The process may be used to generate either a smooth continuous curve between the knots or some other form of curve, forming a cusp at a knot for example, and which although continuous, it is not smooth at all locations but angular, as in the shape of a "K" or "G". In the preferred embodiment of the invention, the selection of a smooth continuous curve or merely a continuous curve, having a cusp for example, is made using stored rules which serve as default command codes which use the interknot angles formed between the knots, and the distance between the knots to produce a desired result. For example, where the angle formed by two knots is in excess of a predetermined threshold angle, a default command code may direct that a cusp be formed. Other rules such as override control codes may be similarly used to force a cusp or smooth curve, regardless of the threshold conditions and which may be encoded in the closed data loop to override the default command codes as explained below.

Assuming, for the purpose of explaining the invention, it is desired to connect all knots in the closed outline loop with smooth continuous curves, the angles formed between an entrance knot at which the representative encoded data loop is entered and the first and second successive knots thereto in a chosen progression of knots in the closed outline loop are averaged to produce average angle values. As the curve formed between knots is a continuation of a curve which enters at the first of the knots ($Z_a$), and which exists at successive or at a second of the knots ($Z_{a+1}$), the tangent angles of the curve, which are the entrance angle at the first knot and exit angle at the second knot can be specified as average angles. The analysis continues by proceeding around the closed outline loop in the established progression of knots and the order thereof of the knots and examining the angles formed between the knots as described above.

As the knots form a master skeletal outline of the character or symbol when juxtaposed on a dimensionless encoding grid, arranged at a normalized size, the knots may be rotated or scaled relative to such a normalized encoding grid. Once the master encoded character or symbol (master encoded character) is scaled and positioned as desired, then the analysis described above, may continue wherein (a) the encoded closed data loop of knots in the closed outline loop is entered at a first set of coordinates representing a first knot, (b) the angular and spacial relationships of the knots on the normalized encoding grid are determined, using the representative encoded data and (c) for each set of knots along the closed outline loop, assuming that each knot is to be connected by a continuation of a smooth curve, the average angles of the respective curve segments entering and exiting the respective knots are determined. Where a smooth continuous curve is desired, then the entrance angle of the curve segment at a knot would normally be the same as the exit angle of the curve from that same knot.

By using the foregoing method of analysis, namely, determining the average angles made by the curve passing through the knots, and using those average angles to represent the slope of the tangents to the particular curve segment at the respective knots, the disadvantages shown in the prior art are overcome.

In particular, in this inventive concept, there is no need to define a circle between the knots and then compute the locus of nodes on the circle as Knuth does. A faster process results using this invention which requires only the interknot angles of the knots relative to each other and to a reference angle be known. The process as stated above, uses a parametric cubic polynomial relationship of a single variable t to generate signals or data, indicative of and representing the coordinates of nodes on the locus of a smooth continuous curve segment between sets of respective knots. Where a greater resolution and greater number of nodes is needed to describe the locus, then the incremental value of the parameter t, may be decreased providing a greater number of discrete cumulative values of t and node coordinates. Where less resolution and fewer nodes are needed to define the locus, then the incremental value of t can be enlarged, producing fewer discrete cumulative values of t and nodes.

In the preferred embodiment, the dimensionless normalized master encoding grid represents an EM space ($M^2$) of 864 by 864 Dimensionless Resolution Units (DRU's) in each of the X, Y axes. The $M^2$ is a measure used in the typesetting trade wherein a character is set within an $M^2$ and is shown herein in a manner consistent with the application of the inventive principles in the preferred embodiment. When the master encoded character is to be displayed, the master encoded character, at a normalized size on the normalized encoding grid is scaled, the knot coordinate positions at the scaled size are encoded and expressed in the appropriate display intercept units such as Raster Resolution Units (RRU's). These scaled encoded knots in the preferred embodiment are expressed in terms of the display RRU's and used to determine the incremental value of t. The incremental value of t is used to generate discrete cumulative values of t which are then applied to the cubic parametric polynomial to generate the node coordinates. Then through the cubic parametric polynomial relationship, signals indicative of the coordinates of the nodes are generated and stored as data. As defined by a parametric expression of a single parameter t, the resultant node's x, y coordinate values (X or Y are the axial directions in the preferred embodiment), vary separately as separate functions of t [i.e. x(t), y(t)]. At the scaled size, the incremental value of t may be related to the reciprocal of the distance between knots expressed in RRU's (i.e. $Z_d = |Z_n - Z_{n-1}|$) or any other suitable method may be used to produce a value of t. Values representing the node coordinates are then generated using these incremental values of t, each value being added, to the previous cumulative values (with the second incremental value of t being added to the first incremental value of t and the third incremental value of t being added to the previous cumulative value of t and so on). In the preferred embodiment, the value of t is set to vary from 0 to 1.

The resulting series of signals, stored as encoded data, represent knots and nodes which define the locus of the smooth continuous curve between the knots and the outline of the character or symbol is a machine part ultimately used to control or modulate a display to form the desired character or symbol at the desired size, in a visual image. The resultant data may be run length data, which is applied directly to a raster beam, to position the beam and energize the beam accordingly, or may be used to control a free running raster. Interpolation, rounding or truncating of value may be used to locate the nodes on the display intercepts corresponding to the raster line locations, where exact coincidence is lacking.

As previously stated, as characters or symbols are not always smooth curves but may contain cusps, a threshold test may be used, such as one based on the exterior angle formed by lines between knots. Where that exterior angle at a knot is greater than a predetermined threshold angle, for example, a cusp may be assumed. It being understood, however, that if the exterior angle is less than the threshold angle, the analysis previously described with regard for producing a locus of nodes to define a smooth continuous curves would be used.

In the preferred embodiment, the master encoding grid is a Cartesian coordinate system. As the preferred embodiment is used in typesetting, the encoding grid relative to which the character is encoded is set within an $M^2$, which in the preferred embodiment contains 864 by 864 Dimensionless Resolution Units (DRU's). The master encoded character, at its normal size is set over a portion of the available normalized encoding grid area of the $M^2$. As is known in the typesetting field, expansion areas in the $M^2$ are also provided for large size characters. The character may be scaled, rotated or projected by ordinary known techniques and new coordinates for the knots may be determined accordingly, as is known in the art. In the preferred embodiment, the scaling is done in increments of 1/1024 DRU's. The new coordinate locations of the knots for the character at its scaled, rotated or projected positions are determined. As only integers are used in the preferred embodiment, any fraction or equivalent thereof is discarded. In the process, the percent of reduction or enlargement is first calculated in relation to a desired character size in units of typesetter's points. The precision of the scaling is increased by an autoscaling linear interpolation increaseing the resolution of the linear interpolation, as explained below. The result is a scaled coordinate point in RRU's without the need to utilize floating point arithmetic.

In the preferred embodiment and as stated above, override control codes are accessed responsive to data stored with the stored knot coordinates to reduce storage and the processing time.

The code 0 is used to indicate the end of all the loops.

A code 1 is used to indicate the movement in a relatively long direction on an axis, for example, the X axis. In this case, an X value is replaced with a new X coordinate value.

The code 2 indicates the same process as a code 1 for another axis, for example, the Y axis direction, where the Y value is replaced with a new Y coordinate value.

A code 3, as in codes 1 and 2, indicates X and Y are both replaced with new coordinate values.

A code 4 indicates the finish of a previous encoded loop and the start of a new loop.

Codes 5, 6 and 7 indicate that the X,Y or XY directions are respectively altered.

Codes 8 to 11 are editing commands forcing predetermined conditions for the curve at the respective knots as will be described.

The knots may be encoded in the closed data loop on a 4-bit memory boundry (nibble) and in the preferred embodiment, the first nibble value of a complete information set of nibbles is used to specify the number of nibbles used in the complete information set.

Additionally, the data is packed in a novel manner which can be interpreted as spacial information or control codes, as will be explained.

In summary, the inventive concept is a process and system for transforming a machine part, in the form of signals, encoded as data and representing a pattern of knots on the outline of a master size symbol, into a similar pattern at a reduced or enlarged size or transposed in space, by generating a series of encoded data signals representing nodes which more definitely define the said pattern in the shape of smooth continuous curves or cusps and which data signals may be directly used to control a display process to visually display the pattern.

Accordingly, what is disclosed is a method and system for generating a series of signals representing nodes on a locus of a curve partially defined by a set of related knots, encoded as data, with said knots defining the end points of respective segments of said curve locus and with said knots being in a successive order in relation to said locus, and for encoding said node signals as data for use when representing said curve segments in a separate additional process responsive to the shape of said curve locus, as represented by said encoded node signals. The method and system involve defining the locations and the successive order of said knots on said curve locus and encoding as data, signals indicative of said knots, then for a first knot, ($Z_a$), representing a first end point of a first curve segment, deriving a first angle, indicative of the average of the interknot angles between said first knot ($Z_a$), and selected related knots and encoding as data, signals indicative of said first angle, at a second of said knots ($Z_b$), representing a second end point of said first curve segment, establishing a second angle for said first curve segment, and encoding as data, signals indicative of said second angle, establishing a compiler for compiling data according to a cubic parametric polynomial relationship between a parameter "t", said knots and angles at the said end points of a said curve segment and the locus of a said curve segment, establishing a range "R" of values for said parameter "t", applying said signals indicative of the said locations of said first and second knots of said first curve segment, to said compiler, applying said signals indicative of the said first and second angles of said first curve segment to said compiler, applying a signal indicative of a distinct selected value of said parameter "t" within said range "R", to said compiler to derive a signal indicative of a respective node location on said first curve segment, repeating the above by applying signals indicative of additional distinct selected values of said parameter "t", within said range "R", to derive a plurality of signals indicative of respective node locations on said locus of said first curve segment for respective distinct selected values of said parameter "t", and encoding said signals derived in step (h) and (i), in a data base to represent said first curve segment.

Further disclosed is a method of encoding data and an encoded data system representing knots on an outline defined relative to a coordinate plane involving selecting sets of coordinates on said outline, to represent the knots, establishing a successive order of said knots, encoding said knots in a data order indicative of said knot order, and encoding by encoding a complete information set of data providing a control code indicative of either (i) the coordinate locations of said knots or (ii) a knot's direction relative to others of said knots or (iii) a predetermined shape of said outline between a pair of said knots or (iv) data indicative of the shape of said outline at a knot or (v) encoding a complete information set providing the coordinate distances between adjacent knots.

Further disclosed is a method and system for encoding data representing knots on an outline defined relative to a coordinate plane and for generating a series of signals representing nodes on the locus of a curve partially defined by said set of knots, involving selecting sets of coordinates on said outline, to represent said knots, establishing a successive order of said knots, encoding said knots in a data order indicative of said knot order, and encoding a complete information set of data providing a code indicative of a predetermined shape of said outline between a pair of said knots or a complete information set providing the coordinate distances between adjacent knots.

Further disclosed is a method and system for generating a series of signals representing nodes on a locus of a curve partially defined by a set of related knots, encoded as data, with said knots defining the end points of respective segments of said curve locus and with said knots being in a successive order in relation to said locus, and for encoding and decoding said node signals as data and for use of said data when in an imaging process responsive to the shape for said curve segments as represented by said encoded data, involving defining the locations and the successive order of said knots on said curve locus and encoding as data, signals indicative of said knots, for a first knot, ($Z_a$), representing a first end point of a first curve segment, deriving a first angle, indicative of the average of the interknot angles between said first knot ($Z_a$), and selected related knots and encoding as data, signals indicative of said first angle, at a second of said knots ($Z_b$), representing a second end point of said first curve segment, establishing a second angle for said first curve segment, and encoding as data, signals indicative of said second angle, establishing a compiler for compiling data according to a cubic parametric polynomial relationship between a parameter "t", said knots and angles at the said end points of a said curve segment and the locus of a said curve segment, establishing a range "R" of values for said parameter "t", applying said signals indicative of the said locations of said first and second knots of said first curve segment, to said compiler, applying said signals indicative of the said first and second angles of said first curve segment to said compiler, applying a signal indicative of a distinct selected value of said parameter "t" within said range "R", to said compiler to derive a signal indicative of a respective node location on said first curve segment, repeating the above by applying signals indicative of additional distinct selected values of said parameter "t", within said range "R", to derive a plurality of signals indicative of respective node locations on said locus of said first curve segment for respective distinct selected values of said parameter "t", encoding said signals derived above in a data base to represent said first curve segment accessing said data base signals, and controlling an imaging means responsive to said accessed signals to reproduce said curve.

Further disclosed is a method and system for linear interpolation of coordinate points between first and second end points, to produce coordinates on a straight line outline and where said coordinates are located on a coordinate system having a first coordinate direction and second coordinate direction and encoded in machine readable data words a radix "r", corresponding to the order of values for designated positions in said data words, involving encoding a first data word of "N" positions corresponding to the distance between the said first and second end points in the said first coordinate direction and placing said first data word into a first machine location, encoding a second data word of "M" bits corresponding to the distance between said first and second end points in said second coordinate direction and placing said second data word into a second machine location, determining the number of available positions, between the most significant position of said first data word and the most significant position of said first machine location, available for shifting said first data word in a first direction of the most significant positions of said first machine location, shifting said first data word by a maximum number of positions, equal to the said number of available positions in said first direction and the number of positions corresponding to the number of significant positions used to encode said second data word, and increasing the scale of said first data word by a scale factor related to the number of said positions shifted, deriving a third data word indicative of said second data word in said second machine location divided into said first data word shifted according to step (d), encoding data words indicative of the coordinate of said straight line in said coordinate direction, for respective ones of said data words encoded according to step (f) encoding a multiple of said third data word, which are related to a respective coordinate in said first coordinate direction, on said straight line, reducing the scale of said multiples of said third data words above, to the scale of the first data word established prior to the above said shifting and encoding said third data words produced above with respective coordinates in said second coordinate direction to produce said coordinates on said straight line.

Further disclosed is encoding data representing knots on an outline defined relative to a coordinate plane and for decoding said encoding data for use in a display process to produce images of said outlines represented by said encoded data by selecting sets of coordinates on said outline, to represent said knots, establishing a successive order of said knots, encoding said knots in a data order indicative of said knot order, the encoding including encoding a complete information set of data providing a control code indicative of either (i) the coordinate locations of said knots or (ii) a knot's direction relative to others of said knots or (iii) a predetermined shape of said outline between a pair of said knots or (iv) data indicative of the shape of said outline at a knot, or (v) providing data indicative of the coordinate distances between adjacent knots, decoding said complete information sets in a decoding order related to said data order responsive to said complete information set being indicative of the coordinate distances between adjacent knots, producing an image of a smooth continuous curved outline or a straight line between said adjacent knots or, responsive to said complete information set being indicative of a said control code, as set forth in (i), (ii), (iii), or (iv), producing an image of a smooth continuous outline or a straight line according to the said coordinate locations of said knots relative to adjacent knots in said successive knot order or producing an image of said outline being smooth at respective knots or being sharp and forming cusps at respective knots.

Further disclosed is encoding data representing knots on an outline loop defined relative to a coordinate plane, for producing a display image of said outline and decoding responsive to the interrelationship of said knots on said outline loop, and imaging said outline loop responsive to said decoded data involving selected sets of coordinates on said outline loop, to represent said knots, establishing a successive order of said knots, encoding said knots in a data order indicative of said knot order, encoding a complete information set of (i) data indicative of the coordinate distances and interknot angles between adjacent knots, comparing the relative positions of successive knots to at least a first interknot criterion, responsive to said step (d) of comparing, (i) producing a first indication that a set of said successive knots is within said criterion, or (ii) producing a second indication that a set of said successive knots is outside said criterion, and (i) responsive to said first indication imaging said outline loop in the form of a smooth continuous curve, or (ii) responsive to said second indication, imaging said outline loop in the form of a straight line, between said set of successive knots.

Further disclosed is encoding and accessing a single data set of solution values functionally related to and representing the solution set to at least two domains of a variable, involving defining a single data set of solution values functionally related to a first domain of a variable and to a second domain of a variable, arranging said data set of solution values in an order related to said first domain and said second domain, accessing said data set of solution values relative to respective values in said first domain to derive at least a part of said solution set to said first domain, and accessing said data set of solution values relative to respective values of said second domain to derive at least a part of said solution set to at least said second domain.

DESCRIPTION OF THE PREFERRED EMBODIMENT

As stated in the summary, the object of this invention is to generate a series of display signals, representing nodes describing the locus of a smooth continuous curve at a desired size, from a normalized curve encoded as a set of encoded knots. Normalized is used in its general and ordinary meaning to denote a norm or standard size. However, as would be apparent to those skilled in the art, the displayed curve, described in terms of display intercept coordinates (RRU's) is dependent upon the resolution of the display, and the rate or relationship between the number of raster resolution units (RRU's) at a given display resolution to the dimensionless resolution units (DRU's) in which the curve is encoded at its normalized size and on the normalized grid. The normalized encoded curve may also be thought of as a master which is encoded at a master size relative to the master encoding grid which may have any suitable coordinate system and which after scaling, may be used to generate the encoded data representing display intercepts in raster units, at a given raster resolution for any desired display size character. As the inventive concepts disclosed herein are used in the typesetting industry to produce typeset composition containing characters having curved outlines in conformance to the highest graphic standards, scaling starts with a determination of the desired size of the character in any chosen system of measurement. In the preferred embodiment, character size is expressed in printer's points (351.282 micrometers/point or 0.01383 inches/point). It being understood, however, that the invention can be used in connection with other units of measurements and with applications outside the printing or typesetting industry, without deviating from or changing the inventive concepts shown herein. The invention, as described herein is with reference to the printing industry, where the master encoding grid is made synonymous with a dimensionless encoding grid in the form of a typesetting $M^2$. This is the application of the preferred embodiment of the invention and discloses the best mode of using the invention.

Figure 1A:
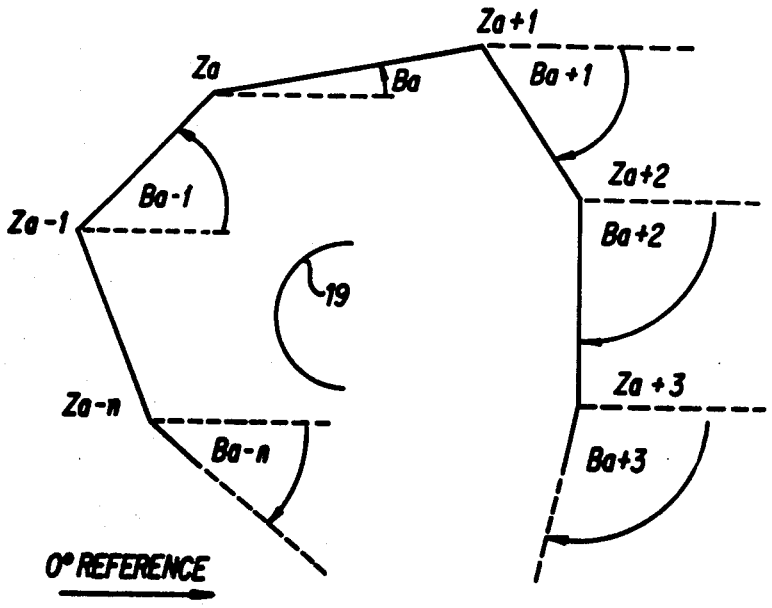
FIG. 1*a* shows a set of knots (i.e. $Z_a$, $Z_{a+1}$, $Z_{a+2}$, . . . ) forming the skeletal outline of a master encoded character.

The problem solved by this invention may be best considered by viewing FIG. 1*a* which shows a series of data encoded knots ($Z_{a-1}$, $Z_a$, $Z_{a+1}$, $Z_{a+2}$ . . . ) on a dimensionless encoding grid having coordinates in the X and Y axial directions, with the X direction coinciding with a zero degree (0°) reference angle. It should be understood, however, that any system of coordinates can be used with any reference angle chosen without changing the manner in which the inventive concepts are used.

Figure 1B:
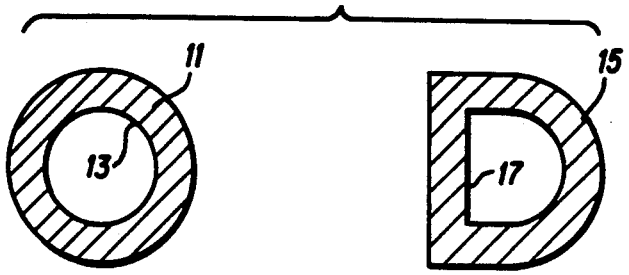
FIG. 1*b* shows the closed outline loops with reference to a character.

As shown in FIG. 1*a*, a number of knots $Z_{a-1}$, $Z_a$, $Z_{a+1}$, $Z_{a+2}$, $Z_{a+3}$ inclusive to $Z_{a-n}$ represent an outline loop which may be smooth and continuous over a series of such knots or continuous without being smooth over a series of such knots or a combination of the foregoing. As stated, the knots represent the skeletal outline of a predetermined normalized or master size character or symbol (hereinafter referred to as master size character), on a juxtaposed dimensionless encoding grid where the coordinates have dimensions of Dimensionless Resolution Units (DRU's). In the case of the encoded character, the master size is with reference to the normalized encoding grid and the area within the grid. The interknot angles between the knots, with reference to the reference angle, are shown as generally denoted by "B" and particularly as $B_{a-1}$, $B_a$, $B_{a+1}$ and so on for the interknot angles at respective knots $Z_{a-1}$, $Z_a$, $Z_{a+1}$ and so on. FIG. 1*a* shows a skeletal outline as may be typically used for symbol wherein all the knots $Z_{a-1}$ through $Z_{a-n}$ on the symbol outline are arranged on a closed outline loop. This relationship in its simplest form could be shown by the knots for the outline of an O or D, encoded with two such closed outline loops, for the exterior closed outline loops 11 and 15 and one for the interior closed outline loops 13 and 17 respectively, as shown in FIG. 1*b*.

As shown in FIG. 1*a*, a direction of progression of the curve outline is chosen with reference to an defined by the order of the knots around the outline. That progression of the curve locus and order of knots is shown by numeral 19 in FIG. 1*a*. The chosen order of knots defining the said progression, (i.e. $Z_{a-1}$, $Z_a$, $Z_{a+2}$ . . . $Z_{a-n}$) establishes an outline loop of knots. That outline loop may be a closed outline loop which ends upon itself, as shown in FIG. 1*b*, by closed outline loops 11, 13, 15 and 17. As will be explained below, a compiler functioning according to a parametric cubic polynomial is used to generate signals indicative of nodes which are the coordinates of locations on the locus of a smooth continuous curve between the knots. The order of the knots, defines an outline loop and the respective order of the nodes by their locations relative to the knot and to each other on the outline loop, as would be apparent to one skilled in the art. As explained below, the data representative or indicative of these knots and nodes are encoded in a data order indicative of the order of the knots and nodes on the outline loop. This data order establishes a data loop. As further explained below, the data loop may be designed to close upon itself so that the ending data location for the data loop is the starting data location where data was accessed therefrom in the encoding process and forming a closed data loop corresponding to the closed outline loop.

As stated above, the knots $Z_a$, $Z_{a+1}$, etc., may be encoded in the Cartisian coordinate system as X-Y points, using as a reference the normalized encoding grid, or may be encoded in any other system of coordinate points. The outline between the knots is not encoded initially as it will be represented by a generated series of nodes and which will represent the smooth continuous curve locus of the outline, according to the principle of the invention. The display intercept values for the nodes on the curve locus, at a predetermined display size, are related to the encoded knots on the dimensionless encoding grid shown in FIG. 1*a* by a parametric cubic polynomial relationship. Since the invention is used in a two-dimensional system, the parametric representation represents the curve locus of such nodes Z(X,Y) independently as a third order polynomial function of a parameter "t" which is independent of the encoding grid coordinates. In the preferred embodiment, the parametric cubic polynomial is shown in a Hermite form, it being understood that those skilled in the art can use other forms for defining the polynomial such as the Bezier form, defined in "Fundamentals of Interactive Computer Graphics", referred to in the foregoing, and to which the improvements of this invention are applicable.

The parametric representation of a curve is one for which X and Y are represented as a third order (cubic) polynomial relationships of a parameter "t" where:

$$x(t)=a_xt^3+b_xt^2+c_xt+d \qquad 1.1$$

$$y(t)=a_yt^3+b_yt^2+c_yt+d \qquad 1.2$$

The Hermite representation of the parametric cubic polynomial uses the coordinate positions, of the knots, and the tangent angles at the knots, such as $Z_a$, $Z_{a+1}$, etc. The Bezier representation uses the positions of the curve's end points and two other points to define, indirectly, the tangents at the curve's end points. The improvements of this invention shown herein are applicable to any representation by the parametric cubic polynomial which uses the position of the curve's end points and the tangent angles of the curve at the end points, directly or indirectly. For sake of explanation, only the Hermite form will be discussed.

Figure 2:
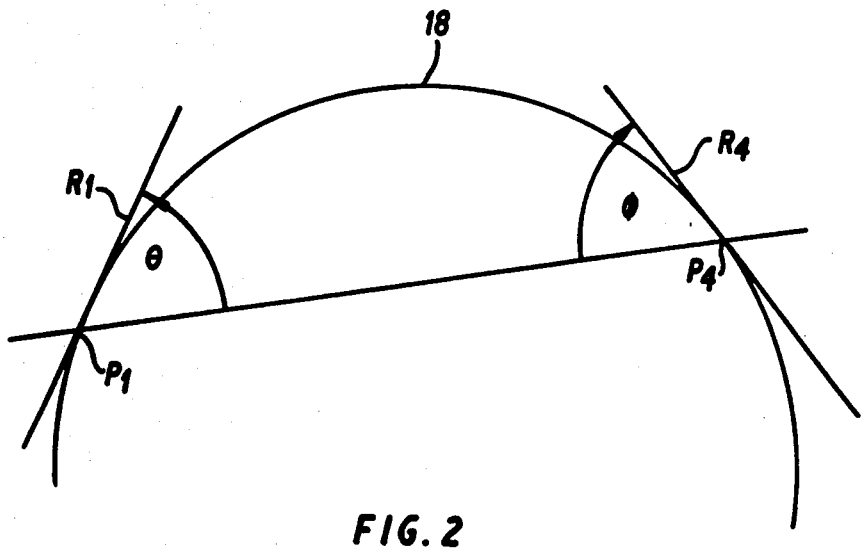
FIG. 2 shows the relationships of the knots, tangent angles and angles and to a curve, for the purpose of explaining the Hermite interpolator.

As shown in FIG. 2, given end points $P_1$, $P_4$ and the respective tangent vectors $R_1$, $R_4$ at the two end points $P_1$, $P_4$ and along the smooth continuous curve segment 18, a cubic parametric polynomial relationship between a parameter "t" and the locus of a curve segment 18, between a pair of end points, $P_1$, and $P_4$, may be represented as the following relationships below.

$$x(t)=P_{1x}+(3t^2-2t^3)(P_{4x}-P_{1x})+t(t-1)^2R_{1x}+t^2(t-1)R_{4x} \qquad 2.1$$

$$y(t)=P_{1y}+(3t^2-2t^3)(P_{4y}-P_{1y})+t(t-1)^2 R_{1y}+t^2(t-1)R_{4y} \quad 2.2$$

where ($P_{1x}$, $P_{1y}$) ($P_{4x}$, $P_{4y}$) are the coordinate values at $P_1$ and $P_4$ respectively, and ($R_{1x}$, $R_{1y}$) and ($R_{4x}$, $R_{4y}$) are the tangent values at $P_1$ and $P_4$ respectively, with respect to a straight line between $P_1$ and $P_4$ thereafter called entrance and exit angles, respectively.

Cubic curves as a minimum are used, as no lower order representation of curve segments can provide continuity of position and slope at the end points where the curve segments meet, and at the same time can assure that the ends of the curve segment pass through specific points.

The derivation of the Hermite parametric cubic polynomials are shown in "Fundamentals of Interactive Computer Graphics" and the manner of using such parametric cubic polynomials to define the points along a curve are further discussed in $T_EX$ and METAFONT referred to in the foregoing.

The Hermite form of the parametric cubic polynomial is as stated is a series of curves as shown by Knuth in Chapter 2 in $T_EX$ and METAFONT and which is written in Euler notation as $$Z(t)=Z_1+(3t^2-2t^3)(Z_2-Z_1)+rt(1-t)^2\$_1-st^2(1-t)\$_2 \quad 3.1$$

$$\$_1=e^{i\theta}(Z_2-Z_1);\ \$_2=e^{-i\theta}(Z_2-Z_1);\ 0\leqq t\leqq 1 \quad 3.2$$

and, where r and s are positive real numbers. Equations 3.1, 3.2 define a curve having directions represented by the deviance angles $\theta$ and $\phi$ at $Z_1$, $Z_2$ respectively.

The relationship shown in 3.1, 3.2 may be encoded into a compiler designed to process input data related to the knot locations, the angles of the curve segment at its end points, and then for separate selected values of a parameter "t" to produce signals indicative of node locations on the locus of the curve segment. The compiler is shown at the end of the specification.

As stated above, the Hermite form of the parametric cubic polynomial is used in the preferred embodiment of the compiler but the principles of the invention can be used with any other cubic polynomial using the directions of the curve at end points of the curve and the end point locations.

Assuming a curve direction for a given knot order from knot to knot, and in particular, from knot $Z_1$ to knot $Z_2$, with knot $Z_1$ being the entrance knot for curve segment $Z_1$, $Z_2$ (hereafter curve segments will be defined by the respective segment and knots such as "curve $Z_1$, $Z_2$") and knot $Z_2$ being the exit knot for curve $Z_1$, $Z_2$, then $\theta$ is the angular direction of the curve $Z_1$, $Z_2$ at entrance knot $Z_2$, and $\phi$ is the direction of curve $Z_1$, $Z_2$ at exit knot $Z_2$. In the preferred embodiment, the interknot angle (B) made by the straight line from knot $Z_1$ and $Z_2$, is defined in terms of a reference angle given for the normalized encoding grid. Also, the angles $\not\text{a}$ and $\not\text{g}$ of the curve are related to that same reference angle. Therefore, the interknot angle expressed below as B and the angles of the curve at the entrance knot, defined below as $\not\text{a}$ and the angle of the curve at the exit knot, defined below as $\not\text{g}$, are all defined with regard to a reference angle.

As further explained below, according to the inventive principles, deviance angles $\theta$ and $\phi$, shown used in equation 3.1 and 3.2, are the curve entrance and exit angles $\not\text{a}$, $\not\text{g}$, respectively, defined with regard to the interknot angles B and applied to the compiler in the form of the parametric cubic polynomial, as shown in equation 3.1.

In explaining the invention, $\not\text{a}$ and $\not\text{g}$ are used to identify the entrance angle of a curve segment at a first knot end point and the exit angle made by that same curve segment at a successive second knot end point, in the knot order. The first and second knots define the entrance and exit knots of the curve segment, with regard to the order of knots and the outline loop, as explained below. However, $\not\text{a}$ and $\not\text{g}$ are defined relative to a reference angle "q" on the master encoding coordinate grid. $\theta$ and $\phi$ are the entrance angle and exit angle in the cubic parametric polynomial of 3.1 and 3.2, defined relative to an interknot angle B between the entrance and exit knots (i.e. in the preferred embodiment, $\theta=\not\text{a}-B$; $\phi=B-\not\text{g}$). The preferred embodiment uses a process of defining the entrance angle $\not\text{a}$ and exit angle $\not\text{g}$ in terms of the interknot angles on the outline loop, and with respect to a reference angle and uses the definition of the entrance and exit angles shown as $\theta$ and $\phi$ when applying the angles $\not\text{a}$ and $\not\text{g}$, at the respective entrance and exit knots, to the compiler, as based on and as required by the derivation of the cubic parametric polynomial, described herein. However, the angles $\theta$ and $\phi$ could be derived directly from the interknot angles B or precomputed from the relationship of the outline loop knots and accessed directly without first deriving $\not\text{a}$ and $\not\text{g}$ and without deviating from the principles of the invention.

The parameter "t" of 3.1 is allowed to vary over a defined range as further explained below, and for each discrete selected value of t, a discrete node on the locus of the curve between the entrance and exit knots and defined by the parametric cubic polynomial is generated by the compiler. The nodes would be the coordinate location of points on the locus of the curve described by equation 3.1 for each selected value of "t" and where knots $Z_1$ and $Z_2$, and the angle of the curve at those knots, given as $\not\text{a}$ and $\not\text{g}$, derived above, was specified. The derivation of $\not\text{a}$, B, $\not\text{g}$, $\theta$, and $\phi$ of "t" and their relationship according to the principles of the invention are further explained and shown below.

It should be noted, however, that the form of the Hermite interpolator used in the preferred embodiment imposes an opposite sign for $\phi$ than that shown in $T_EX$ and METAFONT shown in Knuth.

It should also be noted that the deviance angles $\theta$ and $\phi$ representing the divergence between the straight line angle interknot angle (B), as used in the cubic parametric polynomial of 3.1, 3.2.

"r" and "s" affect the curve velocities, as described below and the length of the curve between its respective end points (i.e., curve $Z_1$, $Z_2$ between $Z_1$, $Z_2$). "r" and "s" are velocities at $Z_1$, $Z_2$ respectively, a large velocity value meaning the curve direction changes slowly while small values indicate the curve undergoing more pronounced directional changes. The velocities, r and s, in $T_EX$ and METAFONT are represented as $$4.1 \quad r=\left|\frac{2^*\sin\phi}{(1+|\cos\Psi|)\sin\Psi}\right|$$

$$4.2 \quad s=\left|\frac{2^*\sin\theta}{(1+|\cos\Psi|)\sin\Psi}\right|$$

-continued 4.3 $\Psi = (\theta + \phi)/2$

Considering the effect of r and s on the curve locus defined by the nodes, produced through the cubic polynomial relationship, the values of r and s may be limited to control the direction of the curve from the entrance knot to the exit knot. In the preferred embodiment, r and s are limited to the values of 0.1 to 4.0. However, these values of r and s could be changed without departing from the principles of the invention.

As discussed in the foregoing, the system shown therein for using the relationship of the points along the smooth curve in $T_EX$ and METAFONT have disadvantages which are eliminated by this invention which will become apparent by reading the following explanation.

As explained above, in using the parametric cubic polynomial relationship to define the nodes along a smooth curve, $T_EX$ and METAFONT start with a circle approximation rule and then must make adjustments to produce a smooth continuous curve between given points. In this invention, those disadvantages are eliminated by the invention described in the following.

In the preferred embodiment, the sign of $\phi$ is reversed relative to the angle rotation used in $T_EX$ and METAFONT.

The principles of this invention as applied to the preferred embodiment, may now be particularly seen with reference to FIG. 1*a*. As stated above, a skeletal outline is described by a progression of a series of knots in the order of $Z_a$, $Z_{a+1}$ . . . $Z_n$, $Z_{a-1}$, which defines a closed outline loop about the outline of the character or symbol. The knots are encoded as coordinate points in a closed data loop, representing the closed outline loop. As stated, the object of the invention is to produce a series of nodes representing display coordinates on the locus of a curve between each of the knots, the curve being smooth and continuous. However, as will be shown, the principles of the invention can be modified so a series of points describing straight lines between knots can be generated and smooth continuous curves can be generated between knots which are interspersed with straight lines. In addition, cusps can be formed between smooth continuous curve and/or straight lines.

The smooth continuous curve is produced through the parametric cubic polynomial relationship described above. In using the invention, the following principles are applied. The data loop may be entered at the data values representing a knot, $Z_a$ for example, and the angular relationship of the knot ($Z_a$) referenced to a preceeding knot ($Z_{a-1}$) and to a succeeding knot in the loop analyzed. The analysis may then proceed in a clockwise direction around the loop which may be considered in the forward direction. However, as stated, the analysis can proceed in a counter-clockwise or backward direction with the direction being used to denote or indicate other values, such as color, or other characteristics as may be needed. As will be understood, the directions used herein are chosen for explanation and do not limit the inventive principles.

FIG. 1*a* represents a series of knots $Z_a$, $Z_{a+1}$, $Z_{a+2}$ - - - $Z_{a+n}$, $Z_{a-1}$ arranged in a closed outline loop, encoded relative to a master encoding grid and partially defining, in skeletal form, the points on a closed outline loop, such as outline 11, 13, 15, or 17, shown in FIG. 1*b*. The interknot angles, the angles from knot to knot (i.e. from knot $Z_{a-1}$ to knot $Z_a$) are denoted generally by the letter "B" with a subscript reference indicating that the angle is formed by a straight line from a respective knot, $B_{a-1}$ for example, to a successive knot $B_a$ in the outline loop. The terms "preceding" and "successive" can be used with reference to the defined order of knots in the outline loop, i.e. either clockwise or counter-clockwise, as the case may be. In FIG. 1*a*, the knot angles B are shown as $B_a$, $B_{a+1}$, $B_{a+2}$, and so on for respective knots.

The manner of applying the cubic parametric polynomial compiler in the preferred embodiment to define nodes between the knots along the locus of a smooth curve utilizes the deviance angle $\theta$ at the curve entrance knot and the deviance angle $\phi$ at the curve exit knot. The deviance angles $\theta$ and $\phi$ may also be referred to as entrance and exit angles.

According to the principles of the invention, and assuming a smooth and continous curve segment is desired to be developed between a first knob $Z_a$ and a second knot $Z_{a+1}$, for the curve $Z_a$, $Z_{a+1}$, shown as numeral 21, in FIG. 1*c*, then the inventive principles may be used to generate a series of signals representing the display coordinates for the nodes along the locus of the smooth continuous curve 21 as follows and similarly for the curves between others of respective pairs of knots. The data encoding of the knots representing each of the closed outline loops may also be thought of as a loop, or closed data loop, indicative of and representing the physical arrangement of the knots in the closed outline loop about the character or symbol outline. As stated, the outline loop and the data loop therefore, may be thought of as an order of knots in the loop path and related to a predetermined loop direction for such order (clockwise or counter-clockwise, for example). Within that progression, and for the respective outline loop direction, it can be easily seen that each knot (i.e. $Z_a$) represents an exit point for the curve segement of the outline loop in the knot order shown by the direction of arrow 20, from a preceding loop knot (i.e. $Z_{a-1}$) and at the same time, the entrance point for the curve segment from that knot (i.e. $Z_a$) to a successive knot (i.e. $Z_{a+1}$). The nodes, generated as explained below are given an order in the outline loop related to the order of knots on the outline loop and the encoding for the nodes is similarly arranged on the data loop in the order of the knots.

In explaining the invention, the convention used for identifying a curve part of the outline loop between knots is to refer to it by its knot end points, (i.e. curve part 21 is curve $Z_a$, $Z_{a+1}$). Similarly, a convention is used to identify a curve entrance and exit angle as explained below.

The entrance angle $\measuredangle$ for curve $Z_a$, $Z_{a+1}$ (between knots $Z_a$ and $Z_{a+1}$), according to our convention, would be the angle represented by the first derivative of the curve $Z_a$, $Z_{a+1}$ at knot $Z_a$ and the exit angle $\measuredangle$ would be te angle represented by the first derivative of the curve segment at the next successive knot $Z_{a+1}$.

As would be understood, where a smooth continuous curve is desired to pass through a knot, (i.e. Za) then the entrance angle $\measuredangle$, at a knot would be the same as the exit angle $\measuredangle$ at that same knot for the preceding curve segment $Z_{a-1}$, $Z_a$.

In explaining the principles of the invention, the entrance angles $\measuredangle$ and exit angles $\measuredangle$ for curve segments starting and ending at knots are defined for the respective knots according to the following convention. The curve segments may be thought of as having an entrance angle $\mathfrak{a}$ at the knot where the outline loop, in the defined progressive order of knots, enters a respective curve segment (i.e. curve $Z_a$, $Z_{a+1}$) forming an entrance angle $\mathfrak{a}_a$ at that entering knot, and an exit angle $\mathfrak{g}$ at the next successive knot in the loop where the loop exits curve segment $Z_a$, $Z_{a+1}$ forming exit angle $g_a$ at knot $Z_{a+1}$. In the convention chosen, the entrance and exit angles ($\mathfrak{a}_a$, $\mathfrak{g}_a$) for a curve segment ($Z_a$, $Z_{a+1}$) of the loop are referenced to the entrance knot ($Z_a$). The entrance angle, $\mathfrak{a}_a$, and the exit angle, $\mathfrak{g}_a$, therefore have a subscript reference to the entrance knot $Z_a$, but refer to the curve segment of the loop and the angle that curve segment makes at a first knot Za where the loop enters the curve $Z_a$, $Z_{a+1}$ and the angle at a successive knot ($Z_{a+1}$) relative to the outline loop direction where it exits the curve $Z_a$, $Z_{a+1}$. The entrance angle, $\mathfrak{a}_a$, is then the angle the loop makes as it passes through knot $Z_a$, enters curve $Z_a$, $Z_{a+1}$, and continues on to knot $Z_{a+1}$. The exit angle, $\mathfrak{g}_a$, is the angle the loop makes as it passes through knot $Z_{a+1}$, exits curve $Z_a$, $Z_{a+1}$, enters the next successive curve $Z_{a+1}$, $Z_{a+2}$ and continues on to the next subsequent exit knot, $Z_{a+2}$. In summary, the entrance angle, $\mathfrak{a}$, and exit angle, $\mathfrak{g}$, according to the convention chosen to explain the principles of this invention, refer to a curve segment of a loop outline between two knots such as $Z_a$ and $Z_{a+1}$, the entrance angle $\mathfrak{a}_a$ being the tangent angle or first derivative the outline loop makes as it enters curve $Z_a$, $Z_{a+1}$ at preceding knot end point $Z_a$ in the outline loop direction, and the exit angle, $\mathfrak{g}_a$, the tangent or first derivative of the outline loop it makes as it exits that curve $Z_a$, $Z_{a+1}$ at knot end point $Z_{a+1}$ and enters the next successive curve $Z_{a+1}$ $Z_{a+2}$, in the outline loop direction. As can be seen, the exit angle, $\mathfrak{g}_a$, for the curve $Z_a$, $Z_{a+1}$ is the same angle as the entrance angle $\mathfrak{a}_{a+1}$, for the next successive curve $Z_{a+1}$, $Z_{a+2}$, in the outline loop direction. Similarly, the entrance angle, $\mathfrak{a}_a$ is the exit angle, $\mathfrak{g}_{a-1}$ for the preceeding curve $Z_{a-1}$, $Z_a$. It will be understood by those skilled in the art that these conventions can be changed without changing the principles of the invention.

Whereas Knuth uses the rule that a smooth continuous curve locus between points, such as from $Z_{a-1}$ to $Z_a$ to $Z_{a+1}$, must take the direction of a circle, the invention herein avoids that rule and the problems created thereby by using an average of the interknot angles (B) relative to a knot to define the respective knot entrance and exit angles, $\mathfrak{a}$ and $\mathfrak{g}$ respectively, and thereby $\theta$ and $\phi$ respectively.

Figure 1C:
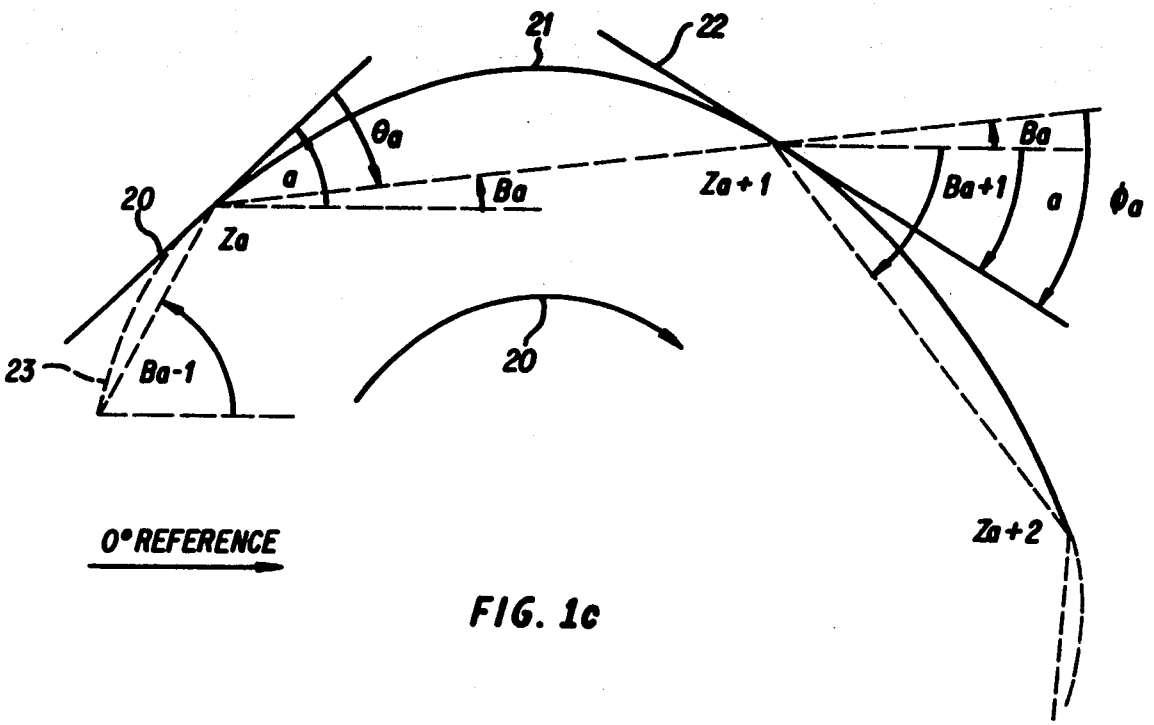
FIG. 1*c* shows curve segments $Z_{a-1}$, $Z_a$, $Z_a$, $Z_{a+1}$, and curve $Z_{a+1}$, $Z_{a+2}$ and the relationships of the deviance angles $\theta$ and $\phi$, at knot $Z_a$ and $Z_{a+1}$.

For example, in FIG. 1*c*, for the curve $Z_a$, $Z_{a+1}$, shown as numeral 21, the entrance angle $\mathfrak{a}_a$ at knot Za of the curve $Z_a$, $Z_{a+1}$, for example, is related to the average of the interknot angles $B_{a-1}$ (from the preceeding knot $Z_{a-1}$ to knot $Z_a$) and $B_a$ (from $Z_a$ to the succeeding knot $Z_{a+1}$). That average angle of the outline loop at any knot Z is a; so expressed as $\mathfrak{a}$ when referring to the entrance angle at a knot and into a curve segment and $\mathfrak{g}$ when referring to the exit angle from a knot and out of a curve segment. In the case of knot $Z_a$, the average entrance angle would be $\mathfrak{a}_a$ for the curve $Z_a$, $Z_{a+1}$ (shown by numeral 21), proceeding from $Z_a$ to $Z_{a+1}$ in the order shown by arrow 20 and $\mathfrak{g}_{a-1}$ for the average exit angle for the curve $Z_{a-1}$, $Z_a$ (shown by numeral 23), proceeding from $Z_{a-1}$ to $Z_a$ in the order shown by arrow 20.

The angles $\mathfrak{a}$ or $\mathfrak{g}$ are always referred to as entrance and exit angles respectively herein, but may or may not be average angles or not depending on the application of each, as explained herein.

The invention is explained with reference to the example of curve $Z_a$, $Z_{a+1}$, wherein $Z_a$ is the entrance knot and $Z_{a+1}$ is the exit knot, it being understood that the same analysis would apply to other curve segments either adjoining or further remote from curve $Z_a$, $Z_{a+1}$ and having respective entrance and exit knots.

In using the compiler to generate the nodes along a smooth continuous curve, the encoded data loop representing the knots along the closed outline loop may be entered at any set of data representing any knot Z, for example, designated to be the entrance knot and the average angle determined by proceeding in the chosen loop direction using the interangular relationships of a knot to its related knots in the loop, to determine the average angles a and g at such related knots. In the preferred embodiment, these related knots are adjacent knots to the next successive knot to the entrance knot.

In the preferred embodiment, the inventive principles of generating the nodes on the smooth continuous curve locus, starts with a first average angle, determined for the knot coordinate successive to the data loop entrance knot, and which is represented by the data residing at the location in the closed data loop where that data loop was entered. The interknot angle for the entrance knot is then saved and used at the completion of the loop analysis to determine the average entrance and exit angles at that entrance knot when the outline loop analysis reaches that entrance knot in the closed outline loop knot. Where the data loop entrance knot is $Z_{a-1}$, its average angle would be determined using the preceding interknot angles $B_{a-2}$ and $B_{a-1}$ for related knots $Z_{a-1}$ and $Z_{a-2}$.

Following the above, the average angle $\mathfrak{a}_a$ and exit angle $\mathfrak{g}_{a-1}$ at knot $Z_a$ is the average of $B_{a-1}$ and $B_a$ and expressed as $$\mathfrak{a} = B_{a-1}/2 + B_a = \quad \mathfrak{g}_{-1}$$

The average exit angle $\mathfrak{g}_a$ and entrance angle $\mathfrak{a}_{a+1}$ at knot $Z_{a+1}$ is the average of $B_a$ and $B_{a+1}$ and expressed as $$\mathfrak{g} = B_{a+1}/2 + B_a = \quad \mathfrak{a}_{+1}$$

As shown, the average entrance angle $\mathfrak{a}$ for any curve segment is the average of the interknot angles at the respective curve segment knot and at related knots, (i.e. the preceding knot in the outline loop) and the average exit angle $\mathfrak{g}$ is the average of the interknot angles at the respective curve segment exit knot and at related knots (i.e. the next successive knot in the outline loop), as shown above.

The parametric cubic polynomial compiler may then be employed to relate the entrance and exit angles $\mathfrak{a}$, $\mathfrak{g}$ for the respective entrance and exit knots to a series of nodes describing the locus of a smooth curve between the respective entrance and exit knots (i.e. $Z_a$, $Z_{a+1}$). For the example above, the knots are $Z_a$, $Z_{a+1}$ and the respective entrance and exit angles are $\mathfrak{a}_a$ and $\mathfrak{g}_a$ for curve $Z_a$, $Z_{a+1}$.

The curve velocities r and s are related to the deviance angles $\theta$ and $\phi$, as set forth above and as used in equation 4.1, 4.2, 4.3. As stated in the foregoing, $\theta$ is the deviance between the average entrance angle, for example, $\mathfrak{a}_a$ for curve $Z_a$, $Z_{a+1}$, at an entrance knot $Z_a$ and the interknot angle $B_a$ at that entrance knot $Z_a$. Similarly, $\phi$ is the deviance between the average exit angle, for example, at the exit knot, $Z_{a+1}$, for the curve $Z_a$, $Z_{a+1}$ and the interknot angle $B_a$ at that entrance knot Za.

Figure 1D:
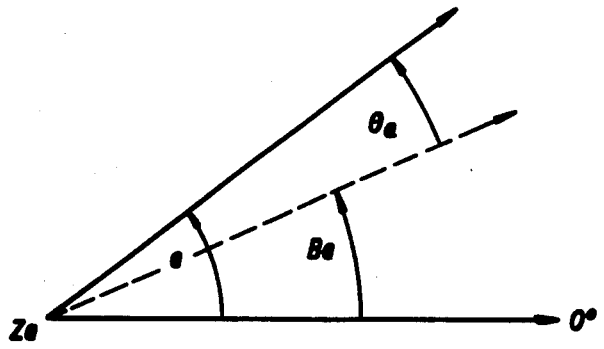
FIG. 1*d* and FIG. 1*e* shows in greater detail the deviance angles of the curve segment $Z_a$, $Z_{a+1}$, at the repective entrance and exit knots, as functions of the interknot angle (B) and the entrance and exit angles.
Figure 1E:
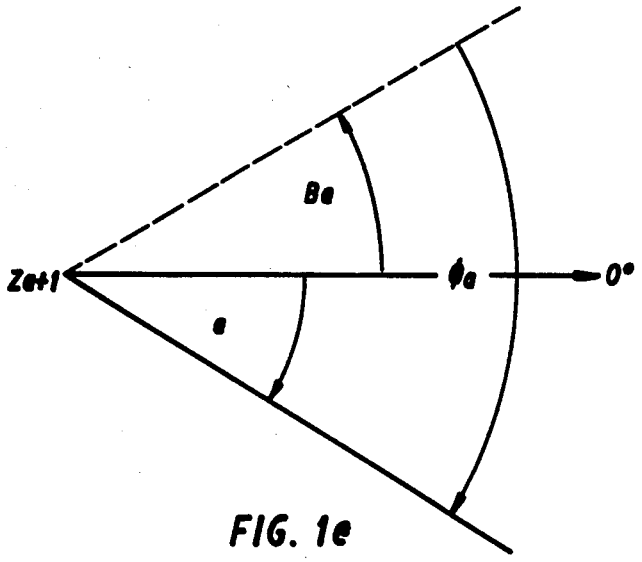

The relationships between $\measuredangle_a$, $B_a$, $\measuredangle_a$, $\theta_a$ and $\phi_a$ may be more clearly seen in FIGS. 1*d* and 1*e* for knots $Z_a$ and $Z_{a+1}$ respectively.

As a reminder, it should be remembered that the angles, $\theta$ and $\phi$ are the tangents to the locus of the curve represented by the nodes generated using the cubic parametric polynomial compiler with respect to the respective interknot angles.

Figure 3:
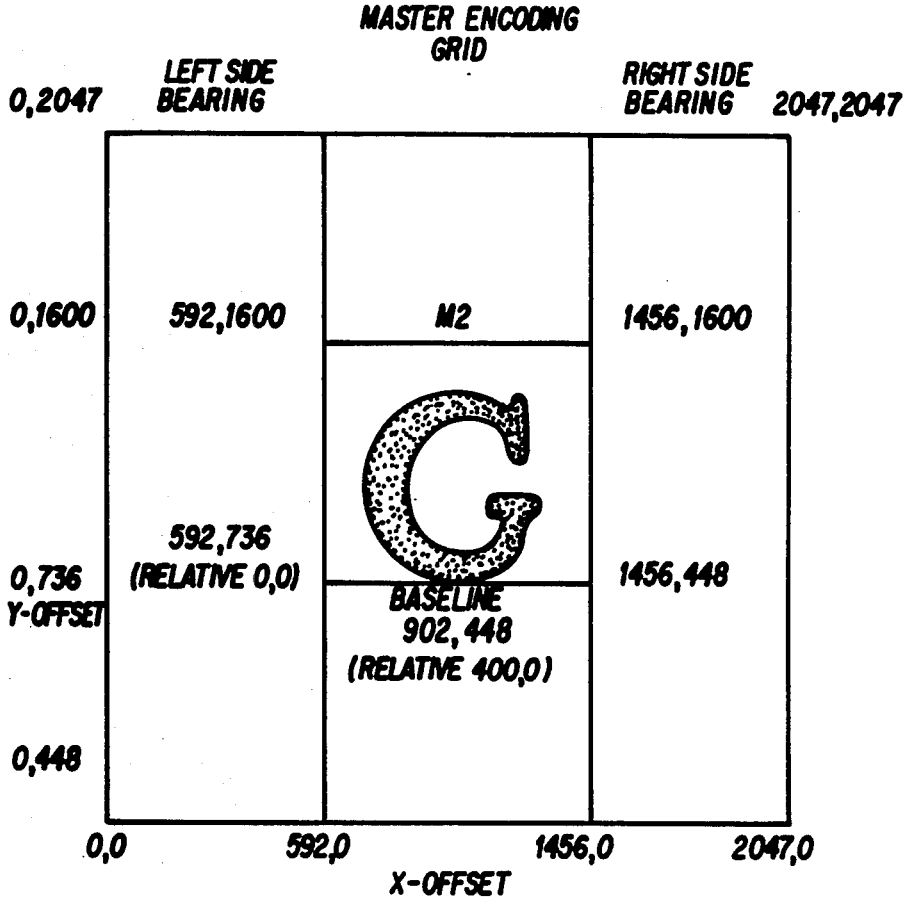
FIG. 3 shows a master encoding grid as may be used in the preferred embodiment, at a normalized size, for encoding a character or symbol such as the character G shown in FIG. 3, as a master encoded character, at a normalized size.

The coordinate values of $Z_a$, $Z_{a+1}$, used through the parametric cubic polynomial compiler to generate the node values are the scaled intercept values given in RRU's, derived from the master encoded values of the knots, in DRUs. For example, assuming an encoding grid shown as an $M^2$ in FIG. 3 and defined as 864×864 DRU's between master encoding grid (x,y) coordinates 592, 746; 592, 1600; 1456, 1600 and 1456, 448 (wherein x,y points 592, 736 are defined as relative 0,0, relative to an x, y offset of 592, 736 respectively) and wherein the encoding grid is defined as 2047 by 2047 DRU's.

In the preferred embodiment, the universe of the master encoding grid comprising the $M^2$ is 32768×32768 DRU's and the offset which positions the origin of the $M^2$ can be positioned anywhere in that universe. In the preferred embodiment, the x and y offsets and shown in FIG. 3.

The x,y coordinates of the intercept locations for knots $Z_a$ at the displayed size in RRU's may be derived prior to generating the nodes by scaling, using the following conversion factor (CF), for the preferred embodiment. Where:

"P" in the desired display size in points per $M^2$ ($Pt/M^2$),

"Res" is the ratio of micrometers per point (uM/Pt) and serves to convert the display size from points to metric units;

"RRU/MM" is the display resolution in Raster Resolution Units per Micrometer;

$M^2$/DRU is the inverse of the encoding grid resolution, in DRUs per $M^2$; and $$(P)*(Res)*(RRU/MM)*(M^2/DRU)=(CF)*(RRU/DRU)$$

For Master Coordinate $Z_n(X_n, Y_n)$, $$(X_n\ DRUs)\ (CF_x\ RRUs/DRU)=X_n\ RRUs,$$

and $$(Y_n\ DRUs)\ (CF_y\ RRUs/DRU)=Y_n\ RRUs$$

The value of the parameter t may be derived from the respective curve segment interknot distance $Z_d=|Z_{n+1}-Z_n|$ given after scaling in RRUs, as described below. The generated coordinates for the nodes are expressed in RRU's permitting run length encoding of the display outline coordinates. Where $Z_d$ is a non-integer, the fractional value may be discarded or rounded with redundant values eliminated.

In the preferred embodiment of this invention, the incremental value of t is related to the inverted value of the absolute difference $Z_d$ between the entrance and the exit knots, i.e. $t_inc=1/Z_d=1/|Z_{n+1}-Z_n|$.

Zn may be easily derived from the axial difference in the X direction, [i.e. $Z_d=[(X_{n+1}-X_n)/\text{Cosine}\ (B_n)]$, or the axial difference in the Y direction, $[Z_d=[(Y_{n+1}-Y_n)/\text{Sine}\ (B_n)]$; Where $X_n$ $Y_{n+1}$; $X_{n+1}$, $Y_{n+1}$ are successive knots defining end points for a curve segment of the closed outline loop and Bn is the interknot angle there between).

In practice, it is better to use the larger axial value in the X or Y direction, to minimize error. In implementing the invention, the preferred embodiment limits increments of t to 1/1024. Discrete values of $T_1=3t^2-2t^3$, $T_2=t^2(1-t)$ and $T_3=t(1-t)^2$ (see equation 3.1, 3.2) may be stored in a look-up table for 1024 values of t in the range 1/1024 t 1024/1024.

In practice t is stored in the range of 1023/1024 because the knot end point coordinate corresponding to t=1024/1024 or 1 is saved, avoiding the need to calculate that knot end point and providing a more reliable result.

Figure 4:
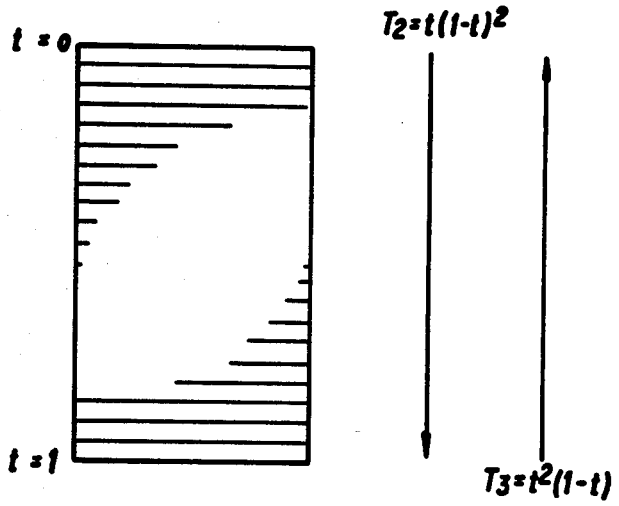
FIG. 4 shows the manner a look-up table may be arranged so access in one direction would provide a value equal to $T_2$, as explained herein, and in the opposite direction, a value of $T_3$, as explained herein.

Further, because of the relationship of $T_1$, $T_2$ and $T_3$, a look-up table as shown in FIG. 4, having values of $T_2$ starting with t=0 and ending with a value of $T_2$ for t=1, may be accessed in reverse order for values of $T_3$, as shown in FIG. 4.

The values, shown stored in a look-up table in FIG. 4, are for discrete values of t in discrete steps of 1/1024 (i.e. 0/1024 to 1023/1024). However, t is shown being inclusive from 0 to 1 for the purpose of explanation, it being understood that in the preferred embodiment, varies between 0 and 1023/1024 as the end point for $T_2$ 1024/1024 is known.

Because the functions domain of the variable t for the solution sets $T_2=t(1-t)^2$ and $T_3=t^2(1-t)$ overlap, a table of values may be accessed in one data direction with respect to a first domain of variables for which the value represents a solution set. Similarly, that solution set may be accessed in an opposite data direction for a second domain of a variable.

Also, because the function $|1+\text{Cos}\ \Psi|\text{Sin}\ \Psi$ is symmetric about 45 degrees, it is only necessary to store values thereof for 0 to 45 degrees in half angle steps.

The solution set of values for the functions $T_2$ and $T_3$ may be accessed in a first data direction to provide the functional solution set values for the domain t=1 to t=0. Values of Sine may be stored in half angle steps between 0 and 90 degrees. Further, any derived nodes may be stored and used again where the respective curve or corresponding symbol outline loop is to be duplicated.

By forming a cumulative value of t as a multiple of the incremental value of t and applying cumulative discrete selected values of t within the parametric cubic polynomial compiler, according to equation 3.1, display intercepts represented by the generated nodes are produced which may then be used as the display coordinates for the closed loop outline at the desired display size.

As stated above, the value of $\theta$ and $\phi$ used in the compiler are derived, according to the principles of the invention from the average entrance and exit angles, $\measuredangle$ and $\measuredangle$ at a respective set of entrance and exit knots. The nodes which are generated using the incremental value of t to increment the cumulative value of t and by applying discrete selected cumulative incremented t values to the cubic parametric polynomial compiler to produce respective node coordinates for such discrete selected values of t.

The nodes, represent locations on the curve, which, as stated above, form an angle at the entrance knot of the curve as given by $\theta$, and forms an angle at the exit knot given by $\phi$. As stated, an order is chosen for the knots and the order of knots defines an outline loop of knots, the nodes being locations on the curve, between the knots also have an order defined by that knot order and by the defined outline loop. As would be understood by those skilled in the art, that order is the succession of knots and nodes encountered as one progresses along the outline loop as specified. The data for the knots and nodes, as stated above, is encoded in a data loop in that same order of knots and nodes. The encoded knots and nodes are placed in the data loop, in that order corresponding to the outline loop. Then, as one progresses in the defined order along the data loop, corresponding to the outline loop, one would encounter the encoding for the knots and nodes in the data loop in an order, corresponding to the order one would encounter the respective knots and nodes on the outline loop represented by that said encoding.

In summary, given the knot locations, and the angles of the curve at an entrance and exit knot as defined above, and given an incremental value of t, then each discrete selected cumulative value of t, as described above, applied to the cubic polynomial parametric compiler would produce respective nodes, indicative of locations along the smooth continuous curve described by the cubic parametric polynomial. The encoding for the knots and nodes would be in the same order along a data loop as one would encounter the corresponding knots and nodes along the outline loop, when proceeding in a chosen order along the outline loop.

The outline loop, when closing upon itself as shown in FIG. 1*b*, for example, is called a closed outline loop. The data when encoded in a data loop which closes upon itself corresponding to the closed outline loop is called a closed data loop. In this way, accessing the closed data loop, in a direction corresponding to the chosen direction along the closed outline loop will return one to the initial or starting data loop entrance location. As described below, the data loop decoding is not complete until a determination is made that the accessed location for the closed data loop is starting location point and that accessing of all the encoded data in the closed data loop has been completed.

Of course, as one skilled in the art would realize, variations of the above closed outline loop and closed data loop can be made without departing from the principles of the invention.

These node coordinate values given in Raster Units may then be used in run length or other suitable data forms to modulate a display to produce the curve at the desired size, as is well known.

The compiler according to the foregoing is shown below.

ENCODING

The novel manner of encoding the data pack, according to the principles of the invention, is shown in the Table I below, wherein p is the value of dx, q is the value of dy and 0, 1, 2, . . . D, E, F, are bit positions in the encoded data pack. In the preferred embodiment, the bit positions are valued according to the binary number system. The Control Codes, explained below, are shown in Table II. The encoding, shown for a maximum 12 binary words of 3 nibbles, in the preferred embodiment, is used to define a control code or coordinate position for the master encoding grid. It should be understood that the size of the word and the number of nibbles used, as described below would increase to accommodate a larger universe, commensurate with a larger size master encoding grid.

The binary words are encoded in a series of nibble length data words, arranged in the order of the data loop. In this way, as will be shown below, the values of selected data words with a nibble series may be used to define the number of nibbles in a complete information set and the initial nibble or bit positions in the next successive complete information set.

A complete information set (CIS) would be the set of data words necessary to completely define the next coordinate or a control code, as shown below.

TABLE I

| Case Indicated by a 1st nibble value of | F | E | D | C | B | A | 9 | 8 | 7 | 6 | 5 | 4 | 3 | 2 | 1 | 0 | Case | | Limits |
|---|---|---|---|---|---|---|---|---|---|---|---|---|---|---|---|---|---|---|---|
| 1–3 | | | | | | | | | | | | | 0 | 0 | q1 | q0 | .I.a | p=0 | q=[1 . . . 3] |
| 0 | | | | | | | | | q3 | q2 | q1 | q0 | 0 | 0 | 0 | 0 | .I.b | p=0 | q=[0,4 . . . 18] |
| 4–7 | | | | | | | | | q2 | p2 | p1 | p0 | 0 | 1 | q1 | q0 | .II. | p=[1 . . . 8] | q=[1 . . . 8] |
| 8–B | | | | | q3 | q2 | q1 | q0 | p3 | p2 | p1 | p0 | 1 | 0 | q4 | p4 | .III. | p=[1 . . . 32] | q=[1 . . . 32] |
| C–F | p6 | q6 | q5 | q4 | q3 | q2 | q1 | q0 | p3 | p2 | p1 | p0 | 1 | 1 | p5 | p4 | .IV. | p=[1 . . . 128] | q=[1 . . . 128] |

TABLE II

| Case | Definition | Override Control Code Value | Total No. of Data Words Needed incl. 1st Data Word | | Purpose |
|---|---|---|---|---|---|
| Ib | end last | 0 | 2 | | end of last loop |
| Ia | horizontal (x) | 1 | 1+3 | =4 | horizontal motion |
| Ia | vertical (y) | 2 | 1+3 | =4 | vertical motion |
| Ia | diagonal (x,y) | 3 | 1+3+3 | =7 | diagonal motion |
| Ic | start loop | 4 | 2 | | end/start new loop |
| Ib | x negate | 5 | 2 | | invert x direction |
| Ib | y negate | 6 | 2 | | invert y direction |
| Ib | xy negate | 7 | 2 | | invert x & y direction |
| Ib | line sharp | 8 | 2 | | linear interpolate sharp knot |
| Ib | line smooth | 9 | 2 | | linear interpolate smooth knot |
| Ib | sharp | 10 | 2 | | curve interpolate sharp knot |

TABLE II-continued

| Case | Definition | Override Control Code Value | Total No. of Data Words Needed incl. 1st Data Word | Purpose |
|---|---|---|---|---|
| Ib | smooth | 11 | 2 | curve interpolate smooth knot |

The data pack forming the closed data loop is used for encoding the axial distances in DRUs (p=dx, q=dy) between knots, and for the double purpose of identifying and accessing override control codes. These override control codes are used to speed the decoding process and reduce the requirement for encoded data describing coordinate points while offering the further option of edit commands.

The data pack override control codes may be used to override machine default command codes which would otherwise be responsive to parameters expressed within the data pack. As can be seen, the data pack offers the option of following default command codes, responsive to predetermined parameters, such as angles between knots or interknot distances, or override control codes for generating the desired series of nodes and curve locus between knots.

In the preferred embodiment, the default command codes are selected responsive to the parameters of the closed outline loop described by the interknot distances expressed within the data pack. The process of the invention described above for generating a series of nodes forming a smooth continuous curve between a set of end points would normally be used except where the distance between those end points was greater than a predetermined distance, such as 128 units for the preferred embodiment. In that case, where the interknot coordinate distances were greater than 128 units, the default command code responsive thereto would direct straight line interpolation and the formation of a series of nodes to find the locus of that straight line between the knots defining that respective coordinate distance.

Similarly, where the exterior angle formed by a line from the entrance knot to the exit knot and by a line formed from the exit knot to a successive knot is greater than a predetermined angle, such as 40° in the preferred embodiment, then a default command code responsive thereto would direct that a cusp be formed at the exit knot.

Straight line interpolation is well-known in the art. However, within the inventive scheme herein is provided an auto-scaling interpolation which provides an innovative and simpler method of linear interpolation and at the same time increases its accuracy and the precision of the closed outline loop as defined by the series of generated nodes. The auto-scaling linear interpolator is described below.

The format of the data pack shown in Table 1 is based 4 bit boundries defining data words of 4 bits each. Data from the data pack, representing discrete complete information sets is accessed in a series of data words in nibbles of 4 bits at a time with the significance of that complete information set (CIS) and the number of data words therein indicated by the value of the first nibble. The correspondence between the first data word value of a series of data words forming a CIS and the Case indicated by that first data word value is shown below.

| First data word value | Case | Purpose |
|---|---|---|
| 1-3 | Ia | Control Code |
| Ø | Ib | Control Code |
| 4-7 | II | Coordinate Distance |
| 8-B | III | Coordinate Distance |
| C-F | IV | Coordinate Distance |

A series of data words may be a control code as in the Cases Ia and Ib or the coordinate distances between knots, represented by the x,y incremental values between such knots in the preferred embodiment, in Cases II, III and IV.

Where the data words are nibbles, in the preferred embodiment the first nibble value of a nibble series then indicates the Case, and directs the access of a predetermined number of successive nibbles or data words within the closed data loop from the CIS and to complete the override control code, as in Case Ia or Ib or to assemble the number of data words necessary to complete the values corresponding to the coordinate distance between the next knot in the closed outline loop, as in Cases II, III and IV.

The number of nibbles or data words accessed responsive to the first nibble or data word value are the nibble or data word series necessary to form the CIS for the particular Case, after the first nibble or data word, as follows:

In Case II, one nibble or a total of 2 nibbles are required. In Case III, two more nibbles after the first nibble, or a total of 3 nibbles are required, and in Case IV, three more nibbles after the first nibble, or a total of 4 nibbles are required to provide the value of the interknot coordinate distance.

In the Cases Ia and Ib, the number of successive nibbles which must be accessed, responsive to the value of the first nibble, is ordered responsively to the Case indicated and as explained in detail below. For example, Case I may require the accessing of 3 or 6 nibbles to complete the Case Ia control code.

At the end of the data word series of a CIS, accessed responsive to the first data word value, the next successive nibble in the closed data loop would then be considered the first data word value of the next data word series and corresponding CIS. That new first data word value of the next data word series would then in a similar manner indicate the number of successive data words to be accessed to complete the completed information set for the override control code or the value of the interknot coordinate distance, as the case may be. By encoding the closed data loop on 4 bit boundries, the data with respect to control codes may be packed successively within the closed data loop with the data respecting the interknot coordinate distances and, as such, the closed data loop may serve the double function of providing override control codes as well as interknot distance data.

Table II provides a definition of the control codes, control code value, the number of nibbles including the first nibble to complete the control code instruction and the purpose of the control code.

Further, as shown in Table I, and as stated above, a first nibble value of 1 to 3 is indicative of Case Ia and with that first nibble value indicating the particular control code value for case Ia, either 1, 2, or 3, and the number of subsequent nibbles to be accessed for the CIS forming that particular Case Ia control code.

As shown in Table II, 3 additional nibbles are required for a total of 4 nibbles, including the first nibble, to complete the CIS responsible to a control code value 1, 3 additional nibbles for a total of 4 nibbles are needed to complete the CIS responsive to a control code value of 2 and 6 additional nibbles for a total of 7 nibbles are needed to complete the CIS responsive to a control code value of 3.

Where the first nibble value of a CIS is zero, then Case Ib is indicated, as shown in the Table I, and the access of the next successive nibble directed for completion of the Case Ib instruction. In Case Ib, 4 is added to that next nibble value to obtain the control code value for case Ib. The control code values for Case Ib are shown in table II with their corresponding purposes.

In summary, a first nibble value of 0, or 1 to 3, indicates Case Ia or Case Ib as shown above, and directs the accessing of a predetermined number of nibbles in the closed data loop successive to the first nibble, to form the CIS for that Case and which is then used to determine the control code value which in turn directs the processor. The next nibble subsequent in the order of the closed data loop to the last nibble of the previous nibble series corresponding to a CIS then becomes a new first nibble value and is used to indicate either an override control code or interknot coordinate distance. Further, and as shown below, where the first nibble bit as shown above indicates a Case II, the ordering of one more nibble for a total of 2 nibbles is required to complete the CIS and to provide the incremental coordinate distance. For Case III, 2 more nibbles for a total of 3 nibbles are required to complete the CIS for the incremental coordinate distance. For Case IV, 3 more nibbles for a total of 4 nibbles are required to complete the CIS for the incremental coordinate distance for code 4. Then the next successive nibble in the closed data loop after the CIS would be the new first nibble value indicative of case Ia, Ib, III, or IV, as the case may be, leading to an indication of the number of successive nibbles needed to complete the CIS to complete the control code or incremental coordinate distance.

For the override control code Case Ia, where the next successive knot in the closed outline loop is to be defined by Case Ia, control code values 1, 2, or 3, as shown in Table II, then, the first nibble value will have a value of 1, 2 or 3 (thereby indicating override control code Case Ia), and with the control code value being indiated by the specified first nibble value (i.e. 1, 2, or 3). The number of successive nibbles to be accessed to form the CIS for that Case Ia control code are indicated by the value of the first nibble value. Where the value of that first nibble value is 1, then as shown in Table II, the next three nibbles in the closed data loop are accessed and used to denote horizontal or motion in the X direction with the next knot X coordinate given by the next three nibbles, completing the nibble series necessary to form the Completed Information Set for that control code.

Where the value of the 1st nibble is 2, then as shown in table II, a vertical motion in the Y direction is indicated with the next three nibbles in the closed data loop being accessed, to complete the nibble series necessary to form the CIS and indicating the Y coordinate value of the next knot.

Where the value of that 1st nibble is 3, then the next six nibbles in the closed data loop are accessed to complete the nibble series and necessary to form the CIS and indicating the next knot, diagonally related to the immediate knot, and with X,Y coordinates therefore given in each of the next 3 nibbles.

In the preferred embodiment, the least significant bit of the control codes for Case Ia, namely control codes 1, 2, and 3 is used to provide a direction instruction for new X, Y or X,Y coordinate values relative to the preceding knot in the closed outline loop. That relative direction between the new knot position and the preceding knot is then followed when locating the positions of successive knots corresponding to the information in a Case II, III or III instruction indicating the incremental coordinate distance. As will be seen below, the direction may also be changed by a Case Ib control code 5, 6, or 7 which would negate the established X, Y or XY direction.

In summary, in the closed outline loop new knot coordinates as indicated by Case Ia, control code values 1, 2 or 3, shown in table II, would be located in a direction consistent with a previous X and Y direction instruction, unless the least significant bit of the first nibble value for the CIS indicates a change in direction, as in Case Ib, control code values 5, 6 and 7.

In summary, the first data word value is the value of the first data word of a series of data words forming the Completed Information Set (CIS) of the closed data loop, indicating a override control, code as in case Ia, for first nibble values 1, 2 and 3, or as in Case Ib, for value 0, or the incremental coordinate distances as for first nibble values 4-F, for cases II, III or IV.

Then, as stated above, if the 1st data word value, in a nibble size data word series is a zero, then control code case Ib is denoted. Case Ib, directs the access of another nibble of 4 bits in the closed data loop and, if that nibble is not equal to 0, its value is added to value 3 to obtain the proper control code, as shown in Table II. In this way, a total value of control codes 0 and 4 to 18 may be defined. The meanings of each of the control codes having values 4–11 is shown in Table II.

If the control code value for the additional 4 bits is zero, the end of the last loop is indicated (i.e. bits 4–7 are 0 value).

Code 4 indicates the start of a loop.

Codes 5, 6 and 7 provide direction information for the next knot in the closed outline loop relative to the preceding knot.

Codes 8, 9, 10 and 11 are editing override control codes, which override the default command codes.

The editing override control codes are used to override the default command codes, which would normally be responsive to and result from a machine interpretation of the data pack values for cases II, III and IV.

Figure 5:
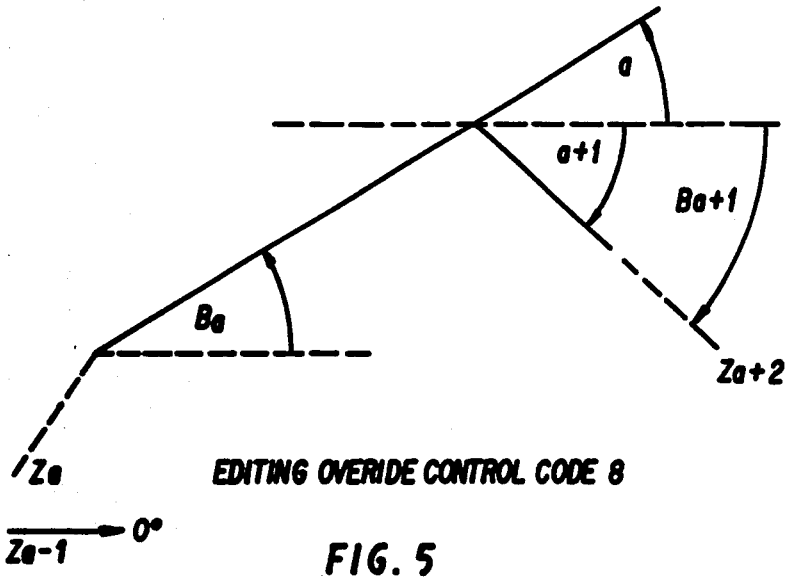
FIG. 5 shows the angular relationships between a set of knots $Z_a$, and $Z_{a+1}$ when a sharp knot or cusp is to be produced.

Code 8 directs Linear Interpolation Sharp Knot. As shown in FIG. 5, it may be used to force the exit angle at a knot (i.e. $\mathfrak{g}_a$ at knot $Z_{a+1}$) for curve $Z_a$, $Z_{a+1}$, to be equal to the interknot angle $B_a$ at the entrance knot, $Z_a$ of that same curve $Z_a$, $Z_{a+1}$. As shown in FIG. 5, Code 8 forces the curve $Z_a$, $Z_{a+1}$, at knot $Z_{a+1}$ to have the same exit angle at the exit knot ($Z_{a+1}$) as the interknot angle $B_a$ at its entrance knot $Z_a$ and produces a sharp cusp at $Z_{a+1}$. To complete the cusp at $Z_{a+1}$, the entrance angle $\measuredangle_{a+1}$ for curve $Z_{a+1}$, $Z_{a+2}$ would be forced equal to the interknot angle $B_{a+1}$ at $Z_{a+1}$.

Code 9 denotes Linear Interpolation-Smooth Knot and may be used, for example, to force a smooth knot located at the end of a curve $Z_a$, $Z_{a+1}$ which then becomes a straight line, or at the end of a straight line, which then becomes a smooth continuous curve.

Figure 6A:
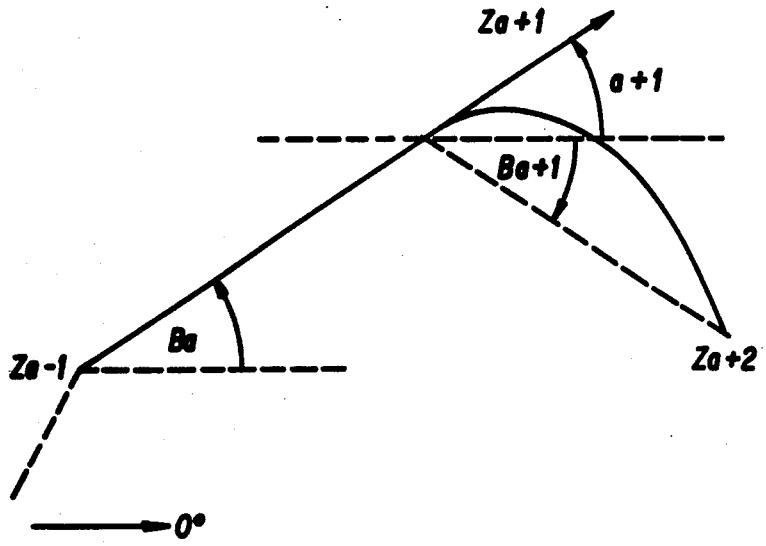
FIG. 6*a* shows the angular relationships at a set of knots when a knot between a straight line and a curve is desired to be smooth.
Figure 6B:
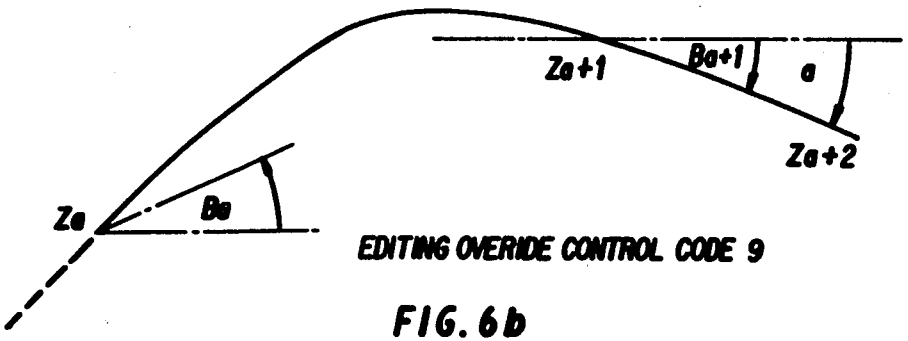
FIG. 6*b* shows the angular relationships at a smooth knot, and between a curve line and a straight line.

The use of override control code 9 is shown in FIG. 6*a* where a knot joins a straight line curve $Z_a$, $Z_{a+1}$ to a smooth continuous curve, $Z_{a+1}$, $Z_{a+2}$. In this case, $\measuredangle_{a+1}$ is set equal to $B_a$.

Where a knot joins a curve section $Z_a$, $Z_{a+1}$ to a straight line curve, $Z_{a+1}$, $Z_{a+2}$, as shown in FIG. 6*b*, then $\measuredangle_a$, the exit angle for curve $Z_a$, $Z_{a+1}$ is made equal to $B_{a+1}$, the interknot angle between $Z_{a+1}$, $Z_{a+2}$.

It should be understood, however, that if a knot joins two straight lines, this rule shown with respect to FIG. 5 is used in the preferred embodiment.

Figure 7A:
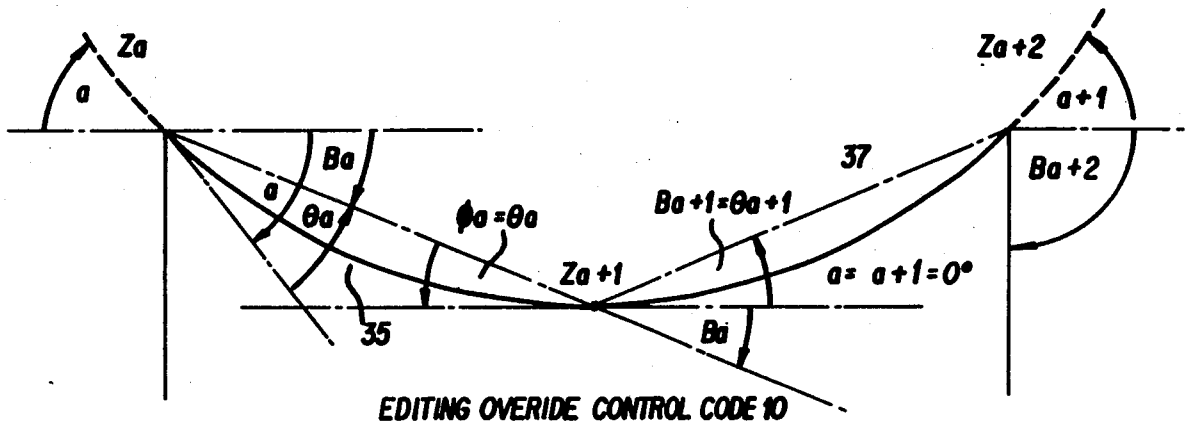
FIG. 7*a* shows the angular relationships at a knot between a curve line and straight line, forced by a control code to override a default command code, which otherwise would produce the results shown in FIG. 7*b*.
Figure 7B:
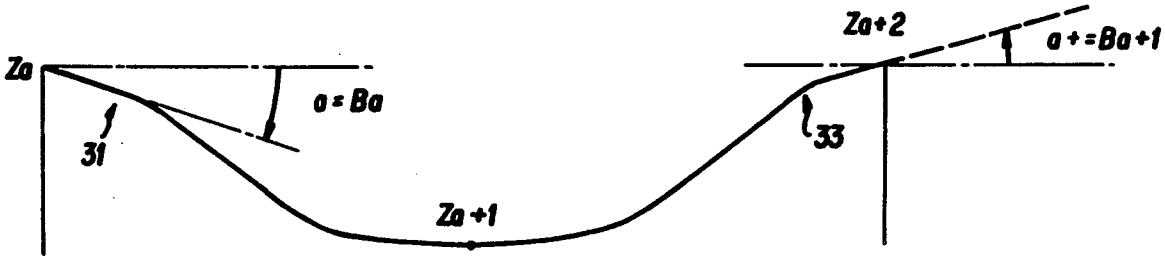
Figure 8:
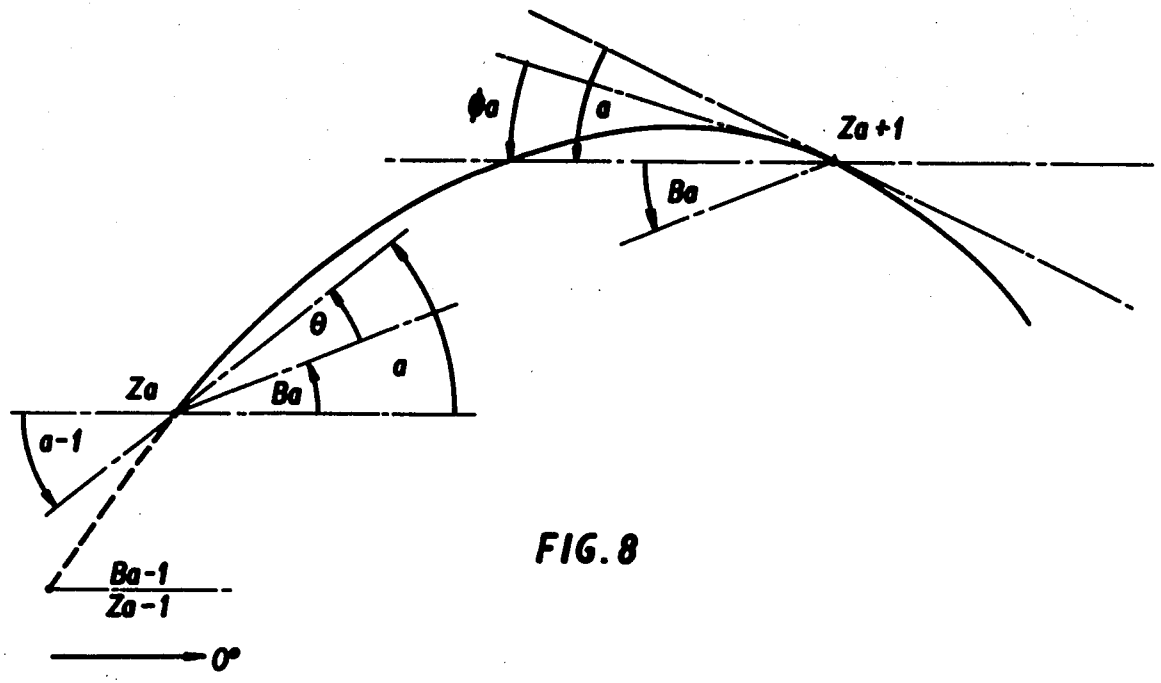
FIG. 8 shows the angular relationships about a set of knots $Z_a$ and $Z_{a+1}$ when it is desired that a smooth continuous curve pass between the knots.

Control code 10 directs a curve interpolation at a sharp knot and is used to form a cusp at the entrance knot or the exit knot of a smooth continuous curve segment joined by that knot to a straight line. Shown in FIG. 7*a*, are two examples, i.e. the curve $Z_a$, $Z_{a+1}$ is formed with a sharp knot at the entrance knot $Z_a$ and the curve $Z_{a+1}$, $Z_{a+2}$ is formed with a sharp knot at the exit knot $Z_{a+2}$. This control code is useful in overriding a default command code which would otherwise require that the sharp knot at $Z_a$, for example have an entrance angle for curve $Z_a$, $Z_{a+1}$ equal to $B_a$ which would introduce a distortion in curve $Z_a$, $Z_{a+1}$ at area 31, approximate the entrance knot $Z_a$ for curve $Z_a$, $Z_{a+1}$, as shown in FIG. 7*b*. Similarly, a distortion would be introduced in a smooth continuous curve terminating in a sharp knot. For example, in curve $Z_{a+1}$, $Z_{a+2}$ as shown by numeral 33 in FIG. 7*b*, approximate the exit knot $Z_{a+2}$, where $g_{a+1}$ would be forced to equal $B_{a+1}$ to form a cusp. code 10 overrides the default command code and forces $\theta$ (i.e. $\theta_a$) to be equal to $\phi$ (i.e. $\phi_a$).

Where a cusp is to be formed at knot $Z_a$, the default command code would specify that the exit angle, $\measuredangle_a$ at knot $Z_a$ would be equal to the interknot angle $B_{a-1}$ at the preceding knot $Z_{a-1}$, for curve $Z_{a-1}$, $Z_a$, and the entrance angle $\measuredangle_a$ for curve $Z_a$, $Z_{a+1}$ would be equal to the interknot angle $B_a$ between the entrance knot $Z_a$ for curve $Z_a$, $Z_{a+1}$ and its exit knot $Z_{a+1}$. As stated above, this would produce the result shown in FIG. 7*b*, and a distortion of the smooth continuous curve $Z^a$, $Z_{a+1}$ shown in FIG. 7*a*. With the result of FIG. 7*b*, the deviance angle $\theta_a$ between $B_a$ and $\measuredangle_a$ would be zero as stated above. In this case, to avoid the distortion shown by numerals 31, 33 in FIG. 7*b* and to produce the smooth continuous curve as shown in FIG. 7*a*, $\theta_a$ is forced equal to $\phi_a$ the deviance angle, at exit knot $Z_{a+1}$, as stated above. In the case shown in FIG. 7*a*, arranged, for the sake of explanation $\measuredangle_a$ is equal to zero, $\phi_a$ is equal to $B_a$.

A similar result is forced by using a code 10 to control the shape of curve $Z_{a+1}$, $Z_{a+2}$ at exit knot $Z_{a+2}$. As stated above, the default command code responsive to a cusp at $Z_{a+2}$ for example, would direct the curve $Z_{a+1}$, $Z_{a+2}$, to the shape shown in FIG. 7*b* and particularly shown by numeral 33 approximately $Z_{a+2}$ by directing that the exit angle $\measuredangle_{a+1}$ at knot $Z_{a+2}$ is equal to the interknot angle $B_{a+1}$ at the entrance knot $Z_{a+1}$ for that same curve. However, by using code 11 to direct that $\phi_{a+1}$ is equal to $\theta_{a+1}$, then at exit knot $Z_{a+2}$ for curve $Z_{a+1}$, $Z_{a+2}\measuredangle_{a+1}$ is equal to $2*B_{a+1}$ ($\measuredangle_a=0$, $\measuredangle_{a+1}=0$, $\theta_{a+1}=\measuredangle_{a+1}-B_{a-1}$).

For the sake of explanation, $\measuredangle_{a+1}$ is equal to 0, for curve $Z_{a+1}$, $Z_{a+2}$.

The effect of code 10 is to produce a smooth continuous curve from or to a cusp such as at entrance knot $Z_a$ or at exit knot $Z_{a+2}$ and symmetrical about the respective curve midpoints, as shown by numeral 35 and numeral 37, respectively for curve $Z_a$, $Z_{a+1}$ and for curve $Z_{a+1}$, $Z_{a+2}$.

Control code 10 is to override a default command code which would othewise specify a cusp, such as where the exterior angle as described above was above a threshold such as 40° as shown in the preferred embodiment, or the interknot distance was greater than a predetermined distance, such as 120 units in the preferred embodiment. In this case, a smooth knot would be formed as described above, by taking the average of the interknot angles between a preceding knot and the subject knot and the subject knot and a successive knot in the outline loop direction of the closed outline loop. However, as explained above, if the absolute value of the interknot angles between the preceding knot and the subject knot and the subject knot and the successive knot is greater than 180°, then the supplemental average is used by supplementing the average angle by 180°. This is to orient the angle in the correct direction where the relationship of the average angle described above would result in a resultant angle 180° out of phase with its correct direction.

The application of the inventive principles will force the angular relationships of $\measuredangle$ $\measuredangle$, $\theta$ and $\phi$ at the respective knots to conform to the rules described above, as necessary to produce the desired curve, straight line, cusp, or smooth knot, whether directed by the default command codes or by the override control codes. It should be noted, however, that where an override control code is used, it is used to force a result contrary to what would ordinarily be produced using the default command codes. For example, if the default command code would produce a cusp and a smooth knot was desired followed by a smooth continuous curve or preceded by a smooth continuous curve, then a code 10 would be used. If the default command code would have produced a smooth continuous curve, and a straight line joining a sharp knot is desired, then a code 8 would be selected. If a smooth knot is desired joined to a straight line, then a code 9 may be selected to override the default command control. All of the foregoing is shown in connection with FIGS. 5, 6, 6*a*, 7, 7*a* and 8 and in the text accompanying these figures.

Figure 9:
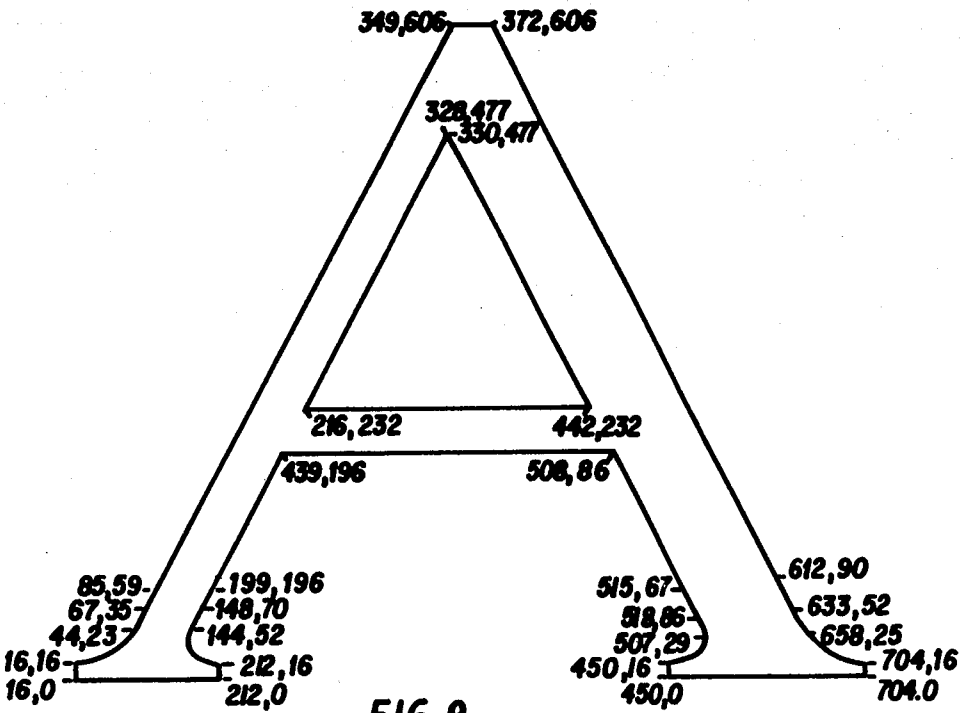
FIG. 9 shows a character as may be produced according to the principles of the invention.

A typical encoding for an A as shown in FIG. 9 is shown in the appendix. The compiler for decoding the packed encoded information is also shown below, and is used with a Motorola 68000 processor. As the desired output is a series of intercepts at the intersection of the locus of the character outline, and the display raster lines, these intercepts can be converted into modulating information for imaging the character on an imaging surface by any suitable well-known imaging device.

For the sake of explanation and in the way of an example, a closed data loop for the enclosed A shown in FIG. 9, is set forth below and described.

CLOSED DATA LOOP FOR THE "" OF FIG. 9
(Given in hexadecimal Notation)

| | | | | | | | | | | | | | | | |
|---|---|---|---|---|---|---|---|---|---|---|---|---|---|---|---|
| 83 | 98 | 3C | 82 | E8 | 5E | Ø2 | 4C | Ø1 | 5C | Ø2 | 5E | 16 | 49 | ØØ | 5B |
| 3Ø | B2 | 54 | D6 | 75 | 96 | 83 | 78 | 81 | A7 | D7 | 5A | 37 | 1B | 8Ø | 7C |
| 57 | 3A | 83 | 89 | ØE | 85 | EØ | 28 | 24 | 15 | CØ | 2Ø | 49 | 77 | 96 | 88 |
| 7D | 2F | 3Ø | 6Ø | 62 | F1 | 6D | ØF | 6Ø | 26 | AD | 28 | 2Ø | C1 | 8A | 88 |
| Ø6 | 5Ø | 1Ø | Ø6 | 95 | 99 | 7B | 88 | 58 | 8Ø | BØ | 82 | Ø8 | Ø1 | 3A | 7Ø |
| FF | FF | ØØ | 1Ø | 79 | Ø6 | 5Ø | 37 | 31 | 19 | 7B | 73 | 53 | 81 | 51 | 79 |

As stated above, the closed data loop is encoded on data words of 4 bit or nibble boundries and the sequence of the nibbles is as given below. In accordance with the preferred embodiment, the first two bytes 5B of the closed data loop indicate the total number of bytes in the data loop for a closed outline loop. The first two bytes, 00 5b indicates that there are 91 bytes total in the data loop for the symbol A, describing outside closed outline loop 31 in the direction of arrows 31 and inside closed outline loop 35 in the direction of arrows 35.

In accordance with the preferred embodiment, the starting X and Y coordinates are given in three nibble packs of information for each respective X and Y location. Accordingly, the next three nibbles 6 49 relates to the starting X location. In accordance with the principles of the invention and the preferred embodiment, the least significant bit of the data for a new X or a new Y location is a sign bit indicative of the direction. Accordingly, in processing the data in the preferred embodiment, a shift of one binary position is made to remove the sign bit, giving a decimal data value of 804. As described above in the preferred embodiment, since the origin of the $M^2$ is offset by 592 units, 592 must be subtracted from 804 to provide the correct X coordinate with reference to the origin of the $M^2$ of 212. The sign of the X direction, whether positive or negative with regard to the origin of the $M^2$ is given by the sign bit and is positive if the sign bit is zero, in the preferred embodiment.

In accordance with the principles of the invention, the starting Y position given as a new Y position is indicated by the next nibble series of 3 nibbles or by 5E1, which is divided by 2 to remove the sign bit yielding the result of 750. In accordance with the offset of the $M^2$ at 736 units, 736 is subtracted from 752 to yield a Y coordinate of 16. The sign bit which is a 1, indicates a negative direction for Y. Accordingly for the "A" of FIG. 9, the start point x, y coordinates shown as numeral 39, is 212, 16 with the new direction being x, −y.

As stated in the preferred embodiment, the data pack is decoded by using the first two bytes to indicate the number of bytes in the closed data loop corresponding to the coordinate points around the closed outline loop, and by three nibbles each comprising twelve bits corresponding to the respective X and Y start locations. It should be noted that wherever the X coordinates are defined by new coordinate values, the least significant bit is used as a sign bit to indicate the coordinate direction. The process performs a divide by two which separates that bit to define the aforesaid direction signed. Additionally, the X position is referenced to the home or reference position in the $M^2$ which may be offset with regard to the origin of the master encoding grid by subtracting the offset from a coordinate position accordingly. With this in mind, the following process is described which produces the listing of coordinates shown below and in FIG. 9.

As stated, the start position is at XY coordinates 212, 0. As the last bit of data accessed from the data pack, to provide complete information for the preceding nibble series was the tenth nibble corresponding to hexadecimal number 5. The next nibble which follows a complete information series of nibbles is a first nibble value.

As shown, the first nibble value 2 indicates a case Ia and according to table II directs the access of the next three nibbles, 5C0 indicative of the new X coordinate position. In accordance with the procedure above, a division by 2 removes the sign bit and a subtraction process is performed relative to the $M^2$ offset, to reference the new Y position to the $M^2$ home position or at zero. The first nibble value "1", following the nibble series for the completed information set of 5C02 then indicates a case Ia and a new X coordinate. In accordance with the process described above, a binary division of two is performed to isolate the sign bit, indicate the direction and a subtraction is performed to reference the new X position to the home position. Accordingly, the new X position is 16.

The next coordinate position of 16,16 is given by the complete information set 2E8, with the nibble series first nibble value 8 indicating of a Case III. In accordance with the format of the data pack as shown in Table, I, P=X is equal to 01110 and Q=y is equal to 00010. This translates to 14 and 2 in decimal rotation respectively. In accordance with the preferred embodiment, as it would be redundant to use Cases II, III and IV, for a translation of 0, a 1 is added to the results of p=x and q=y to provide the new X and Y coordinate distances of 15 and 3 respectively. The p value is added to previous X value of 16 to provide a new X value of 31, and the q value is added to the previous Y value of 16 to provide a new Y value of 19 accordingly.

As a reminder, it should be understood, that this process of decoding the data pack being described is designed to decode the encoded knot coordinates only. After decoding the inventive principles described herein are applied to the knots to either produce a series of nodes describing a smooth continuous curve between the knots, as between knots 16, 16, and knots 31, 19 or a straight line as between knot 212, 0 and knot 16, 0. In accordance with the preferred embodiment, the direction of the knots indicated by the completed information set 2E8 relative to the previous knot is in accordance with the direction established by the last previous sign bit accessed for the respective X and Y directions as shown above, or by 567 as described below.

The next nibble following the nibble series for the completed information set above has the first nibble value of 8 which is a Case III, directing the access of the next two nibbles for providing the nibble series for complete information set of 3C8 corresponding to a p=x value of 13 and a q=y value of 4 in accordance with the format shown in Table II. In accordance with the preferred embodiment, the direction of the knot denoted by this complete information set follows the last previous direction indication given and is accordingly added to the previous coordinates of 31 and 19 to provide new coordinates of 44 and 23.

In accordance with the foregoing, the next nibble being a first nibble value is 8 which accordingly directs the access of the next two nibbles to provide a complete information set of 398 producing new coordinate values of 54, 27, accordingly.

The next nibble corresponding to a first nibble value of 8, as described above, indicates a case 8 and directs the access of the next two nibbles to form the nibble series corresponding to the complete information set of hexadecimal 7C8 and according to the processing described above decoding the new coordinates of 67, 35.

As can be seen, the smooth continuous curve between knot end points 16,16 and passing through knots 31, 19 and 44, 23 and 54, 27 and, 67, 35 are formed according to the principles of the invention to form a smooth continuous curve.

The next first nibble value of the next complete information set is zero indicating Case Ib which directs the access of another nibble to form a two nibble series complete information set. As the next nibble was 8, for Case Ib, a value of 3 is added thereto forming a value of 11, indicative of control code 11 directing a smooth continuous curve be formed between the last knot having coordinate 67, 35 and the next knot which is to be indicated by the next complete information set accessed from the closed data loop.

As the first nibble value of the next complete information set is B indicating Case III, 3 nibbles are accessed forming a 4 nibble series describing the next complete information set and producing the new coordinates of 85, 59.

The next first nibble value of the next nibble series for the next complete information set is 3 indicating Case Ia, control code 3, shown in Table II, and which directs the access of a pair of three nibbles each which are indicative of the next X and Y positions and directions thereof relative to the previous knot. In accordance with the process described above, the new X and Y position is 349, 606 and as the distance between this new knot and the previous knot is greater than 128 units, the default command code directs linear interpolation. In accordance with the above, the hexadecimal value 75A corresponds to the new X position and A7D corresponds to the new Y position. As stated above, the least significant bit of each of the above 3 nibbles corresponds to the relative direction of the new X and Y points.

The first nibble value of the next nibble series for the next complete information set is 1 indicating a Case Ia and directing the access of the next three nibbles of 7A8 to replace the X coordinate with 372 and a new set of coordinates 372, 606.

The next first nibble value for the next nibble series is a 3 corresponding to a case Ia, a control code 3 and the access of a pair of 3 nibbles, i.e. 968, corresponding to the new X position and 675, corresponding to the new Y positions and new X, Y coordinates of 612, 90 respectively.

The next first nibble value following the nibble series for the complete information set above is D, corresponding to Case IV which directs the access of the next three nibbles to form the 4 nibble series 254, and which according to the form shown in Table I provides a p=x value of 20 and a q=y value of 37. According to the process described above, a 1 is added to the p=x value and the q=y value to form decimal coordinate values of 21 and 38. Following the most recent X, Y coordinate direction instructions given, the X incremental value is added to the previous coordinate 612 providing the new X coordinate of 633 and the Y incremental value is subtracted from the previous Y of 90 to provide a new Y coordinate value of 52.

The next first nibble value of the next nibble series for the next complete information set is a B corresponding to Case III which directs the access of two more nibbles to form a three nibble series, complete information set, and producing the next coordinate values of 650, 32 for X and Y respectively.

The next first nibble of the next nibble series for the next complete information set is 8 corresponding to a Case III, causing the access of the next two nibbles to produce a three nibble information set and new coordinate values of 659, 25 for X and Y respectively.

The next first nibble value is a 9 corresponding to case III and directing the access of the next two nibbles of 77 and corresponding to new X and Y coordinate 683, 17.

The next first nibble value is a 9 causing the access of the next two nibbles 04 and corresponding to the new X, Y coordinates with 704, 16.

The next new first value is 2 corresponding to Case Ia and directing the access of the next three nibbles corresponding to the 5C0 corresponding to a new Y value with the direction indicated by the first significant bit therein and producing new XY coordinates of 704, 0 respectively.

The next first nibble value of the next nibble series for the next complete information set is 1 corresponding to a Case Ia and directing the access of the next two nibbles forming a three nibble series complete information set 824 and corresponding to the new X, Y location of 450, with respect to the last previous direction given for the axial directions X and Y.

The next first nibble value 4, the next complete information set is 2 corresponding to case Ia and to complete information sets 5E0 corresponding to new XY coordinates 450, 16.

The next first nibble value is 8 corresponding to Case III and as described above corresponding to complete information set 0E8 and new XY coordinates 465, 17.

The next first nibble value is 9 corresponding to Case III and complete information set 389 and new XY coordinates 490, 21.

The next first nibble value is 8 corresponding to Case III and complete information set 38A and new XY coordinates 501, 25.

The next first nibble value is 7 corresponding to Case II which directs the access of another nibble and according to the format shown in Table II provides a p=x value of binary 101 corresponding to a decimal value of 5 to which one is added in accordance with the procedure above to provide a decimal value of 6 for the new X coordinate incremental distance. Similarly, the q=y value is binary 011 which corresponds to a decimal value of 3, to which one is added in accordance with the process above to provide a new value of 4 corresponding to the incremental Y coordinate distance. The new XY coordinates are therefore 507, 29 accordingly to the directions given in the last previous direction instruction.

The next first nibble value is 8 corresponding to Case III and the access of two more nibbles to form the complete information set A88 and XY coordinates 516, 40.

The next first nibble value is 8 corresponding to Case III, the access of the next two nibbles form a complete information set C18 and new coordinates XY of 518, 53.

The next first nibble value is zero corresponding to case Ib which directs the access of the next nibble to, which 3 is added in accordance with procedures described above to form the control code 5. As shown in Table II is an X Negate which changes the X direction from its previous direction. The next first nibble value is an 8 corresponding to Case III and in accordance with the foregoing new X, Y coordinates 515, 67.

The next first nibble value is 8 corresponding to case III and new coordinates of X, Y of 508, 86, respectively in accordance with the above procedure.

The next first nibble value is a 0 corresponding to case Ib which directs the access of the next nibble 6 to which 3 is added according to the above procedure to provide a control code of 9. 9 as shown in Table II is a line smooth direction.

The next first nibble value is F corresponding to Case IV and in accordance with the procedure above causes the access of three more nibbles forming the complete information set 600F and new X, Y coordinates 459, 196 in accordance with directions as given.

The next first nibble value is 1 corresponding to Case Ia which directs the access of the next three nibbles, 62F indicative of an X coordinate point in accordance with the last previous directions given. Accordingly, the new X, Y coordinates are 199, 196.

The next first nibble value is zero corresponding to Case Ib and directs in the access of the next nibble having a value of 6 to which 3 is added in accordance with the above procedure to produce a 9 corresponding to control code 9. A next first nibble value is zero once again corresponding to Case Ib which directs the access of a next nibble which is 3 to which 3 is added giving the control code value 6 which means negate Y.

The next first nibble value is F corresponding to Case IV and in accordance with the above procedure causes the access of the next three nibbles to complete the information set 7D2F and producing new X, Y coordinates of 148, 70 which is connected to the previous X, Y coordinates 199, 66, according to the override control code 9 and in the new Y direction.

The new first nibble value is zero corresponding to case Ib and directing the access of the next nibble having a value of 7 to which 3 is added to give it the control code 10.

The next first nibble value is an A corresponding to Case III and directing the access of the next two nibbles to give the complete information set 13A and new X and Y coordinates 144, 52 respectively.

The next first nibble value is zero corresponding to Case Ib which directs the access of another nibble having a value 8 to which 3 is added in accordance with the above procedure to provide the control code 11.

The next first nibble value is zero corresponding to Case Ib directing the access of another nibble having the value 2 to which 3 is added giving the control code 5 which negates the previous X direction.

The next first nibble value is A corresponding to Case III and the access of two additional nibbles giving the complete information set B08 and new XY coordinates 145, 40.

The next first nibble value is zero corresponding to case Ib in accordance with the above procedure control code 11.

The next first nibble value is 8 corresponding to Case III, complete information set 858 and new XY coordinates 151, 31.

The next first nibble value is 8 corresponding to Case III, complete information set 7B8 and new XY coordinates 163, 23.

The next first nibble value is 9 corresponding to Case III, complete information set 599 and new XY coordinates 189, 17. The next first nibble value is 9 corresponding to complete information set 069 and coordinates 212, 16.

The above XY coordinates 212, 16 bring the traverse of the closed data loop bringing it back to the starting point.

The next first nibble value is zero indicating Case Ib with the next access nibble I to which 3 is added producing the control code value 4 indicating the end of closed data loop.

In accordance with the preferred embodiment, a routine is added, not shown, which would be known to one skilled in the art to ensure that the closed data loop decoding closes upon the start location of the closed data loop and completes the closed outline loop by ending at the start point encoding of the closed data loop which represents the start of the closed outline loop.

The second closed outline loop, shown by numeral 35 and arrows 37, of the A now starts at the closed data loop coded hexadecimal numbers 790, 650 corresponding to new X and Y coordinate values 216, 232 and the X and Y directions, derived according to the process given above with the regard to the start points for the foregoing loop, 31.

The next first nibble value is 1 corresponding to Case Ia and directing the access of the next three nibbles 815 and new XY coordinates 442, 232.

The next first nibble value is a 3 corresponding to a Case Ia, directing the access of a pair of three nibbles 735, and 97B corresponding to new X and Y coordinates of 330 and 477 in the negative X and negative Y directions accordingly.

The next first nibble value is 1 corresponding to Case Ia directing the access of the next three nibbles 731 corresponding to X coordinate 328, Y coordinate 477 in the negative X and negative Y directions accordingly.

The next first nibble value is 3 corresponding to Case Ia directing the access of a pair of three nibbles each corresponding to hexadecimal value 690 and 790 and X and Y positions 216, 232, respectively. As 216, 232 are the start points, the closed data loop representing the closed outline loop 35 has been completed and the next first nibble value is zero indicating Case Ib with the last nibble accessed accordingly being zero indicating the end of loop. Once again, the routine described above is used to insure that the closed data loop ends at its start point.

The above is a representative encoding of a letter used in the process to derive the coordinate values around the outline of the character and any override control codes which may be used to replace default command codes. However, it should be understood that changes to the codings could be used consistent with the principles of this invention, as claimed herein, and that the invention should not be restricted to the coding or decoding process shown above, with respect to the preferred embodiment.

AUTOSCALING LINEAR INTERPOLATION

Linear interpolation is a well-known technique and is not claimed as an invention in this application. The autoscaling linear interpolation which is claimed and which is described below is a method of increasing the precision of a machine interpolation procedure which uses as a start point, a first set of coordinates and as an ending point a second set of coordinates. The coordinates are usually expressed in respective coordinate directions such as x and y, for example. In the preferred embodiment, the process of linear interpolation is for the purpose of producing coordinate points along a straight line between the first and second end points, which coincide with a second coordinate system such as the intercepts in a raster display. Each of the coordinates are found by determining the slope of the straight line between the two end points which is equal to the incremental distance in a first coordinate direction divided by the incremental distance in a second coordinate direction (i.e. $Y_2-Y_1/X_2-X_1$). That first coordinate incremental distance is expressed in an encoded machine value as a first data word, (i.e. $Y_2-Y_1$), in a first machine location. The second coordinate incremental distance between the two end points in the second coordinate direction (i.e. $X_2-X_1$), is also expressed as a machine value and placed in a second machine location. The machine location limits the precision by which a data word may be expressed. For example, and as is well-known, each machine is based upon radix, which is a number base. The most common machine number base is the binary number base. Each data word accordingly, has a number of bit positions with each specified bit position being a specified power of that radix (i.e. $2^4$, $2^3$, $2^2$, $2^1$, $2^0$, $2^{-1}$, $2^{-2}$,). Accordingly, a shift of a data word in a direction of the most significant bits corresponding to higher exponential values or higher orders of the machine radix, results in an increase in the scale or value of the data word. Further, each shift in the direction of the most significant bits, results in an effective multiplication of the data word value by a scale factor of the machine radix raised to an exponential power corresponding to the number of bits shifted (i.e. 13 bit positions shifted is equal to a scale factor of $2^{13}$ in a binary machine or equivalent of 8196, in decimal notation. Conversely, each shift of a data word, towards the least significant bits, corresponding to lower exponential values or orders of that machine radix, corresponds to an effective division by the machine radix value and conversely to a reducing scale factor. Further, machine locations for storing data words are limited in the number of bits available. As the precision of a data word is a function of the data space and the number of bits available for storing that data word, an increased precision for expressing a data word are obtainable by extending the number of bits or size of a machine location available for specifying a data word. For example, as is well-recognized, in a decimal system, the number 5.632498 is a more precise value than 5.3624 which lacks the last three significant places (i.e. 0.000098), of the former number. In binary, the number 10111.101 is a more precise expression than that number truncated or rounded to 10111.000, as the latter number is missing the bits 0.101 and is therefore less precise. However, the former binary expression requires a larger machine location for specifying all the relevant bits in that expression. The "point" in the above binary and decimal values are used to indicate the positions, according to the radix system used, to indicate position values equal to or greater than 1 (decimal) and less than 1 (decimal) (i.e. integer and fractional values).

The effect of shifting to increase the scale of the Y increment is to eliminate the binary point in a third data word representing the slope or a Y incremental value and thereby avoiding floating point arithmetic operations. The point separates the bit positions in the radix system selected, separating fractional from integer values in a data word having values equal to or greater than 1 and less than 1 (i.e. between the bit positions "$2^0$" and "$2^{-1}$". The binary point is equivalent to the decimal point in a radix 10 system and equivalent to a "point" between those machine positions having a value equal to or greater then 1 and less then 1 in any system and as stated, separating the fractional values from the integer values in the slope or Y increment value. By shifting a machine representation of a number in the direction of more significant bits, the scale of the number is increased, thereby moving the "point" effectively in the direction of the less significant bits. If a sufficient number of bit positions are shifted, the binary point is eliminated from the number. In this way, floating point arithmetic is avoided.

According to the invention, linear interpolation proceeds according to the known method by determining the coordinate distance in a first coordinate direction and in a second coordinate direction between a set of end points. The method is used in the machine having a radix "r" cooresponding to the values of designated bit positions in the encoded words used within the machine. The process continues by encoding a first data word on "N" bits corresponding to the distance between the first and second end points in the first coordinate (i.e. $Y_2-Y_1$), and then placing that first data word in a first machine location. To complete the process of calculation the slope, according to the interpolation method, a second data word of M bits corresponding to the distance between the first and second end points (i.e. $X_2-X_1$) in a second coorindate direction is encoded and placed in a second location. The machine is now ready to use the data value in the first location and a data word value in the second location in a process of division to produce a third data word corresponding to the slope of the straight line between the first and second end points (i.e. $Y_2-Y_1/X_2-X_1$). To increase the precision or resolution of the third data word according to the invention process, the scale of the first data word (i.e. $Y_2-Y_1$), is increased by determining the the number of available positions between the most significant position of the first data word and the most significant position of the first machine location. The first data word is then shifted in a first direction towards the most significant positions in that first machine location, utilizing those more significant positions which were unused, when expressing the first data word. The scale of the first data word is again increased by shifting a second time in the same first direction of the most significant positions by a number of positions corresponding to the number of bit positions used to encode the second data word (i.e. $X_2-X_1$). In the preferred embodiment, the first machine location is expanded to accommodate this additional shift. It should be noted that the inventive principle is not limited to the size of available data space in any one machine or to any machine radix.

In the preferred embodiment, the second shifting operation described above occurs in an extension to the first machine location. The quotient corresponding to the slope (i.e. $Y_2-Y_1/X_2-X_1$) produced as the third data word by division of the first data word by the second data word will reduce the first data word to a size coextensive with the first machine location. As a result then, the data word may be raised by a scale factor corresponding to a shift in the direction of the most significant positions corresponding to the number of significant positions used to express the denominator (i.e. $X_2-X_1$) or second data word, as the next division step cancels that said shift of the first data value by the said number of bit positions in the second data word and corresponding reduces its position length to the size of the first machine location.

The third encoded data word (i.e. the Y incremental value for each X increment) is then stored and added to the first data word (i.e. $Y_1$). The second data word (i.e. $X_1$) is incremented a coordinate word value corresponding to the first and second coordinate positions of a point along the line are then stored. In Table III are given the coordinate X, Y values; the value of Y incremented at its highest precision and scale factor for the example shown.

In the iterative process, the third encoded data word at the higher resolution, produced, corresponding to the slope produced according to the above, is used iteratively as a Y incremental value to derive a cumulative Y incremental value related to a respective X coordinate value in the first direction (i.e. Y) and stored as a cumulative Y. As no change has been made to the precision (i.e. the number of positions used to express the third data word), the precision of the third data word is the same as the first data word, produced by shifting the first data word and increasing its scale, as described.

As interpolation is an iterative process, the data word (i.e. the Y incremental value at the said higher precision), is used to produce the cumulative Y, related to the Y coordinate for a respective X coordinate.

As the purpose of producing data word values corresponding to points along a straight line, is to produce intercepts on a display coordinate system, the scale cumulative Y words are reduced to the scale used to express the end point coordinate values, by the step of truncating or rounding. Truncating may be accomplished by discarding a predetermined number of least significant bits or rounding may be used by a shift in the direction of the least significant bits, minus one, adding a bit corresponding to the rounding value such as 0.5 (decimal) and discarding any bits having values less than the least significant bit value of interest. In the preferred embodiment, truncating or rounding is to the position of the lower integer value in the radix 2 system (i.e. to bit position $2^0$).

In the foregoing manner, the scale of cumulative Y is then reduced to fit scale of the data words for the end point coordinates. In the preferred embodiment, the original precision is that of the coordinates on a display which are the display intercepts, shown as X, Y in Table III. The result of using this method is to avoid the incremental error introduced into each cumulative Y value by summing Y incremental at a lower scale.

The incremental value at the increased scale factor may be used to derive a cumulative Y for each respective coordinate X values by iteratively incrementing Y increment by Y increment to produce a first cumulative Y and then incrementing that first cumulative Y with the Y incremental value and so on to produce a series of distinct cumulative Y values at the higher scale factor for each X coordinate. The discrete cumulate Y values may then be reduced by the scale factor to the scale of the numerator (dx) before shifting and added to the initial Y coordinate value to produce the correct Y coordinate for each respective X coordinate. By producing the cumulative Y using Y increment at the increased scale factor, cumulative errors in the Y coordinate value due to an error in the cumulative Y value due to the lower scale factor of Y increments are avoided.

An example is shown in Table III. In the preferred embodiment, a radix 2 machine is used with locations of 16 bits each used and with the most significant or 16th bit being used for a sign bit. The Y register, therefore, corresponding to a first data word of 120 would be 0000 0000 0111 1000. As the leftmost or most significant bit of the register is not available for indicating the numerical value, as it is a sign bit in the preferred embodiment, then the first data word expressed in binary, may be shifted to the left in the direction of the most significant bits, a total of eight places corresponding to the eight zeros or unused binary bit positions to the left of "111 1000." The updated first data word, as shown in the register is now 01111000000000000 corresponding to a decimal value of 30,720.

The denominator corresponding to the distance between the end points in a second coordinate direction and to the second data word is the binary word 0000 0000 0011 0010 equal to a decimal value of 50. The quotient produced by the division of the dividend or first data word by the denominator or second data word produces a quotient having a number of bits related to the number of bits in the dividend reduced by the number of bits in the divisor or denominator. In the divisor, the most significant bit is in the 6th bit position corresponding to a decimal $2^5$ or decimal of 32. The numerator corresponding to the first data word and expressed as the 16 bit binary word 0111 1000 0000 0000 may be raised by an order of the radix, (i.e. $2^5$) corresponding to the order of the most significant bit position of the denominator, with the assurance that the quotient will fit within the register size containing the first data word after shifting above and without loss of any significant bits in the quotient, such as, for example, bit corresponding to the remainder.

To summarize the foregoing, the precision of data word for the numerator value, used in deriving the slope can be raised within the space allotted by a machine register by shifting the significant bits of that data word to the left or towards the most significant bit in the register equal to the number of unused bits in the register or in the example between the most significant bit position for the first data word shown, or seventh bit position and the most significant bit position available in the register. This causes the binary word corresponding to the numerator to be stated at its highest value thereby avoiding floating point arithmetic. The precision of the slope used in linear interpolation may be further increased by expanding the register space available for storing that binary word and shifting hat first data word to the left, effectively raising it by a power of the radix used, corresponding to the number of significant bits in the denominator or divisor. As stated above, as the slope is the quotient produced by the division of the dividend or numerator (first data value), by the divisor or denominator (second data value), a shift of the numerator by the number of significant bits in the denominator, after division produces a quotient having a number of significant bits no greater than the dividend. In this way, the precision of the quotient or incremental value in the first coordinate direction is maintained equal to the precision of a numerator.

To continue with the example above, as the divisor contains 6 significant bits corresponding in binary notation to it $2^5$ or 32 then the numerator may be shifted to the left for a total of 13 places by increasing the scale, raising the value of the first data word by a scale factor of $2^{13}$. As $2^{13}$ equals decimal 8192, the arithmetic accomplished in binary form and expressed in decimal is $$\text{dec.}\ \frac{120 \times 8192}{50} = \frac{F0000}{32}\ HEX \text{ where } 120 = Y_2 - Y_1;$$

$$50 = X_2 - X_1;$$

The first coordinate or Y incremental value is expressed in decimal as 19660/8192=2.399902 or 4CCC in HEX. The actual incremental value defined by the coordinate end points is 120/50=2.4. The difference between the Y incremental value, expressed as a third data word and the actual slope is $4\times10^{-3}\%$ error. As shown in Table III, the Y incremental produced at the higher precision is used to iteratively increment Y, which is then reduced in scale accordingly and added to the first end point in the first coordinate direction (Y direction) and that Y coordinate value is stored. In reducing the scale, the Y value may be truncated or rounded, to produce an intercept value, for example. As shown in Table III below, the intercept value is shown as produced by truncation and rounding.

Additionally, to increase the speed of the process, the value of the first data word or numerator may be compared to successive entries in an ordered set of values. By a comparison of the value of the first data word it can quickly be determined whether the coordinate difference (i.e. $Y_2-Y_1$) is greater or lesser than a value in a particular position of the set of values. Accordingly, the set of values may be arranged in decreasing orders of the machine radix, (i.e. $2^{13}, 2^{12}, \ldots 2^0$). By a successive process of comparison in the decreasing order, it can easily be determined where in this procedure, the first data word in the first machine location is less than a value in the set of values. Then that particular value in the set of values could be referenced to an index value to indicate the number of bits available in the numerator register for shifting the first data word. It should be noted that according to the principles of the invention, it is not necessary where the denominator is a power of two, such as two or four, to divide, saving additional time, as shifting of the numerator accomplishes the same result.

Accordingly, the above process is equally valid for the reverse process where the set of values is in increasing order and the comparison is in the increasing order with the particular value of interest in the set being the first greater than the first data word.

In this way, it is possible to avoid floating point arithmetic by increasing the value of the numerator and corresponding to the number of unused bits available in the register for shifting while further increasing th value of the numerator corresponding to the number of significant bits in the denominator to maintain the power of two of the most significant bit of the quotient equal to the power of two of the most significant bit of the dividend and thereby increasing the precision of the quotient and the answer. Additionally, it is possible to use a set of values such as a look up table for example, to compare the value of the numerator to values in the denominator, selecting as an index number related to a value in said set of values to indicating the number of positions available for shifting the numerator by arranging the set of values in an order of values corresponding to decreasing or increasing orders of the radix and successively comparing the numerator value in the order of said decreasing or increasing powers of the radix until a particular value is found which is greater or less, respectively than the numerator value. That particular value can then correspond to an index value corresponding to the power of two available in the register for shifting the numerator and increasing its value by a power of two.

As would be apparent to those skilled in the art, the inventive principles can be applied to any radix system or to any coordinate system.

TABLE III

| Start Point | Delta_X=5Ø | | | |
|---|---|---|---|---|
| $X_1,Y_1$ =Ø, Ø | Delta_Y=12Ø | Y incremental = | | 19660 dec.; |
| End Point | | | | 4CCC Hex |
| $X_2,Y_2$ = 5Ø, 12Ø | | Scale Factor = | | 1Ø5134 dec. |
| (truncated) | (rounded) | Cumulative incremental | | |
| X,Y | Y | Y per X coordinate | | |
| 1,2 | [2] | Sum= | 19660= | 4CCChex |
| 2,4 | [5] | Sum= | 39320= | 9998hex |
| 3,7 | [7] | Sum= | 58980= | E664hex |
| 4,9 | [1Ø] | Sum= | 78640 = | 1333Øhex |
| 5,11 | [12] | Sum= | 983ØØ = | 17FFChex |
| 6,14 | [14] | Sum= | 117960 = | 1CCC8hex |
| 7,16 | [17] | Sum= | 137620 = | 21994hex |
| 8,19 | [19] | Sum= | 157280 = | 2666Øhex |
| 9,21 | [22] | Sum= | 176940 = | 2B32Chex |
| 1Ø,23 | [24] | Sum= | 196600 = | 2FFF8hex |
| 11,26 | [26] | Sum= | 216260 = | 34CC4hex |
| 12,28 | [29] | Sum= | 235920 = | 39990hex |
| 13,31 | [31] | Sum= | 255580 = | 3E65Chex |
| 14,33 | [34] | Sum= | 275240 = | 43328hex |
| 15,35 | [36] | Sum= | 294900 = | 47FF4hex |
| 16,38 | [38] | Sum= | 314560 = | 4CCCØhex |
| 17,4Ø | [41] | Sum= | 334220 = | 5198Chex |
| 18,43 | [43] | Sum= | 353880 = | 56658hex |
| 19,45 | [46] | Sum= | 373540 = | 5B324hex |
| 2Ø,47 | [48] | Sum= | 393200 = | 5FFFØhex |
| 21,5Ø | [5Ø] | Sum= | 412860 = | 64CBChex |
| 22,52 | [53] | Sum= | 432520 = | 69988hex |
| 23,55 | [55] | Sum= | 452180 = | 6E654hex |
| 24,57 | [58] | Sum= | 471840 = | 7332Øhex |
| 25,59 | [6Ø] | Sum= | 491500 = | 77FEChex |
| 26,62 | [62] | Sum= | 511160 = | 7CCB8hex |
| 27,64 | [65] | Sum= | 530820 = | 81984hex |
| 28,67 | [67] | Sum= | 550480 = | 8665Øhex |
| 29,69 | [7Ø] | Sum= | 570140 = | 8B31Chex |
| 3Ø,71 | [72] | Sum= | 589800 = | 8FFE8hex |
| 31,74 | [74] | Sum= | 6Ø9460 = | 94CB4hex |
| 32,76 | [77] | Sum= | 629120 = | 9998Øhex |
| 33,79 | [79] | Sum= | 648780 = | 9E64Chex |
| 34,81 | [82] | Sum= | 668440 = | A3318hex |
| 35,83 | [84] | Sum= | 688100 = | A7FE4hex |
| 36,86 | [86] | Sum= | 7Ø7760 = | ACCBØhex |
| 37,88 | [89] | Sum= | 727420 = | B197Chex |
| 38,91 | [91] | Sum= | 747080 = | B6648hex |
| 39,93 | [94] | Sum= | 766740 = | BB314hex |
| 4Ø,95 | [96] | Sum= | 786400 = | BFFEØhex |
| 41,98 | [98] | Sum= | 8Ø6060 = | C4CAChex |
| 42,1ØØ | [1Ø1] | Sum= | 825720 = | C9978hex |
| 43,1Ø3 | [1Ø3] | Sum= | 845380 = | CE644hex |
| 44,1Ø5 | [1Ø6] | Sum= | 865040 = | D3310hex |
| 45,1Ø7 | [1Ø8] | Sum= | 884700 = | D7FDChex |
| 46,11Ø | [11Ø] | Sum= | 9Ø4360 = | DCCA8hex |
| 47,112 | [113] | Sum= | 924020 = | E1974hex |
| 48,115 | [115] | Sum= | 943680 = | E6640hex |
| 49,117 | [118] | Sum= | 963340 = | EB30Chex |
| 5Ø,12Ø | [12Ø] | Sum= | 983000 = | EFFD8hex |

The effect of shifting to increase the scale of the Y increment is to eliminate the binary point in a third data word representing the slope and Y increment and thereby avoiding floating point arithmetic operations.

The binary point separates the bit locations separating fractional from integer values in a data word (i.e. having values equal to or greater than 1 and less than 1 (i.e. between the bit positions "$2^0$" and "$2^{-1}$". The binary point is equivalent to the decimal point in a radix 10 system and equivalent to a "point" between those machine positions having a value equal to or greater than 1 and less than one in any system and separating the fractional values from the integer values in the slope or Y increment value.

By shifting in the direction of more significant bits, the scale factor of Y increment is increased, thereby moving the "point" effectively in the direction of the less significant bits. If a sufficient number of bit positions are shifted, the binary point is eliminated from Y increment. In this way, floating point arithmetic is avoided. The value of Y increment at the increased scale factor may be used to derive a cumulative Y for each respective coordinate X values by iteratively incrementing Y increment by Y increment to produce a first cumulative Y and then incrementing that first cumulative Y with Y increment and so on to produce a series of distinct cumulative Y values at the higher scale factor for each X coordinate. The discrete cumulate Y values may then be reduced by the scale factor to the scale of the numerator (dx) before shifting and added to the initial Y coordinate value to produce the correct Y coordinate for each respective X coordinate. By producing the cumulative Y using Y increment at the increased scale factor, errors in the Y coordinate value due to an error in the cumulative Y increment due to the lower scale factor of Y increment are avoided.

The compiler used in the preferred embodiment to perform the method described herein is shown in the following program listings written in Motorola 68000 assembler language and contained within six modules.

The first module is the main program utilizing the control modules shown as modules 2–7. Its function is to access the pack data and interpret the knot locations and control codes therein.

Module 2 is a subset of module 1 and is used to evaluate each complete information set, identifying the Case and control code value thereof.

Module 3 is the compiler described earlier, which functions according to equations 3.1 and 3.2. and which compiles the knot locations, the angles of the curve at the knots, and the related values of the parameter t to produce the node locations on the curve segment locus.

Module 4 is the compiler which operates according to the method of auto-scaling linear interpolation shown herein.

Module 5 is a module which receives curve coordinate data, corresponding to the display coordinate system and sorts this data in the order of the raster lines on the display, so that the display data is accessed in timed relation to the generation of the raster lines, with data for display on any one particular raster line accessed in time with the location of the imaging beam at that raster line.

Module 6 is a general purpose memory allocation and release mechanism for buffer and raster line data.

Module 7 is an apparatus for performing general trigonometry.

As said, these modules are written in 68000 assembler code as used in the preferred embodiment to perform the invention as described. The language for the preferred embodiment is further compiled into machine object language for use on the Motorola 68000.

```
D E C O D E   A   S E R I E S   O F   L O O P S
 2                                  DECODE  IDNT    1,0 CURVE FONT DECODER
 6
 7                                          XDEF    DECODE
 8
 9                                          XREF    FINAL_HERMITE,HERMITE,INIT_HERMITE
10                                          XREF    GET_PQ,GETNIB34,GET_NIB4
11
12                                  *               STACK TEMPORARIES
13  00000000                                        OFFSET  0
14  00000000                                        DS.W    1
14  FFFFFFFE                        X_HOME:         SET     -*              * X HOME POSITION
15  00000002                                        DS.W    1
15  FFFFFFFC                        Y_HOME:         SET     -*              * Y HOME POSITION
16  00000004                                        DS.B    1
16  FFFFFFFB                        FINAL:          SET     -*              * LAST TIME IF TRUE
17  00000005                                        DS.B    1
17  FFFFFFFA                        X_DIR:          SET     -*              * X DIRECTION
18  00000006                                        DS.B    1
18  FFFFFFF9                        Y_DIR:          SET     -*              * Y DIRECTION
19  00000008                                        DS.W    0
19  FFFFFFF8                        LOCALS:         SET     -*              * NUMBER OF BYTES USED
20
21                                  NEW_VALUE:      MACRO           NEW_VALUE X_OR_Y,X_NEW!Y_NEW!X_CUR!Y_CUR
22                                          JSR     GETNIB34
23                                          LSR.W   #1,D7
24                                          SCS     \1_DIR(A6)
25                                          SUB.W   \1_HOME(A6),D7
26                                          MOVE.W  D7,\2
27                                          ENDM
28
29  9:000000                                SECTION 9               * CODE SECTION
30  9:000000                        DECODE: EQU     *
31  9:000000  4E56FFF8                      LINK    A6,#LOCALS
32  9:000004  4850                          PEA     (A0)
33  9:000006  48A7F800                      MOVEM.W D0/D1/D2/D3/D4,-(SP)
34  9:00000A  3D7C0250FFFE                  MOVE.W  #592,X_HOME(A6)
35  9:000010  3D7C02DFFFFC                  MOVE.W  #735,Y_HOME(A6)
36  9:000016  422EFFFB                      CLR.B   FINAL(A6)
```

Copyright (c) 1983 Allied Corporation All Rights Reserved
Module -I-

```
N E W   L O O P
38  9:00001A                        NEW_LOOP: EQU   *
39  9:00001A  4EB900000000                  JSR     GETNIB34
40  9:000020  6615                          BNE.S   ORG_OK
41  9:000022  4EB900000000                  JSR     GETNIB34
42  9:000028  3D47FFFE                      MOVE.W  D7,X_HOME(A6)
43  9:00002C  4EB900000000                  JSR     GETNIB34
44  9:000032  3D47FFFC                      MOVE.W  D7,Y_HOME(A6)
45  9:000036  4EB900000000                  JSR     GETNIB34
```

```
 46  9:00003C                                ORG_OK: EQU     *
 47  9:00003C  E24F                                  LSR.W   #1,D7
 48  9:00003E  55EEFFFA                              SCS     X_DIR(A6)
 49  9:000042  9E6EFFFE                              SUB.W   X_HOME(A6),D7
 50  9:000046  3007                                  MOVE.W  D7,D0
 51  9:000048  4EB900000000      +                   JSR     GETNIB34
 51  9:00004E  E24F              +                   LSR.W   #1,D7
 51  9:000050  55EEFFF9          +                   SCS     Y_DIR(A6)
 51  9:000054  9E6EFFFC          +                   SUB.W   Y_HOME(A6),D7
 51  9:000058  3207              +                   MOVE.W  D7,D1
 52  9:00005A  4847                                  SWAP    D7
 53  9:00005C  3E00                                  MOVE.W  D0,D7
 54  9:00005E  4EB900000000                          JSR     INIT_HERMITE
 55  9:000064                                NEXT_KNOT: EQU  *
 56  9:000064  3400                                  MOVE.W  D0,D2
 57  9:000066  3601                                  MOVE.W  D1,D3
 58  9:00006B  7800                                  MOVEQ.L #0,D4
 59                              +
 60  9:00006A                                SAME_KNOT: EQU  *
 61  9:00006A  4EB900000000                          JSR     GET_PQ
 62  9:000070  4A47                                  TST.W   D7
 63  9:000072  6743                                  BEQ.S   DO_CONTROL
 64  9:000074  4A2EFFFA                              TST.B   X_DIR(A6)
 65  9:000078  6704                                  BEQ.S   INC_X
 66  9:00007A  9447                                  SUB.W   D7,D2
 67  9:00007C  6002                                  BRA.S   REL_Y
 68  9:00007E  D447                          INC_X:  ADD.W   D7,D2
 69  9:000080  4A2EFFF9                      REL_Y:  TST.B   Y_DIR(A6)
 70  9:000084  6704                                  BEQ.S   INC_Y
 71  9:000086  9646                                  SUB.W   D6,D3
 72  9:000088  6002                                  BRA.S   SEND_KNOT
 73  9:00008A  D646                          INC_Y:  ADD.W   D6,D3
 74                              +
 75  9:00008C                                SEND_KNOT: EQU  *
 76  9:00008C  3002                                  MOVE.W  D2,D0
 77  9:00008E  3203                                  MOVE.W  D3,D1
 78  9:000090  3C04                                  MOVE.W  D4,D6
 79  9:000092  3E01                                  MOVE.W  D1,D7
 80  9:000094  4847                                  SWAP    D7
 81  9:000096  3E00                                  MOVE.W  D0,D7
 82  9:000098  4EB900000000                          JSR     HERMITE
 83  9:00009E  60C6                                  BRA.S   NEXT_KNOT


E N D   L O O P
 85  9:0000A0                                END_LAST: EQU   *
 86  9:0000A0  522EFFFB                              ADDQ.B  #1,FINAL(A6)
 87  9:0000A4                                END_LOOP: EQU   *
 88  9:0000A4  4EB900000000                          JSR     FINAL_HERMITE
 89  9:0000AA  6603                                  BNE.S   LOOP_DONE
 90  9:0000AC  4A2EFFFB                              TST.B   FINAL(A6)
 91  9:0000B0  6700FF6B                              BEQ     NEW_LOOP
 92  9:0000B4  4CDF001F                      LOOP_DONE MOVEM.W (SP)+,D0/D1/D2/D3/D4
 93  9:0000B8  205F                                  MOVE.L  (SP)+,A0
 94  9:0000BA  4E5E                                  UNLK    A6
 95  9:0000BC  4E75                                  RTS
 96                              +
 97  9:0000BE                                DO_CONTROL: EQU *
 98  9:0000BE  3E06                                  MOVE.W  D6,D7
 99  9:0000C0  6B06                                  BMI.S   CASE_DEFAULT
100  9:0000C2  0C47000B                              CMPI.W  #8,D7
101  9:0000C6  6F02                                  BLE.S   CASE_OK
102  9:0000C8                                CASE_DEFAULT: EQU *
103  9:0000C8  7E08                                  MOVEQ.L #8,D7
104  9:0000CA                                CASE_OK: EQU    *
105  9:0000CA  DE47              +                   ADD.W   D7,D7
106  9:0000CC  4EFB7002                              JMP     CASE_TBL(PC,D7.W)
107
108                                          CASE_TBL:
109  9:0000D0  60CE                                  BRA.S   END_LAST
110  9:0000D2  600E                                  BRA.S   HORIZONTAL
111  9:0000D4  6024                                  BRA.S   VERTICAL
112  9:0000D6  6004                                  BRA.S   DIAGONAL
113  9:0000D8  60CA                                  BRA.S   END_LOOP
114  9:0000DA  6034                                  BRA.S   X_NEGATE
115  9:0000DC  603E                                  BRA.S   Y_NEGATE
116  9:0000DE  6038                                  BRA.S   XY_NEGATE
117  9:0000E0  6042                                  BRA.S   DEFAULT

HORIZONTAL / VERTICAL / DIAGONAL
119  9:0000E2                                HORIZONTAL: EQU *
120  9:0000E2                                DIAGONAL: EQU   *
121  9:0000E2  1006                                  MOVE.B  D6,D0
122  9:0000E4  4EB900000000      +                   JSR     GETNIB34
122  9:0000EA  E24F              +                   LSR.W   #1,D7
122  9:0000EC  55EEFFFA          +                   SCS     X_DIR(A6)
122  9:0000F0  9E6EFFFE          +                   SUB.W   X_HOME(A6),D7
122  9:0000F4  3407              +                   MOVE.W  D7,D2
123  9:0000F6  5300                                  SUBQ.B  #1,D0
124  9:0000F8  6792                                  BEQ     SEND_KNOT
125  9:0000FA                                VERTICAL EQU    *
126  9:0000FA  4EB900000000      +                   JSR     GETNIB34
126  9:000100  E24F              +                   LSR.W   #1,D7
126  9:000102  55EEFFF9          +                   SCS     Y_DIR(A6)
126  9:000106  9E6EFFFC          +                   SUB.W   Y_HOME(A6),D7
126  9:00010A  3607              +                   MOVE.W  D7,D3
127  9:00010C  6000FF7E                              BRA     SEND_KNOT
128                              +
129  9:000110                                X_NEGATE: EQU   *
130  9:000110  462EFFFA                              NOT.B   X_DIR(A6)
131  9:000114  6000FF54                              BRA     SAME_KNOT
132  9:000118                                XY_NEGATE: EQU  *
133  9:00011B  462EFFFA                              NOT.B   X_DIR(A6)
134  9:00011C                                Y_NEGATE: EQU   *
135  9:00011C  462EFFF9                              NOT.B   Y_DIR(A6)
136  9:000120  6000FF48                              BRA     SAME_KNOT
137                              +
138  9:000124                                DEFAULT: EQU    *
139  9:000124  7801                                  MOVEQ.L #1,D4
140  9:000126  C806                                  AND.B   D6,D4
141  9:00012B  5204                                  ADDQ.B  #1,D4
142  9:00012A  E147                                  LSL.W   #8,D4
```

```
143  9:00012C  0200 0002          ANDI.B  #2,D6
144  9:000130  E206               ASR.B   #1,D6
145  9:000132  5206               ADDQ.B  #1,D6
146  9:000134  1806               MOVE.B  D6,D4
147  9:000136  6000FF32           BRA     SAME_KNOT
148
149                               END

N I B B L E
  2                       NIBBLE  IDNT    1,0 CURVE FONT LOOP DATA HANDLER
  6                               XDEF    GET_PQ,GETNIB34,GET_NIB4
  7                +
  8                       *       G E T _ P Q
  9                       *
 10  9:000000      +               SECTION $9              * CODE SECTION
 11  9:000000                GET_PQ: EQU     *
 12  9:000000  6172                  BSR.S   GET_NIB1
 13  9:000002  3C07                  MOVE.W  D7,D6
 14  9:000004  E447                  ASR.W   #2,D7
 15  9:000006  DE47       +          ADD.W   D7,D7                   MAKE OFFSET INTO CASE_JMP
 16  9:00000B  4EFB7002              JMP     CASE_BRA(PC,D7.W)
 17
 18  9:00000C  6006          CASE_BRA: BRA.S CASE_0
 19  9:00000E  6014                  BRA.S   CASE_1
 20  9:000010  6026                  BRA.S   CASE_2
 21  9:000012  6040                  BRA.S   CASE_3

G E T _ P Q
 23  9:000014  4A46          CASE_0  TST.W   D6
 24  9:000016  6608                  BNE.S   GTPQ_0
 25  9:00001B  6151                  BSR.S   GET_NIB1
 26  9:00001A  6702                  BEQ.S   *+4
 27  9:00001C  5647                  ADDQ.W  #3,D7
 28  9:00001E  CD47                  EXG     D6,D7
 29  9:000020  7E00          GTPQ_0  MOVEQ.L #0,D7
 30  9:000022  4E75                  RTS
 31
 32  9:000024  614E          CASE_1  BSR.S   GET_NIB1
 33  9:000026  0C470008              CMPI.W  #8,D7
 34  9:00002A  6D06                  BLT.S   GTPQ_1
 35  9:00002C  0247 0007             ANDI.W  #7,D7
 36  9:000030  6030                  BRA.S   GTPQ_9
 37  9:000032  0A46 0004     GTPQ_1  EORI.W  #4,D6
 38  9:000036  6036                  BRA.S   GTPQ_9
 39
 40  9:000038  6138          CASE_2  BSR.S   GET_NIB1
 41  9:00003A  E24E                  LSR.W   #1,D6
 42  9:00003C  6404                  BCC.S   *+6
 43  9:00003E  06470010              ADDI.W  #$10,D7
 44  9:000042  3F07                  MOVE.W  D7,-(SP)
 45  9:000044  6122                  BSR.S   GET_NIB1
 46  9:000046  E24E                  LSR.W   #1,D6
 47  9:000048  6404                  BCC.S   *+6
 48  9:00004A  06470010              ADDI.W  #$10,D7
 49  9:00004E  3C07                  MOVE.W  D7,D6
 50  9:000050  3E1F                  MOVE.W  (SP)+,D7
 51  9:000052  601A                  BRA.S   GTPQ_9
 52
 53  9:000054  611E          CASE_3  BSR.S   GET_NIB1
 54  9:000056  0A46000C              EORI.W  #$C,D6
 55  9:00005A  E94E                  LSL.W   #4,D6
 56  9:00005C  8C47                  OR.W    D7,D6
 57  9:00005E  6140                  BSR.S   GET_NIB2
 58  9:000060  CD47                  EXG     D6,D7
 59  9:000062  4A06                  TST.B   D6
 60  9:000064  6A08                  BPL.S   GTPQ_9
 61  9:000066  00476040              ORI.W   #$40,D7
 62  9:00006A  0246007F              ANDI.W  #$7F,D6
 63  9:00006E  5286          GTPQ_9  ADDQ.L  #1,D6
 64  9:000070  5287                  ADDQ.L  #1,D7
 65  9:000072  4E75                  RTS

G E T   1   N I B B L E
 67                       *       G E T _ N I B 1
 68                       *
 69  7:000000      +               SECTION $7              * DATA SECTION
 70  7:000000                NIB:    DS.B    1
 71  7:000002      +               DS.W    0
 72  9:000074      +               SECTION $9              * CODE SECTION
 73  9:000074  3E2D0028      GET_NIB1 MOVE.W NIB_CNT(A5),D7
 74  9:000078  E44F                  LSR.W   #2,D7
 75  9:00007A  651A                  BCS.S   GNB1_1
 76  9:00007C  206D0000              MOVE.L  NIB_PTR(A5),A0
 77  9:000080  1E307000              MOVE.B  0(A0,D7.W),D7
 78  9:000084  13C700000000          MOVE.B  D7,NIB
 79  9:00008A  546D0028      GNB1_0: ADDQ.W  #2,NIB_CNT(A5)
 80  9:00008E  0247000F              ANDI.W  #$F,D7
 81  9:000092  48C7                  EXT.L   D7
 82  9:000094  4E75                  RTS
 83  9:000096  1E3900000000  GNB1_1: MOVE.B  NIB,D7
 84  9:00009C  E80F                  LSR.B   #4,D7
 85  9:00009E  60EA                  BRA     GNB1_0
 86                       +
 87                       *       G E T _ N I B 2
 88                       *
 89  9:0000A0  3E2D0028      GET_NIB2 MOVE.W NIB_CNT(A5),D7
 90  9:0000A4  E44F                  LSR.W   #2,D7
 91  9:0000A6  6512                  BCS.S   GNB2_1
 92  9:0000A8  5B6D0028              ADDQ.W  #4,NIB_CNT(A5)
 93  9:0000AC  206D0000              MOVE.L  NIB_PTR(A5),A0
 94  9:0000B0  41F07000              LEA.L   0(A0,D7.W),A0
 95  9:0000B4  7E00                  MOVEQ.L #0,D7
 96  9:0000B6  1E10                  MOVE.B  (A0),D7
 97  9:0000BB  4E75                  RTS
 98  9:0000BA  61DA          GNB2_1  BSR     GNB1_1
 99  9:0000BC  3F07                  MOVE.W  D7,-(SP)
100  9:0000BE  61D4                  BSR     GET_NIB1
101  9:0000C0  E94F          GNB3_0  LSL.W   #4,D7
102  9:0000C2  8E5F                  OR.W    (SP)+,D7
103  9:0000C4  4E75                  RTS
```

GET 3 NIBBLES

```
105                                 *       G E T _ N I B 3
106                                 *
107  9:0000C6  7E02                 GET_NIB3: MOVEQ.L #2,D7
108  9:0000C8  CE6A0028                       AND.W   NIB_CNT(A5),D7
109  9:0000CC  6708                           BEQ.S   GNB3_1
110  9:0000CE  61A4                           BSR     GET_NIB1
111  9:0000D0  3F07                           MOVE.W  D7,-(SP)
112  9:0000D2  61C2                           BSR     GET_NIB2
113  9:0000D4  60E4                           BRA     GNB3_0
114  9:0000D6  61C8                 GNB3_1    BSR     GET_NIB2
115  9:0000D8  3F07                           MOVE.W  D7,-(SP)
116  9:0000DA  6198                           BSR     GET_NIB1
117  9:0000DC  E14F                 GNB4_0    LSL.W   #8,D7
118  9:0000DE  8E5F                           OR.W    (SP)+,D7
119  9:0000E0  4E75                           RTS
120                                +
121                                 *       G E T N I B 3 4
122                                 *
123  9:0000E2  7E01                 GETNIB34: MOVEQ.L #1,D7
124  9:0000E4  CE6A0028                       AND.W   NIB_CNT(A5),D7
125  9:0000E8  67D2                           BEQ     GET_NIB3
126                                 *        BRA     GET_NIB4
127                                +
128                                 *       G E T _ N I B 4
129                                 *
130  9:0000EA  61B4                 GET_NIB4: BSR     GET_NIB2
131  9:0000EC  3F07                           MOVE.W  D7,-(SP)
132  9:0000EE  61B0                           BSR     GET_NIB2
133  9:0000F0  60E4                           BRA     GNB4_0
134
135                                          END
```

HERMITE CURVE PROCESSOR

```
 2                                  HERMITE IDNT    1,0 CURVE FONT HERMITE SPLINE GENERATOR
 6                                +
 7                                          XDEF    INIT_HERMITE,HERMITE,FINAL_HERMITE      ENTRY POINTS
 8                                          XDEF    SCALE,SET_BETA,GAMMA_ALPHA,MAKE_NODES   STATIC SUBROUTINE
 9                                          XDEF    SCALE,PREV,CUR,NEXT,FIRST,SECOND        VARIABLES
10                                          XREF    PLOT_CHECK
11
12  0000007F                        LINEAR_IMPLIED: SET     127
13  00000001                        ISLINEAR:       SET     1
14  00000002                        CURVE:          SET     2
15  00000050                        CUSP_IMPLIED:   SET     40*2
16  00000001                        ISCUSP:         SET     1
17  00000002                        CONTIGIOUS:     SET     2
18  0000005A                        HDEG_45:        SET     45*2
19  000000B4                        HDEG_90:        SET     90*2
20  0000016B                        HDEG_180:       SET     180*2
21  00004000                        R_S_2:          SET     $4000
22  00007FFF                        R_S_4:          SET     $7FFF
23  00000003                        T_TOOFAR:       SET     3
24  00000006                        T_DECREMENT:    SET     3*SHORT
25  0000000A                        T_INCREMENT:    SET     5*SHORT
26  00000800                        T_LENGTH:       SET     1024*SHORT
27  00000666                        XI_LIMIT:       SET     1638
28  00000000                       +GAIN@V_SCALE:     SET   0                 GAIN SCALE FACTOR
28  00000008                       +GAIN@S_SCALE:     SET   8
28  000000FF                       +GAIN@M_SCALE:     SET (1<<8-1)<<0
29  00000000                       +R_S@V_SCALE:      SET   0                 R/S SCALE
29  0000000D                       +R_S@S_SCALE:      SET   13
29  00001FFF                       +R_S@M_SCALE:      SET (1<<13-1)<<0
30  00000000                       +SINE@V_SCALE:     SET   0                 SINE/COSINE SCALE
30  0000000F                       +SINE@S_SCALE:     SET   15
30  00007FFF                       +SINE@M_SCALE:     SET (1<<15-1)<<0
31  00000000                       +TIME@V_SCALE:     SET   0                 TIME FUNCTION SCALE
31  0000000F                       +TIME@S_SCALE:     SET   15
31  00007FFF                       +TIME@M_SCALE:     SET (1<<15-1)<<0
```

STATIC DATA AREA

```
33                                  *       KNOT STRUCTURE
34  00000000                                OFFSET  0
35  00000000                       +MIS_Y:          DS.W    1
35  00000002                       +MIS_X:          DS.W    1
36  00000004                       +DRU_Y:          DS.W    1
36  00000006                       +DRU_X:          DS.W    1
37  00000008                        ALPHA:          DS.W    1
38  0000000A                        BETA:           DS.W    1
39  0000000C                        GAMMA:          DS.W    1
40  0000000E                        CUSP:           DS.B    1
41  0000000F                        LINEAR:         DS.B    1
42  00000010                       +        DS.W    0
43  00000010                        KNOT_LENGTH: EQU *
44  7:000000                       +        SECTION $7              * DATA SECTION
45  7:000000                       +        DS.W    0
46  7:000000  0000000000000000      PREV:   DCB.B   KNOT_LENGTH,0
47  7:000010  0000000000000000      CUR:    DCB.B   KNOT_LENGTH,0
48  7:000020  0000000000000000      NEXT:   DCB.B   KNOT_LENGTH,0
49  7:000030  0000000000000000      FIRST:  DCB.B   KNOT_LENGTH,0
50  7:000040  0000000000000000      SECOND: DCB.B   KNOT_LENGTH,0
51                                 +
52                                  *       I N I T _ H E R M I T E
53                                  *
54  9:000000                       +        SECTION $9              * CODE SECTION
55  9:000000  4851                  INIT_HERMITE: PEA (A1)
56  9:000002  43F900000000                  LEA.L   PREV,A1
57  9:000008  426D002A                      CLR.W   KNOT_CNT(A5)
58  9:00000C  2347 0004                     MOVE.L  D7,DRU_Y(A1)
59  9:000010  6104                          BSR.S   SCALE
60  9:000012  225F                          MOVE.L  (SP)+,A1
61  9:000014  4E75                          RTS
```

SCALE --- SLANT / ROTATE / TRANSLATE / SCALE

```
63                                  *       S C A L E
64                                  *
65  9:000016                       +        SECTION $9              * CODE SECTION
66  9:000016                        SCALE:  EQU     *
67  9:000016  48E7C000                      MOVEM.L D0/D1,-(SP)
68  9:00001A  3229 0004                     MOVE.W  DRU_Y(A1),D1
69  9:00001E  3029 0006                     MOVE.W  DRU_X(A1),D0
```

```
 70  9:000022  3E2F0004                          MOVE.W  SLANT(A5),D7
 71  9:000026  6712                              BEQ.S   SCAL_1
 72  9:000028  4EB900000000                      JSR     SINE
 73  9:00002E  CFC1                              MULS    D1,D7
 74  9:000030  E387                +             ASL.L   #16-SINE$S_SCALE,D7
 74  9:000032  4847                +             SWAP    D7
 75  9:000034  D047                              ADD.W   D7,D0
 76  9:000036  33470006                          MOVE.W  D7,DRU_X(A1)
 77  9:00003A  926F000C            SCAL_1:       SUB.W   ROT_Y(A5),D1
 78  9:00003E  906F000E                          SUB.W   ROT_X(A5),D0
 79  9:000042  3E2D0006                          MOVE.W  ROTATE(A5),D7
 80  9:000046  6752                              BEQ.S   SCAL_6
 81  9:00004B  0C4700B4                          CMPI.W  #HDEG_90,D7
 82  9:00004C  6606                              BNE.S   SCAL_2
 83  9:00004E  C141                              EXG     D0,D1
 84  9:000050  4440                              NEG.W   D0
 85  9:000052  6046                              BRA.S   SCAL_6
 86  9:000054  0C47FF4C            SCAL_2:       CMPI.W  #-HDEG_90,D7
 87  9:000058  6606                              BNE.S   SCAL_3
 88  9:00005A  C141                              EXG     D0,D1
 89  9:00005C  4441                              NEG.W   D1
 90  9:00005E  6034                              BRA.S   SCAL_6
 91  9:000060  0C470168            SCAL_3:       CMPI.W  #HDEG_180,D7
 92  9:000064  6706                              BEQ.S   SCAL_4
 93  9:000066  0C47FE98                          CMPI.W  #-HDEG_180,D7
 94  9:00006A  6606                              BNE.S   SCAL_5
 95  9:00006C  4440                SCAL_4:       NEG.W   D0
 96  9:00006E  4441                              NEG.W   D1
 97  9:000070  6024                              BRA.S   SCAL_6

S C A L E ---   SLANT / ROTATE / TRANSLATE / SCALE
 99  9:000072  4EB900000000        SCAL_5:       JSR     COSINE
100  9:000078  3F07                              MOVE.W  D7,-(SP)
101  9:00007A  3E2D0006                          MOVE.W  ROTATE(A5),D7
102  9:00007E  4EB900000000                      JSR     SINE
103  9:000084  3C00                              MOVE.W  D0,D6
104  9:000086  CDC7                              MULS    D7,D6
105  9:000088  CFC1                              MULS    D1,D7
106  9:00008A  C3D7                              MULS    (SP),D1
107  9:00008C  D286                              ADD.L   D6,D1
108  9:00008E  E381                +             ASL.L   #16-SINE$S_SCALE,D1
108  9:000090  4841                +             SWAP    D1
109  9:000092  C1DF                              MULS    (SP)+,D0
110  9:000094  9087                              SUB.L   D7,D0
111  9:000096  E380                +             ASL.L   #16-SINE$S_SCALE,D0
111  9:00009B  4840                +             SWAP    D0
112  9:00009A  D06D0012            SCAL_6:       ADD.W   ORG_X(A5),D0
113  9:00009E  C1E7000A                          MULS    GAIN_X(A5),D0
114  9:0000A2  E0B9                +             ASR.L   #GAIN$S_SCALE,D0
115  9:0000A4  D06F0016                          ADD.W   OFST_X(A5),D0
120  9:0000A8  3340002                           MOVE.W  D0,MIS_X(A1)
122  9:0000AC  D26D0010                          ADD.W   ORG_Y(A5),D1
123  9:0000B0  C3E0008                           MULS    GAIN_Y(A5),D1
124  9:0000B4  E081                +             ASR.L   #GAIN$S_SCALE,D1
125  9:0000B6  D26F0014                          ADD.W   OFST_Y(A5),D1
127  9:0000BA  3281                              MOVE.W  D1,(A1)
132  9:0000BC  4CDF0003                          MOVEM.L (SP)+,D0/D1
133  9:0000C0  4E75                              RTS

H E R M I T E
135                                   *           H E R M I T E
136                                   *
137  9:0000C2                         +           SECTION $9              * CODE SECTION
138  9:0000C2                              HERMITE: EQU    *
139  9:0000C2  48E70060                          MOVEM.L A1/A2,-(SP)
140  9:0000C6  45F900000010                      LEA.L   CUR,A2
141  9:0000CC  4A6D002A                          TST.W   KNOT_CNT(A5)
142  9:0000D0  6613                              BNE.S   HRMT_1
143  9:0000D2  2547D004                          MOVE.L  D7,DRU_Y+CUR-CUR(A2)
144  9:0000D6  354FFFFE                          MOVE.W  D6,CUSP+PREV-CUR(A2)
145  9:0000DA  43D2                              LEA.L   (A2),A1
146  9:0000DC  6100FF38                          BSR     SCALE
147  9:0000E0  43EAFFF0                          LEA.L   PREV-CUR(A2),A1
148  9:0000E4  6100A0                            BSR     SET_BETA
149  9:0000E8  6044                              BRA.S   HRMT_0
150  9:0000EA  25479014            HRMT_1:       MOVE.L  D7,DRU_Y+NEXT-CUR(A2)
151  9:0000EE  354D000E                          MOVE.W  D6,CUSP+CUR-CUR(A2)
152  9:0000F2  43E0010                           LEA.L   NEXT-CUR(A2),A1
153  9:0000F6  6100FF1E                          BSR     SCALE
154  9:0000FA  C54F                              EXG     A2,A1
155  9:0000FC  6100088                           BSR     SET_BETA
156  9:000100  7C10                              MOVEQ.L #NEXT-CUR,D6
157  9:000102  45D1                              LEA.L   (A1),A2
158  9:000104  43EAFFF0                          LEA.L   PREV-CUR(A2),A1
159  9:000108  61000130                          BSR     GAMMA_ALPHA
160  9:00010C  672A                              BEQ.S   HRMT_4
161  9:00010E  0C6D0001002A                      CMPI.W  #2-1,KNOT_CNT(A5)
162  9:000114  672E                              BEQ.S   HRMT_5
163  9:000116  61000250                          BSR     MAKE_NODES

H E R M I T E
165  9:00011A  43EAFFF0            HRMT_2:       LEA.L   PREV-CUR(A2),A1
166  9:00011E  22DA                +             MOVE.L  (A2)+,(A1)+
166  9:000120  22DA                +             MOVE.L  (A2)+,(A1)+
166  9:000122  22DA                +             MOVE.L  (A2)+,(A1)+
166  9:000124  22DA                +             MOVE.L  (A2)+,(A1)+
169  9:000126                              HRMT_3: EQU     *
170  9:000126  22DA                +             MOVE.L  (A2)+,(A1)+
170  9:000128  22DA                +             MOVE.L  (A2)+,(A1)+
170  9:00012A  22DA                +             MOVE.L  (A2)+,(A1)+
170  9:00012C  22DA                +             MOVE.L  (A2)+,(A1)+
171  9:00012E  4CDF0600            HRMT_0:       MOVEM.L (SP)+,A1/A2
172  9:000132  526D002A                          ADDQ.W  #1,KNOT_CNT(A5)
173  9:000136  4E75                              RTS
174  9:000138                      HRMT_4:       EQU     *
175  9:000138  45E03010            +             LEA.L   NEXT-CUR(A2),A2
176  9:00013C  6148                              BSR.S   SET_BETA
177  9:00013E  43EAFFF0                          LEA.L   CUR-NEXT(A2),A1
178  9:000142  60E2                              BRA     HRMT_3
179  9:000144  3E2A000A            HRMT_5:       MOVE.W  BETA(A2),D7
180  9:00014B  9E69000A                          SUB.W   BETA(A1),D7
```

```
181  9:00014C  4EB900000000                JSR      FOLD_ANGLE
182  9:000152  5EE9002F                    SGT      INIT_COLOR(A5)
184  9:000156  3E12                        MOVE.W   (A2),D7
185  9:000158  BE51                        CMP.W    (A1),D7
191  9:00015A  5DC7                        SLT      D7
192  9:00015C  6606                        BNE.S    HRMT_6
193  9:00015E  BE29002F                    CMP.B    INIT_COLOR(A5),D7
194  9:000162  57C7                        SEQ      D7
195  9:000164  1B47002E            HRMT_6  MOVE.B   D7,COLOR(A5)
196  9:000168  43E9C020                    LEA.L    FIRST-CUR(A2),A1
197  9:00016C  45E1FFF0            +       LEA.L    PREV-CUR(A2),A2
198  9:000170  22D1                +       MOVE.L   (A2)+,(A1)+
198  9:000172  22D1                +       MOVE.L   (A2)+,(A1)+
198  9:000174  22D1                +       MOVE.L   (A2)+,(A1)+
198  9:000176  22D1                +       MOVE.L   (A2)+,(A1)+
201  9:00017B  22D1                +       MOVE.L   (A2)+,(A1)+
201  9:00017A  22D1                +       MOVE.L   (A2)+,(A1)+
201  9:00017C  22D1                +       MOVE.L   (A2)+,(A1)+
201  9:00017E  22D1                +       MOVE.L   (A2)+,(A1)+
201  9:000180  45E1FFF0            +       LEA.L    -(KNOT_LENGTH)(A2),A2
202  9:000184  6094                        BRA      HRMT_2
```

S E T  B E T A

```
204                                   *       S E T _ B E T A
205                                   *
206  9:000186                      +         SECTION #9              * CODE SECTION
207  9:000186                      SET_BETA  EQU      *
208  9:000186  3E29 0004                     MOVE.W   DRU_Y(A2),D7
209  9:00018A  9E69 0004                     SUB.W    DRU_Y(A1),D7
210  9:00018E  4847                          SWAP     D7
211  9:000190  3E29 0006                     MOVE.W   DRU_X(A2),D7
212  9:000194  9E69 0006                     SUB.W    DRU_X(A1),D7
213  9:000198  2F07                          MOVE.L   D7,-(SP)
214  9:00019A  4EB900000000                  JSR      ARCTAN
215  9:0001A0  DE69 0006                     ADD.W    ROTATE(A5),D7
216  9:0001A4  3347 000A                     MOVE.W   D7,BETA(A1)
217  9:0001A8  4A29 000F                     TST.B    LINEAR(A1)
218  9:0001AC  6622                          BNE.S    SBETA_4
219  9:0001AE  3E17                          MOVE.W   (SP)+,D7
220  9:0001B0  6A02                +         BPL.S    *+4
220  9:0001B2  4447                +         NEG.W    D7
221  9:0001B4  0C47 007F                     CMPI.W   #LINEAR_IMPLIED,D7
222  9:0001B8  620E                          BHI.S    SBETA_2
223  9:0001BA  3E17                          MOVE.W   (SP)+,D7
224  9:0001BC  6A02                +         BPL.S    *+4
224  9:0001BE  4447                +         NEG.W    D7
225  9:0001C0  0C47 007F                     CMPI.W   #LINEAR_IMPLIED,D7
226  9:0001C4  6204                          BHI.S    SBETA_3
227  9:0001C6  4E75                          RTS
228  9:0001C8                      SBETA_2   EQU      *
229  9:0001C8  548F                +         ADDQ.L   #SHORT,SP
230  9:0001CA  5229 000F           SBETA_3   ADDQ.B   #ISLINEAR,LINEAR(A1)
231  9:0001CE  4E75                          RTS
232  9:0001D0                      SBETA_4   EQU      *
233  9:0001D0  588F                +         ADDQ.L   #LONG,SP
234  9:0001D2  4E75                          RTS
```

F I N A L  H E R M I T E

```
236                                   *       F I N A L _ H E R M I T E
237                                   *
238  9:0001D4                      +         SECTION #9              * CODE SECTION
239  9:0001D4  7E01                FHMT_1:   MOVEQ.L  #TRUE,D7
240  9:0001D6  1B47 002D                     MOVE.B   D7,LOOP_NOT_CLOSED(A5)
241  9:0001DA  4E75                          RTS
242  9:0001DC                      FINAL_HERMITE: EQU *
243  9:0001DC  2E39 00000034                 MOVE.L   FIRST+DRU_Y,D7
244  9:0001E2  BEB9 00000014                 CMP.L    CUR+DRU_Y,D7
245  9:0001E8  66EA                          BNE      FHMT_1
246  9:0001EA  48E7 C060                     MOVEM.L  D0/D1/A1/A2,-(SP)
247  9:0001EE  45F9 00000030                 LEA.L    FIRST,A2
248  9:0001F4  7C10                          MOVEQ.L  #SECOND-FIRST,D6
249  9:0001F6  43E9FFD0                      LEA.L    PREV-FIRST(A2),A1
250  9:0001FA  613E                          BSR.S    GAMMA_ALPHA
251  9:0001FC  672E                          BEQ.S    FHMT_3
252  9:0001FE  6109 0168                     BSR      MAKE_NODES
253  9:000202  43D2                          LEA.L    (A2),A1
254  9:000204  45E9 0010           +         LEA.L    SECOND-FIRST(A2),A2
255  9:000208  6109 015E           FHMT_2:   BSR      MAKE_NODES
256  9:00020C  3029 0020                     MOVE.W   OLD_RASTER(A5),D0
257  9:000210  3229 0022                     MOVE.W   OLD_INTERCEPT(A5),D1
258  9:000214  D241                          ADD.W    D1,D1
259  9:000216  4A29 002E                     TST.B    COLOR(A5)
260  9:00021A  6702                          BEQ.S    *+4
261  9:00021C  5241                          ADDQ.W   #1,D1
262  9:00021E  4EB900000000                  JSR      PLOT_CHECK
263  9:000224  4CDF 0603                     MOVEM.L  (SP)+,D0/D1/A1/A2
264  9:000228  7E00                          MOVEQ.L  #FALSE,D7
265  9:00022A  4E75                          RTS
266  9:00022C                      FHMT_3:   EQU      *
267  9:00022C  45E9 0010           +         LEA.L    SECOND-FIRST(A2),A2
268  9:000230  6100 FF54                     BSR      SET_BETA
269  9:000234  7C00                          MOVEQ.L  #SECOND-SECOND,D6
270  9:000236  6102                          BSR.S    GAMMA_ALPHA
271  9:000238  60CE                          BRA      FHMT_2
```

G A M M A  A L P H A

```
273                                   *       G A M M A _ A L P H A
274                                   *
275  9:00023A                      +         SECTION #9              * CODE SECTION
276  9:00023A                      GAMMA_ALPHA: EQU *
277  9:00023A  4A86                          TST.L    D6
278  9:00023C  6734                          BEQ.S    GMAL_4
279  9:00023E  3E29 000A                     MOVE.W   BETA(A2),D7
280  9:000242  9E69 000A                     SUB.W    BETA(A1),D7
281  9:000246  6716                          BEQ.S    GMAL_2
287  9:000248  3E29 0002                     MOVE.W   MIS_X(A2),D7
288  9:00024C  BE69 0002                     CMP.W    MIS_X(A1),D7
290  9:000250  6614                          BNE.S    GMAL_3
291  9:000252  BE76 6802                     CMP.W    MIS_X(A2,D6.L),D7
292  9:000256  6706                          BEQ.S    GMAL_2
294  9:000258  3E12                          MOVE.W   (A2),D7
```

```
295  9:00025A  BE51                    CMP.W    (A1),D7
301  9:00025C  6614                    BNE.S    GMAL_4
302  9:00025E  536D002A        GMAL_2: SUBQ.W   #1,KNOT_CNT(A5)
303  9:000262  7E00                    MOVEQ.L  #FALSE,D7
304  9:000264  4E75                    RTS
305  9:000266                  GMAL_3: EQU      *
307  9:000266  3E12                    MOVE.W   (A2),D7
308  9:000268  BE51                    CMP.W    (A1),D7
314  9:00026A  6606                    BNE.S    GMAL_4
315  9:00026C  BE76800                 CMP.W    MIS_Y(A2,D6.L),D7
316  9:000270  67EC                    BEQ.S    GMAL_2

C A M M A   A L P H A

318  9:000272  4A2A000E        GMAL_4: TST.B    CUSP(A2)
319  9:000276  6622                    BNE.S    GMAL_6
320  9:000278  3E2A000A                MOVE.W   BETA(A2),D7
321  9:00027C  9E6D000A                SUB.W    BETA(A1),D7
322  9:000280  4EB9000000000           JSR      FOLD_ANGLE
323  9:000286  4A47                    TST.W    D7
324  9:000288  6A02                    BPL.S    *+4
324  9:00028A  4447                    NEG.W    D7
325  9:00028C  0C470050                CMPI.W   #CUSP_IMPLIED,D7
326  9:000290  6304                    BLS.S    GMAL_5
327  9:000292  532A000E                SUBQ.B   #CONTIGIOUS-ISCUSP,CUSP(A2)
328  9:000296  542A000E        GMAL_5: ADDQ.B   #CONTIGIOUS,CUSP(A2)
329  9:00029A  4A6D0004        GMAL_6: TST.W    SLANT(A5)
330  9:00029E  660A                    BNE.S    GMAL6A
331  9:0002A0  3E2D000B                MOVE.W   GAIN_Y(A5),D7
332  9:0002A4  BE6D000A                CMP.W    GAIN_X(A5),D7
333  9:0002A8  673E                    BEQ.S    GMAL_8
334  9:0002AA  0C6D0001002A    GMAL6A  CMPI.W   #2-1,KNOT_CNT(A5)
335  9:0002B0  6618                    BNE.S    GMAL_7
337  9:0002B2  3E12                    MOVE.W   (A2),D7
338  9:0002B4  9E51                    SUB.W    (A1),D7
344  9:0002B6  4847                    SWAP     D7
350  9:0002B8  3E2A0002                MOVE.W   MIS_X(A2),D7
351  9:0002BC  9E6A0002                SUB.W    MIS_X(A1),D7
353  9:0002C0  4EB900000000            JSR      ARCTAN
354  9:0002C6  3347000A                MOVE.W   D7,BETA(A1)
355  9:0002CA  4A86            GMAL_7: TST.L    D6
356  9:0002CC  671A                    BEQ.S    GMAL_8
357  9:0002CE  3E36800                 MOVE.W   MIS_Y(A2,D6.L),D7
359  9:0002D2  9E51                    SUB.W    (A2),D7
364  9:0002D4  4847                    SWAP     D7
365  9:0002D6  3E36802                 MOVE.W   MIS_X(A2,D6.L),D7
370  9:0002DA  9E6A0002                SUB.W    MIS_X(A2),D7
372  9:0002DE  4EB900000000            JSR      ARCTAN
373  9:0002E4  3347000A                MOVE.W   D7,BETA(A2)

C A M M A   A L P H A

375  9:0002E8  0C2A0002000E    GMAL_8  CMPI.B   #CONTIGIOUS,CUSP(A2)
376  9:0002EE  6656                    BNE.S    GMAL_13
377  9:0002F0  3E2A000A                MOVE.W   BETA(A2),D7
378  9:0002F4  DE6A000A                ADD.W    BETA(A1),D7
379  9:0002F8  E247                    ASR.W    #1,D7
380  9:0002FA  3547000B                MOVE.W   D7,ALPHA(A2)
381  9:0002FE  3E2A000A                MOVE.W   BETA(A2),D7
382  9:000302  9E6A000A                SUB.W    BETA(A1),D7
383  9:000306  6A02                    BPL.S    *+4
383  9:00030B  4447                    NEG.W    D7
384  9:00030A  0C470168                CMPI.W   #HDEG_180,D7
385  9:00030E  6312                    BLS.S    GMAL_10
386  9:000310  3E2A0008                MOVE.W   ALPHA(A2),D7
387  9:000314  6B04                    BMI.S    GMAL_9
388  9:000316  044702D0                SUB.W    #HDEG_180*2,D7
389  9:00031A  0647016B        GMAL_9  ADD.W    #HDEG_180,D7
390  9:00031E  3547000B                MOVE.W   D7,ALPHA(A2)
391  9:000322  336A0008000C    GMAL_10 MOVE.W   ALPHA(A2),GAMMA(A1)
392  9:000328  7E01                    MOVEQ.L  #ISLINEAR,D7
393  9:00032A  BE2A000F                CMP.B    LINEAR(A1),D7
394  9:00032E  6606                    BNE.S    GMAL_11
395  9:000330  336A000A0008            MOVE.W   BETA(A1),ALPHA(A2)
396  9:000336  BE2A000F        GMAL_11 CMP.B    LINEAR(A2),D7
397  9:00033A  6606                    BNE.S    GMAL_12
398  9:00033C  336A000A000C            MOVE.W   BETA(A2),GAMMA(A1)
399  9:000342  7E01            GMAL_12 MOVEQ.L  #TRUE,D7
400  9:000344  4E75                    RTS
401  9:000346  336A000A000C    GMAL_13 MOVE.W   BETA(A1),GAMMA(A1)
402  9:00034C  336A000A0008            MOVE.W   BETA(A2),ALPHA(A2)
403  9:000352  60EE                    BRA      GMAL_12

M A K E   N O D E S

405                           *       M A K E _ N O D E S
406                           *
407                           *LOCALS
408  00000000                         OFFSET   0
409  00000000                                  DS.W     1
409  FFFFFFFE                  X2_X1:          SET      -*
410  00000002                                  DS.W     1
410  FFFFFFFC                  Y2_Y1:          SET      -*
411  00000004                                  DS.W     1
411  FFFFFFFA                  T_STEP:         SET      -*
412  00000006                                  DS.W     0
412  FFFFFFFA                  LOCALS:         SET      -*
413
414                                   XREF     NTRPLB
415                                   XREF     ARCTAN,SINE,COSINE,FOLD_ANGLE
416                                   XREF     TIME_1_TBL,TIME_2_TBL,XI_TBL

M A K E   N O D E S

418  9:000354                         SECTION  #9              * CODE SECTION
419  9:000354  4E5E            MKND_99 UNLK     A6
420  9:000356  4C9FC03F                MOVEM.W  (SP)+,D0/D1/D2/D3/D4/D5
421  9:00035A                  MKND_1: EQU      *
423  9:00035A  3C12                    MOVE.W   (A2),D6
432  9:00035C  3E2A0002                MOVE.W   MIS_X(A2),D7
434  9:000360  4EB900000000            JSR      NTRPLB
435  9:000366  4E75                    RTS
436
437  9:000368                  MAKE_NODES: EQU *
```

```
439  9:000368  2B5:0020                          MOVE.L   (A1),PLOT_Y(A5)
444  9:00036C  0C2:0001000F            MKND_2:   CMPI.B   #ISLINEAR,LINEAR(A1)
445  9:000372  67E6                              BEQ      MKND_1
446  9:000374  3E2:000A                          MOVE.W   BETA(A1),D7
447  9:00037B  BE6:0008                          CMP.W    ALPHA(A1),D7
448  9:00037C  6606                              BNE.S    MKND_3
449  9:00037E  BE6:000C                          CMP.W    GAMMA(A1),D7
450  9:000382  67D6                              BEQ      MKND_1

MAKE  NODES
452  9:000384  48A7FC00                MKND_3    MOVEM.W  D0/D1/D2/D3/D4/D5,-(SP)
453  9:000388  4E56FFFA                          LINK     A6,#LOCALS
454  9:00038C  9E6:000B                          SUB.W    ALPHA(A1),D7
455  9:000390  4EB:00000000                      JSR      FOLD_ANGLE
456  9:000396  3007                              MOVE.W   D7,D0
457  9:000398  3E2:000C                          MOVE.W   GAMMA(A1),D7
458  9:00039C  9E6:000A                          SUB.W    BETA(A1),D7
459  9:0003A0  4EB:00000000                      JSR      FOLD_ANGLE
460  9:0003A6  3207                              MOVE.W   D7,D1
461  9:0003AB  6602                              BNE      *+4
462  9:0003AA  3200                              MOVE.W   D0,D1
463  9:0003AC  4A40                              TST.W    D0
464  9:0003AE  6602                              BNE      *+4
465  9:0003B0  3001                              MOVE.W   D1,D0
466  9:0003B2  3E00                              MOVE.W   D0,D7
467  9:0003B4  DE41                              ADD.W    D1,D7
468  9:0003B6  E247                              ASR.W    #1,D7
469  9:0003B8  6A02                +             BPL.S    *+4
469  9:0003BA  4447                +             NEG.W    D7
470  9:0003BC  0C47005A                          CMPI.W   #HDEG_45,D7
471  9:0003C0  6306                              BLS.S    MKND_4
472  9:0003C2  4447                              NEG.W    D7
473  9:0003C4  0647:00B4                         ADDI.W   #HDEG_90,D7
474  9:0003C8  41F:00000000            MKND_4    LEA.L    X1_TBL,A0
475  9:0003CE  DE47                +             ADD.W    D7,D7
476  9:0003D0  3E30:7000                         MOVE.W   0(A0,D7.W),D7
477  9:0003D4  3407                              MOVE.W   D7,D2
478  9:0003D6  0C47:0666                         CMPI.W   #X1_LIMIT,D7
479  9:0003DA  6408                +             BCC.S    MKND_5          * HIGH OR SAME
480  9:0003DC  323:4000                          MOVE.W   #R_S_2,D1
481  9:0003E0  3001                              MOVE.W   D1,D0
482  9:0003E2  6042                              BRA.S    MKND_10
483  9:0003E4  7C00                    MKND_5    MOVEQ.L  #0,D6
484  9:0003E6  3C02                              MOVE.W   D2,D6
485  9:0003EB  E586                              ASL.L    #2,D6
486  9:0003EA  3E01                              MOVE.W   D1,D7
487  9:0003EC  4EB:00000000                      JSR      SINE
488  9:0003F2  6A02                +             BPL.S    *+4
488  9:0003F4  4487                +             NEG.L    D7
489  9:0003F6  BE86                              CMP.L    D6,D7
490  9:0003F8  6506                +             BCS.S    MKND_6          * LOWER
491  9:0003FA  3E3:7FFF                          MOVE.W   #R_S_4,D7
492  9:0003FE  6006                              BRA.S    MKND_7

MAKE  NODES
494  9:000400  4847                    MKND_6:   SWAP     D7
495  9:000402  E687                              ASR.L    #16-R_S*S_SCALE,D7
496  9:000404  8EC2                              DIVU     D2,D7
497  9:000406  3207                    MKND_7:   MOVE.W   D7,D1
498  9:000408  3E00                              MOVE.W   D0,D7
499  9:00040A  4EB:00000000                      JSR      SINE
500  9:000410  6A02                +             BPL.S    *+4
500  9:000412  4487                +             NEG.L    D7
501  9:000414  BE86                              CMP.L    D6,D7
502  9:000416  6506                +             BCS.S    MKND_8          * LOWER
503  9:000418  3E3:7FFF                          MOVE.W   #R_S_4,D7
504  9:00041C  6006                              BRA.S    MKND_9
505  9:00041E  4847                    MKND_8:   SWAP     D7
506  9:000420  E687                              ASR.L    #16-R_S*S_SCALE,D7
507  9:000422  8EC2                              DIVU     D2,D7
508  9:000424  3007                    MKND_9:   MOVE.W   D7,D0
509  9:000426                          MKND_10   EQU      *
514  9:000426  3C2:0002                          MOVE.W   MIS_X(A2),D6
516  9:00042A  9C6:0022                          SUB.W    PLOT_X(A5),D6
517  9:00042E  3D4:FFFE                          MOVE.W   D6,X2_X1(A6)
518  9:000432  6A02                +             BPL.S    *+4
518  9:000434  4446                +             NEG.W    D6
520  9:000436  3E12                              MOVE.W   (A2),D7
525  9:000438  9E6:0020                          SUB.W    PLOT_Y(A5),D7
526  9:00043C  3D47FFFC                          MOVE.W   D7,Y2_Y1(A6)
527  9:000440  6A02                +             BPL.S    *+4
527  9:000442  4447                +             NEG.W    D7
528  9:000444  BE46                              CMP.W    D6,D7
529  9:000446  6202                              BHI.S    MKND_11
530  9:000448  3E2:000A                          MOVE.W   BETA(A1),D7
531  9:00044C  4EB:00000000                      JSR      COSINE
532  9:000452  6002                              BRA.S    MKND_12
533  9:000454  3C07                    MKND_11   MOVE.W   D7,D6
534  9:000456  3E2:000A                          MOVE.W   BETA(A1),D7
535  9:00045A  4EB:00000000                      JSR      SINE
536  9:000460                          MKND_12   EQU      *
537  9:000460  6A02                +             BPL.S    *+4
537  9:000462  4487                +             NEG.L    D7
538  9:000464  4846                              SWAP     D6
539  9:000466  4246                              CLR.W    D6
540  9:000468  E286                              ASR.L    #16-SINE*S_SCALE,D6
541  9:00046A  8CC7                              DIVU     D7,D6
542  9:00046C  3406                              MOVE.W   D6,D2
543  9:00046E  CCC1                              MULU     D1,D6
544  9:000470  E386                +             ASL.L    #16-(R_S*S_SCALE+2),D6
544  9:000472  4846                +             SWAP     D6
545  9:000474  3206                              MOVE.W   D6,D1
546  9:000476  3E02                              MOVE.W   D2,D7
547  9:000478  CEC0                              MULU     D0,D7
548  9:00047A  E387                +             ASL.L    #16-(R_S*S_SCALE+2),D7
548  9:00047C  4847                +             SWAP     D7
549  9:00047E  3007                              MOVE.W   D7,D0
550  9:000480  3E2:0008                          MOVE.W   ALPHA(A1),D7
```

```
M A K E   N O D E S
  551  9:0004B4  4EB900000000                JSR      COSINE
  552  9:0004BA  C5C1                        MULS     D1,D7
  553  9:0004BC  E787                +       ASL.L    #16-(SINE$S_SCALE-2),D7
  553  9:0004BE  4847                +       SWAP     D7
  554  9:000490  3607                        MOVE.W   D7,D3
  555  9:000492  3E2D0008                    MOVE.W   ALPHA(A1),D7
  556  9:000496  4EB900000000                JSR      SINE
  557  9:00049C  C5C1                        MULS     D1,D7
  558  9:00049E  E787                +       ASL.L    #16-(SINE$S_SCALE-2),D7
  558  9:0004A0  4847                +       SWAP     D7
  559  9:0004A2  3207                        MOVE.W   D7,D1
  560  9:0004A4  3E2D000C                    MOVE.W   GAMMA(A1),D7
  561  9:0004A8  4EB900000000                JSR      COSINE
  562  9:0004AE  C5C0                        MULS     D0,D7
  563  9:0004B0  E787                +       ASL.L    #16-(SINE$S_SCALE-2),D7
  563  9:0004B2  4847                +       SWAP     D7
  564  9:0004B4  3807                        MOVE.W   D7,D4
  565  9:0004B6  3E2D000C                    MOVE.W   GAMMA(A1),D7
  566  9:0004BA  4EB900000000                JSR      SINE
  567  9:0004C0  C5C0                        MULS     D0,D7
  568  9:0004C2  E787                +       ASL.L    #16-(SINE$S_SCALE-2),D7
  568  9:0004C4  4847                +       SWAP     D7
  569  9:0004C6  3007                        MOVE.W   D7,D0
  570  9:0004C8  2E3900000800                MOVE.L   #T_LENGTH,D7
  571  9:0004CE  8EC2                        DIVU     D2,D7
  572  9:0004D0  5247                        ADDQ.W   #SHORT-1,D7
  573  9:0004D2  024FFFFE                    ANDI.W   #-SHORT,D7
  574  9:0004D6  6602                        BNE.S    *+4
  575  9:0004D8  7E02                        MOVEQ.L  #SHORT,D7
  576  9:0004DA  3D4FFFFA                    MOVE.W   D7,T_STEP(A6)
  577  9:0004DE  4245                        CLR.W    D5

M A K E   N O D E S
  579  9:0004E0  DA6FFFFA          MKND_19   ADD.W    T_STEP(A6),D5
  580  9:0004E4  0C45B800          MKND_20   CMPI.W   #T_LENGTH,D5
  581  9:0004E8  6C00FF6A                    BGE      MKND_99
  582  9:0004EC  3E3807FE                    MOVE.W   #T_LENGTH-SHORT,D7
  583  9:0004F0  9E45                        SUB.W    D5,D7
  584  9:0004F2  41F930000000                LEA.L    TIME_2_TBL,A0
  585  9:0004F8  3E307000                    MOVE.W   0(A0,D7.W),D7
  586  9:0004FC  CFC4                        MULS     D0,D7
  587  9:0004FE  3C35C000                    MOVE.W   0(A0,D5.W),D6
  588  9:000502  CDC1                        MULS     D1,D6
  589  9:000504  9C87                        SUB.L    D7,D6
  590  9:000506  41F930000000                LEA.L    TIME_1_TBL,A0
  591  9:00050C  3E2DFFFC                    MOVE.W   Y2_Y1(A6),D7
  592  9:000510  CFF35000                    MULS     0(A0,D5.W),D7
  593  9:000514  DC87                        ADD.L    D7,D6
  594  9:000516  E386                +       ASL.L    #16-TIME$S_SCALE,D6
  594  9:000518  4846                +       SWAP     D6
  596  9:00051A  DC51                        ADD.W    (A1),D6
  601  9:00051C  3406                        MOVE.W   D6,D2
  602  9:00051E  9C6D0020                    SUB.W    PLOT_Y(A5),D6
  603  9:000522  6604                        BNE.S    MKND_21
  604  9:000524  066D000AFFFA                ADD.W    #T_INCREMENT,T_STEP(A6)
  605  9:00052A  60B4                        BRA      MKND_19
  606  9:00052C                    MKND_21   EQU      *
  607  9:00052C  6A02                +       BPL.S    *+4
  607  9:00052E  4446                +       NEG.W    D6
  608  9:000530  0C46D003                    CMPI.W   #T_TOOFAR,D6
  609  9:000534  6302                        BLS.S    MKND_22
  610  9:000536  5D6FFFFA                    SUB.W    #T_DECREMENT,T_STEP(A6)
  611  9:00053A  6E06                        BGT.S    MKND_22
  612  9:00053C  3D7D0002FFFA                MOVE.W   #SHORT,T_STEP(A6)

M A K E   N O D E S
  614  9:000542  3E3807FE          MKND_22   MOVE.W   #T_LENGTH-SHORT,D7
  615  9:000546  9E45                        SUB.W    D5,D7
  616  9:000548  41F930000000                LEA.L    TIME_2_TBL,A0
  617  9:00054E  3E307000                    MOVE.W   0(A0,D7.W),D7
  618  9:000552  CFC4                        MULS     D4,D7
  619  9:000554  3C35C000                    MOVE.W   0(A0,D5.W),D6
  620  9:00055B  CDC3                        MULS     D3,D6
  621  9:00055A  9C87                        SUB.L    D7,D6
  622  9:00055C  41F900000000                LEA.L    TIME_1_TBL,A0
  623  9:000562  3E2DFFFE                    MOVE.W   X2_X1(A6),D7
  624  9:000566  CFF35000                    MULS     0(A0,D5.W),D7
  625  9:00056A  DE86                        ADD.L    D6,D7
  626  9:00056C  E387                +       ASL.L    #16-TIME$S_SCALE,D7
  626  9:00056E  4847                +       SWAP     D7
  631  9:000570  DE6D0002                    ADD.W    MIS_X(A1),D7
  633  9:000574  3C02                        MOVE.W   D2,D6
  634  9:000576  4EB900000000                JSR      NTRPL8
  635  9:00057C  6000FF62                    BRA      MKND_19
  636
  637                                       END

R e a d o n l y   T i m e   T a b l e s
T i m e   F u n c t i o n #1
TIMETABL      5      T i m e   F u n c t i o n #1
TIMETABL    137      T i m e   F u n c t i o n #2
    5                                +
    6                                         xdef     time_1_tbl,time_2_tbl
    7  C:000000                       +       section $C                 * Code Section
    8  C:000000                       time_1_tbl: equ *                  * 3*t*t-2*t*t*t   t=0..1023/1024 by 1/1024
    9  C:000000  0000000000000001               dc.w 0,0,0,1,1,2,3,5
   10  C:000010  000A000B0009000B               dc.w 6,8,9,11,13,16,18,21
   11  C:000020  001F001B001E0021               dc.w 24,27,30,33,37,41,45,49
   12  C:000030  003D003A003E0043               dc.w 53,58,62,67,72,77,83,88
   13  C:000040  0052006400600070               dc.w 94,100,106,112,119,125,132,139
   14  C:000050  009200990A100A8                dc.w 146,153,161,168,176,184,192,201
   15  C:000060  00B000DA00E300EC               dc.w 209,218,227,236,245,254,264,273
   16  C:000070  011C0125012F013A               dc.w 283,293,303,314,324,335,346,357
   17  C:000080  0170017B01870192               dc.w 368,379,391,402,414,426,438,451
   18  C:000090  01C901DC01E901F6               dc.w 463,476,489,502,515,528,541,555
   19  C:0000A0  0230024702550263               dc.w 569,583,597,611,625,640,655,669
   20  C:0000B0  02A002BC02C802DA               dc.w 684,700,715,730,746,762,778,794
   21  C:0000C0  0320033A0348035C               dc.w 810,826,843,860,876,893,911,928
   22  C:0000D0  03E003C3003D03E7               dc.w 945,963,981,999,1017,1035,1053,1072
   23  C:0000E0  0442045504680473               dc.w 1090,1109,1128,1147,1166,1186,1205,1225
   24  C:0000F0  04D004F005050519               dc.w 1245,1264,1285,1305,1325,1346,1366,1387
```

```
25  C:000100  058 059505AA05C0     dc.w 1408,1429,1450,1472,1493,1515,1537,1558
26  C:000110  062 06430659066F     dc.w 1580,1603,1625,1647,1670,1693,1716,1739
27  C:000120  06E 06F907100728     dc.w 1762,1785,1808,1832,1856,1879,1903,1927
28  C:000130  07A 07B807D007E9     dc.w 1952,1976,2000,2025,2050,2075,2100,2125
29  C:000140  0B6 0B7F0B9908B3     dc.w 2150,2175,2201,2227,2252,2278,2304,2330
30  C:000150  093 094F096A09B4     dc.w 2357,2383,2410,2436,2463,2490,2517,2544
31  C:000160  0A0 0A270A420A5E     dc.w 2571,2599,2626,2654,2682,2709,2737,2766
32  C:000170  0AE 0B060B230B3F     dc.w 2794,2822,2851,2879,2908,2937,2966,2995
33  C:000180  0BD 0BED0C0B0C2B     dc.w 3024,3053,3083,3112,3142,3172,3202,3232
34  C:000190  0CB 0CDC0CFA0D19     dc.w 3262,3292,3322,3353,3383,3414,3445,3476
35  C:0001A0  0DB 0DD20DF10E10     dc.w 3507,3538,3569,3600,3632,3664,3695,3727
36  C:0001B0  0EA 0ECF0EEF0F0F     dc.w 3759,3791,3823,3855,3888,3920,3953,3985
37  C:0001C0  0FB 0FD30FF41015     dc.w 4018,4051,4084,4117,4150,4183,4217,4250
38  C:0001D0  10B 10DE10FF1121     dc.w 4284,4318,4351,4385,4419,4453,4488,4522
39  C:0001E0  11C 11EF12111234     dc.w 4556,4591,4625,4660,4695,4730,4765,4800
40  C:0001F0  12E 1306132A134D     dc.w 4835,4870,4906,4941,4977,5012,5048,5084
41  C:000200  140 1424144B146C     dc.w 5120,5156,5192,5228,5265,5301,5338,5374
42  C:000210  152 1548156D1592     dc.w 5411,5448,5485,5522,5559,5596,5633,5670
43  C:000220  164 1671169716BD     dc.w 5708,5745,5783,5821,5858,5896,5934,5972
44  C:000230  177 17A017C717ED     dc.w 6010,6048,6087,6125,6163,6202,6241,6279
45  C:000240  18A 18D518FC1923     dc.w 6318,6357,6396,6435,6474,6513,6552,6592
46  C:000250  19E 1A0F1A361A5E     dc.w 6631,6671,6710,6750,6790,6829,6869,6909
47  C:000260  1B2 1B4D1D761B9E     dc.w 6949,6989,7030,7070,7110,7151,7191,7232
48  C:000270  1C6 1C911CBA1CE3     dc.w 7272,7313,7354,7395,7436,7477,7518,7559
49  C:000280  1DD 1DD91E031E2C     dc.w 7600,7641,7683,7724,7766,7807,7849,7890
50  C:000290  1EF 1F261F501F7A     dc.w 7932,7974,8016,8058,8100,8142,8184,8226
51  C:0002A0  204 207720A220CC     dc.w 8269,8311,8354,8396,8439,8481,8524,8567
52  C:0002B0  21A 21CC21F72222     dc.w 8609,8652,8695,8738,8781,8824,8867,8911
53  C:0002C0  22F 2252351237C      dc.w 8954,8997,9041,9084,9128,9171,9215,9259
54  C:0002D0  245 248224AE24DA     dc.w 9302,9346,9390,9434,9478,9522,9566,9610
55  C:0002E0  25B 25E2260F263B     dc.w 9654,9698,9743,9787,9831,9876,9920,9965
```

Readonly Time Tables

Time Function#1

```
56  C:0002F0  271 2746277327A0     dc.w 10010,10054,10099,10144,10188,10233,10278,10323
57  C:000300  28B 28AD28DA2907     dc.w 10368,10413,10458,10503,10548,10594,10639,10684
58  C:000310  29E 2A172A442A72     dc.w 10729,10775,10820,10866,10911,10957,11002,11048
59  C:000320  2B5 2B832BB12BDF     dc.w 11094,11139,11185,11231,11277,11323,11369,11415
60  C:000330  2CC 2CF32D212D4F     dc.w 11461,11507,11553,11599,11645,11691,11737,11784
61  C:000340  2E3 2E642E932EC1     dc.w 11830,11876,11923,11969,12016,12062,12108,12155
62  C:000350  2FA 2FD83007303 5    dc.w 12202,12248,12295,12341,12388,12435,12482,12528
63  C:000360  311 314E317D31AC     dc.w 12575,12622,12669,12716,12763,12810,12857,12904
64  C:000370  329 32C632F53324     dc.w 12951,12998,13045,13092,13139,13186,13234,13281
65  C:000380  341 343F346F349E     dc.w 13328,13375,13423,13470,13517,13565,13612,13659
66  C:000390  358 35BA35EA3619     dc.w 13707,13754,13802,13849,13897,13944,13992,14039
67  C:0003A0  370 373637663796     dc.w 14087,14134,14182,14230,14277,14325,14373,14420
68  C:0003B0  388 38B438E33913     dc.w 14468,14516,14563,14611,14659,14707,14754,14802
69  C:0003C0  3A0 3A323A623A91     dc.w 14850,14898,14946,14993,15041,15089,15137,15185
70  C:0003D0  3B8 3BB13BE13C11     dc.w 15233,15281,15329,15377,15424,15472,15520,15568
71  C:0003E0  3D0 3D303D603D90     dc.w 15616,15664,15712,15760,15808,15856,15904,15952
72  C:0003F0  3E9 3EB03EE03F10     dc.w 16000,16048,16096,16144,16192,16240,16288,16336
73  C:000400  400 403040604090     dc.w 16384,16432,16480,16528,16576,16624,16672,16720
74  C:000410  418 41B041E04210     dc.w 16768,16816,16864,16912,16960,17008,17056,17104
75  C:000420  430 433043604390     dc.w 17152,17200,17248,17296,17344,17391,17439,17487
76  C:000430  447 44AF44DF450F     dc.w 17535,17583,17631,17679,17727,17775,17822,17870
77  C:000440  45F 462E465E468D     dc.w 17918,17966,18014,18061,18109,18157,18205,18252
78  C:000450  477 47AC47DB4B0B     dc.w 18300,18348,18395,18443,18491,18538,18586,18634
79  C:000460  48F 49294958498B     dc.w 18681,18729,18776,18824,18871,18919,18966,19014
80  C:000470  4A7 4AA54AD44B03     dc.w 19061,19109,19156,19203,19251,19298,19345,19393
81  C:0004B0  4BF 4C1F4C4E4C7E     dc.w 19440,19487,19534,19582,19629,19676,19723,19770
82  C:000490  4D6 94D984DC74DF6    dc.w 19817,19864,19911,19958,20005,20052,20099,20146
83  C:0004A0  4EE 4F104F3E4F6D     dc.w 20193,20240,20286,20333,20380,20427,20473,20520
84  C:0004B0  505 508556B450E2     dc.w 20566,20613,20660,20706,20752,20799,20845,20892
85  C:0004C0  51C 51F852275255     dc.w 20938,20984,21031,21077,21123,21169,21215,21261
86  C:0004D0  533 53695395753C5    dc.w 21307,21353,21399,21445,21491,21537,21583,21629
87  C:0004E0  54A 54D855065533     dc.w 21674,21720,21766,21811,21857,21902,21948,21993
88  C:0004F0  561 56445671569E     dc.w 22039,22084,22129,22174,22220,22265,22310,22355
89  C:000500  578 57AD57DA5807     dc.w 22400,22445,22490,22535,22580,22624,22669,22714
90  C:000510  5BE 5C9135940596C    dc.w 22758,22803,22848,22892,22937,22981,23025,23070
91  C:000520  5A4 5A765AA25ACE     dc.w 23114,23158,23202,23246,23290,23334,23378,23422
92  C:000530  5BA 5BD55C015C2D     dc.w 23466,23509,23553,23597,23640,23684,23727,23771
93  C:000540  5D0 5D315D5D5D88     dc.w 23814,23857,23901,23944,23987,24030,24073,24116
94  C:000550  5E5 5E895EB45EDF     dc.w 24159,24201,24244,24287,24329,24372,24414,24457
95  C:000560  5FB 5FDE60086032     dc.w 24499,24542,24584,24626,24668,24710,24752,24794
96  C:000570  610 612E61576181     dc.w 24836,24878,24919,24961,25002,25044,25085,25127
97  C:000580  623 627962A262CB     dc.w 25168,25209,25250,25291,25332,25373,25414,25455
98  C:000590  639 63C063E96411     dc.w 25496,25536,25577,25617,25658,25698,25738,25779
99  C:0005A0  64D 66503652B6533    dc.w 25819,25859,25899,25939,25978,26018,26058,26097
100 C:0005B0  661 6640666866BF     dc.w 26137,26176,26216,26255,26294,26333,26372,26411
101 C:0005C0  675 6779679F67C6     dc.w 26450,26489,26527,26566,26605,26643,26681,26720
102 C:0005D0  688 68AC68D26BF8     dc.w 26758,26796,26834,26872,26910,26947,26985,27023
103 C:0005E0  69B 69DA69FF6A24     dc.w 27060,27098,27135,27172,27209,27246,27283,27320
104 C:0005F0  6AD 6B026B266B4B     dc.w 27357,27394,27430,27467,27503,27540,27576,27612
105 C:000600  6C0 6C246C4B6C6C     dc.w 27648,27684,27720,27756,27791,27827,27862,27898
106 C:000610  6D1 6D406D636D86     dc.w 27933,27968,28003,28038,28073,28108,28143,28177
107 C:000620  6E3 6E566E786E9B     dc.w 28212,28246,28280,28315,28349,28383,28417,28450
108 C:000630  6F4 6F666F876FA9     dc.w 28484,28518,28551,28585,28618,28651,28684,28717
109 C:000640  704 706F708F70B0     dc.w 28750,28783,28815,28848,28880,28913,28945,28977
110 C:000650  715 717171719171B0   dc.w 29009,29041,29073,29104,29136,29168,29199,29230
111 C:000660  724 726C728B72AA     dc.w 29261,29292,29323,29354,29385,29415,29446,29476
112 C:000670  734 7360737E739C     dc.w 29506,29536,29566,29596,29626,29656,29685,29715
113 C:000680  743 744D746A7487     dc.w 29744,29773,29802,29831,29860,29889,29917,29946
114 C:000690  751 7532754F756B     dc.w 29974,30002,30031,30059,30086,30114,30142,30169
115 C:0006A0  75F 57610762B7646    dc.w 30197,30224,30251,30278,30305,30332,30358,30385
116 C:0006B0  76C 76E6770077 1A    dc.w 30411,30438,30464,30490,30516,30541,30567,30593
117 C:0006C0  779 77B377CC77E5     dc.w 30618,30643,30668,30693,30718,30743,30768,30792
118 C:0006D0  786 78797891 78A9    dc.w 30816,30841,30865,30889,30912,30936,30960,30983
119 C:0006E0  791 7935794C7963     dc.w 31006,31029,31052,31075,31098,31121,31143,31165
120 C:0006F0  79D 79EA79FF7A15     dc.w 31188,31210,31231,31253,31275,31296,31318,31339
121 C:000700  7A8 7A957AAA7ABE     dc.w 31360,31381,31402,31422,31443,31463,31483,31504
122 C:000710  7B2 7B377B4B7B5E     dc.w 31523,31543,31563,31582,31602,31621,31640,31659
123 C:000720  7BB 7BD07BE37BF5     dc.w 31678,31696,31715,31733,31751,31769,31787,31805
124 C:000730  7C4 7C607C717C83     dc.w 31823,31840,31857,31875,31892,31908,31925,31942
125 C:000740  7CD 7CE67CF67D06     dc.w 31958,31974,31990,32006,32022,32038,32053,32068
126 C:000750  7D5 7D637D717D80     dc.w 32084,32099,32113,32128,32143,32157,32171,32185
127 C:000760  7DC 7DD57DE37DF0     dc.w 32199,32213,32227,32240,32253,32266,32279,32292
128 C:000770  7E3 7E3D7E4A7E56     dc.w 32305,32317,32330,32342,32354,32366,32377,32389
129 C:000780  7E9 7E9B7EA67EB1     dc.w 32400,32411,32422,32433,32444,32454,32465,32475
```

```
130  C:000790  7EE57EEF7EB7F02
131  C:0007A0  7F2F7F377F407F4B
132  C:0007B0  7F657F757F7C7FB3
133  C:0007C0  7FA27FAB7FAD7FB3
134  C:0007D0  7FC57FCF7FD37FD7
135  C:0007E0  7FE57FEB7FEE7FF0
136  C:0007F0  7FF47FFB7FFD7FFE
```

```
dc.w 32485,32495,32504,32514,32523,32532,32541,32550
dc.w 32559,32567,32576,32584,32592,32600,32607,32615
dc.w 32622,32629,32636,32643,32649,32656,32662,32668
dc.w 32674,32680,32685,32691,32696,32701,32706,32710
dc.w 32715,32719,32723,32727,32731,32735,32738,32741
dc.w 32744,32747,32750,32752,32755,32757,32759,32760
dc.w 32762,32763,32765,32766,32767,32767,32767,32767
```

Readonly Time Tables

Time Function #2

```
138  C:000B00
139  C:000B00  000000200040005F
140  C:000B10  00F0011B013A015B
141  C:000B20  01F0020E022C024A
142  C:000B30  02D002F903160333
143  C:000B40  03C103DD03F90415
144  C:000B50  049804B904D404EF
145  C:000B60  0570058E05A805C1
146  C:000B70  0641065B067406BD
147  C:000B80  0700072007390751
148  C:000B90  07C707DF07F60B0D
149  C:000BA0  0B8408960BAD0BC3
150  C:000BB0  0931094609 5C0971
151  C:000BC0  09D809F00A040A19
152  C:000BD0  0A7C0A920AA60ABA
153  C:000BE0  0B190B2E0B410B54
154  C:000BF0  0BB10BC30BD50BE7
155  C:000900  0C400C510C630C74
156  C:000910  0CC90CD90CEA0CFA
157  C:000920  0D4B0D5B0D6B0D7A
158  C:000930  0DC70DD60DE50DF4
159  C:000940  0E3B0E4B0E590E6B
160  C:000950  0EA80EBA0EC80ED5
161  C:000960  0F1C0F230F300F3C
162  C:000970  0F7B0FB60F920F9E
163  C:000980  0FD80FE30FEF0FFA
164  C:000990  103A103B10451050
165  C:0009A0  10B310BD109610A0
166  C:0009B0  10D210D910E210EB
167  C:0009C0  1117112011281130
168  C:0009D0  1159116111691170
169  C:0009E0  1196119D11A411AB
170  C:0009F0  11C811D411DB11E1
171  C:000A00  120C1206120C1212
172  C:000A10  122E1233123B123D
173  C:000A20  1257125B12601264
174  C:000A30  127A127E12821286
175  C:000A40  1298129D12A012A3
176  C:000A50  12B512B612B912BC
177  C:000A60  12C912CC12CE12D0
178  C:000A70  12DB12DD12DF12E0
179  C:000A80  12E512E912EB12EC
180  C:000A90  12F112F212F2 12F3
181  C:000AA0  12F612F612F612F6
182  C:000AB0  12F612F612F612F6
183  C:000AC0  12F312F212F212F1
184  C:000AD0  12EC12EB12E912E8
185  C:000AE0  12E112DF12DE12DC
186  C:000AF0  12D212D012CE12CC
187  C:000B00  12C012BD12BB12B8
188  C:000B10  12A712A712A412A1
189  C:000B20  1291128E128A1287
190  C:000B30  1275127112 6D1269
191  C:000B40  1255125112 4D1248
192  C:000B50  1232122E12291224
193  C:000B60  1207120712021 1FD
194  C:000B70  11E411DE11D911D4
195  C:000B80  11B511B211AD11A7
196  C:000B90  11B411B411 7E1178
197  C:000BA0  1159115211 4C1146
198  C:000BB0  1125111E1118 1111
199  C:000BC0  10E810E810E110DA
200  C:000BD0  10B710AF10A810A1
201  C:000BE0  1072107410 6D1065
202  C:000BF0  1037102F1028
203  C:000C00  1000FF80FF00FE8
204  C:000C10  0FB80FB70FAE0FA6
205  C:000C20  0F7C0F740F6B0F63
206  C:000C30  0F370F2F0F260F1D
207  C:000C40  0EF80EE80EDF0ED6
208  C:000C50  0EA80EA00E970E8E
209  C:000C60  0E580E560E4D0E43
210  C:000C70  0E140E0B0E010DF8
211  C:000C80  0DC80DBE0DB50DAB
212  C:000C90  0D7 0D710D670D5D
213  C:000CA0  0D2 0D220D180D0E
214  C:000CB0  0CD0CD20CC80CBE
215  C:000CC0  0C8C0C810C770C6C
216  C:000CD0  0C3 0C2F0C250C1A
217  C:000CE0  0BE 0BDD0BD20BC8
218  C:000CF0  0B9 0B890B7F0B74
219  C:000D00  0B4 0B350B2B0B20
220  C:000D10  0AE0AE10AD70ACC
221  C:000D20  0A9 0A8D0A820A77
222  C:000D30  0A4 0A3B0A2D0A22
223  C:000D40  09E809E209D809CD
224  C:000D50  0998098D0982097B
225  C:000D60  0940093B092D0922
226  C:000D70  08E 08E208D808CD
227  C:000D80  0B9 0B8D0B830B7B
228  C:000D90  0B4 0B39082E0B23
229  C:000DA0  07EF07E407DA07CF
230  C:000DB0  0791079007B6077B
231  C:000DC0  0747073D07320728
232  C:000DD0  06F106EA06DF06D5
233  C:000DE0  06A2069806BD06B3
234  C:000DF0  0653 0646063C0632
235  C:000E00  060 05F605EC05E2
236  C:000E10  05B105A7059D0593
237  C:000E20  0562 0538054F0545
238  C:000E30  0515 050B050204F8
239  C:000E40  04C 04C004B604AD
```

```
time_2_tbl: equ *                    * t*(t-1)*(t-1) t=0..1023/1024 by 1/1024
dc.w 0,32,64,95,127,158,190,221
dc.w 252,283,314,344,375,406,436,466
dc.w 496,526,556,586,615,645,674,703
dc.w 732,761,790,819,848,876,905,933
dc.w 961,989,1017,1045,1072,1100,1127,1155
dc.w 1182,1209,1236,1263,1290,1316,1343,1369
dc.w 1395,1422,1448,1473,1499,1525,1551,1576
dc.w 1601,1627,1652,1677,1702,1726,1751,1776
dc.w 1800,1824,1849,1873,1897,1920,1944,1968
dc.w 1991,2015,2038,2061,2084,2107,2130,2153
dc.w 2176,2198,2221,2243,2265,2287,2309,2331
dc.w 2353,2374,2396,2417,2439,2460,2481,2502
dc.w 2523,2544,2564,2585,2606,2626,2646,2666
dc.w 2686,2706,2726,2746,2765,2785,2804,2824
dc.w 2843,2862,2881,2900,2919,2937,2956,2974
dc.w 2993,3011,3029,3047,3065,3083,3101,3118
dc.w 3136,3153,3171,3188,3205,3222,3239,3256
dc.w 3273,3289,3306,3322,3339,3355,3371,3387
dc.w 3403,3419,3435,3450,3466,3481,3497,3512
dc.w 3527,3542,3557,3572,3587,3602,3616,3631
dc.w 3645,3659,3673,3688,3702,3716,3729,3743
dc.w 3757,3770,3784,3797,3810,3823,3837,3849
dc.w 3862,3875,3888,3900,3913,3925,3938,3950
dc.w 3962,3974,3986,3998,4010,4021,4033,4045
dc.w 4056,4067,4079,4090,4101,4112,4123,4133
dc.w 4144,4155,4165,4176,4186,4196,4207,4217
dc.w 4227,4237,4246,4256,4266,4275,4285,4294
dc.w 4304,4313,4322,4331,4340,4349,4358,4366
dc.w 4375,4384,4392,4400,4409,4417,4425,4433
dc.w 4441,4449,4457,4464,4472,4480,4487,4495
dc.w 4502,4509,4516,4523,4530,4537,4544,4551
dc.w 4557,4564,4571,4577,4583,4590,4596,4602
dc.w 4608,4614,4620,4626,4631,4637,4643,4648
dc.w 4654,4659,4664,4669,4674,4679,4684,4689
dc.w 4694,4699,4704,4708,4713,4717,4721,4726
dc.w 4730,4734,4738,4742,4746,4750,4754,4757
dc.w 4761,4765,4768,4771,4775,4778,4781,4784
dc.w 4787,4790,4793,4796,4799,4802,4804,4807
dc.w 4809,4812,4814,4816,4819,4821,4823,4825
dc.w 4827,4829,4831,4832,4834,4836,4837,4839
dc.w 4840,4841,4843,4844,4845,4846,4847,4848
dc.w 4849,4850,4850,4851,4852,4852,4853,4853
dc.w 4854,4854,4854,4854,4854,4855,4855,4854
dc.w 4854,4854,4854,4854,4853,4853,4852,4852
dc.w 4851,4850,4850,4849,4848,4847,4846,4845
dc.w 4844,4843,4841,4840,4839,4837,4836,4834
dc.w 4833,4831,4830,4828,4826,4824,4822,4820
dc.w 4818,4816,4814,4812,4810,4807,4805,4802
dc.w 4800,4797,4795,4792,4790,4787,4784,4781
dc.w 4778,4775,4772,4769,4766,4763,4760,4756
dc.w 4753,4750,4746,4743,4739,4736,4732,4728
dc.w 4725,4721,4717,4713,4709,4705,4701,4697
dc.w 4693,4689,4685,4680,4676,4672,4667,4663
dc.w 4658,4654,4649,4644,4640,4635,4630,4625
dc.w 4620,4615,4610,4605,4600,4595,4590,4585
dc.w 4580,4574,4569,4564,4558,4553,4547,4542
dc.w 4536,4530,4525,4519,4513,4507,4501,4496
dc.w 4490,4484,4478,4472,4465,4459,4453,4447
dc.w 4441,4434,4428,4422,4415,4409,4402,4396
dc.w 4389,4382,4376,4369,4362,4356,4349,4342
dc.w 4335,4328,4321,4314,4307,4300,4293,4286
dc.w 4279,4271,4264,4257,4250,4242,4235,4227
dc.w 4220,4212,4205,4197,4190,4182,4174,4167
dc.w 4159,4151,4143,4136,4128,4120,4112,4104
dc.w 4096,4088,4080,4072,4064,4056,4047,4039
dc.w 4031,4023,4014,4006,3998,3989,3981,3973
dc.w 3964,3956,3947,3939,3930,3921,3913,3904
dc.w 3895,3887,3878,3869,3860,3852,3843,3834
dc.w 3825,3816,3807,3798,3789,3780,3771,3762
dc.w 3753,3744,3735,3726,3716,3707,3698,3689
dc.w 3679,3670,3661,3651,3642,3633,3623,3614
dc.w 3604,3595,3585,3576,3566,3557,3547,3538
dc.w 3528,3518,3509,3499,3489,3480,3470,3460
dc.w 3450,3441,3431,3421,3411,3401,3391,3382
dc.w 3372,3362,3352,3342,3332,3322,3312,3302
dc.w 3292,3282,3272,3262,3252,3241,3231,3221
dc.w 3211,3201,3191,3180,3170,3160,3150,3140
dc.w 3129,3119,3109,3098,3088,3078,3068,3057
dc.w 3047,3037,3026,3016,3005,2995,2985,2974
dc.w 2964,2953,2943,2932,2922,2911,2901,2890
dc.w 2880,2869,2859,2848,2838,2827,2817,2806
dc.w 2796,2785,2775,2764,2753,2743,2732,2722
dc.w 2711,2701,2690,2679,2669,2658,2647,2637
dc.w 2626,2616,2605,2594,2584,2573,2562,2552
dc.w 2541,2530,2520,2509,2498,2488,2477,2466
dc.w 2456,2445,2434,2424,2413,2402,2392,2381
dc.w 2370,2360,2349,2338,2328,2317,2306,2296
dc.w 2285,2274,2264,2253,2243,2232,2221,2211
dc.w 2200,2189,2179,2168,2158,2147,2136,2126
dc.w 2115,2105,2094,2083,2073,2062,2052,2041
dc.w 2031,2020,2010,1999,1989,1978,1968,1957
dc.w 1947,1936,1926,1915,1905,1894,1884,1873
dc.w 1863,1853,1842,1832,1821,1811,1801,1790
dc.w 1780,1770,1759,1749,1739,1729,1718,1708
dc.w 1698,1688,1677,1667,1657,1647,1637,1627
dc.w 1616,1606,1596,1586,1576,1566,1556,1546
dc.w 1536,1526,1516,1506,1496,1486,1476,1466
dc.w 1457,1447,1437,1427,1417,1407,1398,1388
dc.w 1378,1368,1359,1349,1339,1330,1320,1311
dc.w 1301,1291,1282,1272,1263,1253,1244,1234
dc.w 1225,1216,1206,1197,1188,1178,1169,1160
```

```
C:000E50  047E0475046C0463        dc.w 1150,1141,1132,1123,1114,1105,1096,1086
C:000E60  043F042C0423041A        dc.w 1077,1068,1059,1050,1041,1032,1024,1015
C:000E70  03EE03E503DC03D3        dc.w 1006,997,988,979,971,962,953,945
C:000E80  03A903F0397038E         dc.w 936,927,919,910,902,893,885,876
C:000E90  0364035C0353034B        dc.w 868,860,851,843,835,826,818,810
C:000EA0  032_031903110309        dc.w 802,793,785,777,769,761,753,745
C:000EB0  02E102D902D202CA        dc.w 737,729,722,714,706,698,690,683
C:000EC0  02A9029B0294028C        dc.w 675,667,660,652,645,637,630,622
C:000ED0  0267025F02580251        dc.w 615,607,600,593,586,578,571,564
C:000EE0  0221022602 1F021B       dc.w 557,550,543,536,529,522,515,508
C:000EF0  01F501EE01E801E1        dc.w 501,494,488,481,474,468,461,455
C:000F00  01C501BA01B301AD        dc.w 448,442,435,429,422,416,410,403
C:000F10  01B901B701B1017B        dc.w 397,391,385,379,373,367,361,355
C:000F20  01590157015201 4C       dc.w 349,343,338,332,326,320,315,309
C:000F30  013 012A0125011F        dc.w 304,298,293,287,282,277,271,266
C:000F40  010 010000FB00F6        dc.w 261,256,251,246,241,236,231,226
C:000F50  00D000D800D400CF        dc.w 221,216,212,207,202,198,193,189
C:000F60  00B000B400D000AB        dc.w 184,180,176,171,167,163,159,155
C:000F70  009 009300BF00BB        dc.w 151,147,143,139,135,131,127,124
C:000F80  007300740071006D        dc.w 120,116,113,109,106,103,99,96
C:000F90  005000590056005 3       dc.w 93,89,86,83,80,77,74,71
C:000FA0  004 0042003F003D        dc.w 69,66,63,61,58,55,53,50
C:000FB0  003 002E002B0029        dc.w 48,46,43,41,39,37,35,33
C:000FC0  001 001D001B001A        dc.w 31,29,27,26,24,22,21,19
C:000FD0  001 0010000F000D        dc.w 18,16,15,13,12,11,10,9
C:000FE0  000 000700060005        dc.w 8,7,6,5,4,4,3,3
C:000FF0  000 000200010001        dc.w 2,2,1,1,0,0,0,0

                                        end
```

L I N E A R - I N T E R P O L A T O R / EXTENDED PRECISION

```
                                  NTRPL8  IDNT    1,0 CURVE FONT LINEAR INTERPOLLATOR
                                          XDEF    NTRPL8
                                          XREF    PLOT_INSERT
                                          XREF    VEKTOR,GERADE          * TO SHOW BUILDING OF CHAR
                                  INSERT  MACRO           INSERT D1
                                          IFNC    '\1',''
                                          MOVE.W  \1,D1
                                          ENDC
                                          ADD.W   D1,D1
                                          TST.B   COLOR(A5)
                                          BEQ.S   *+4
                                          ADDQ.W  #1,D1
                                          JSR     PLOT_INSERT
                                          ENDM
```

L I N E A R - I N T E R P O L A T O R / EXTENDED PRECISION

```
9:000000                +         SECTION 89                      * CODE SECTION
9:000000  48A 0C00                NTRPL8  MOVEM.W D0/D1/D4/D5,-(SP)
9:000004  3A07                            MOVE.W  D7,D5
9:000006  3806                            MOVE.W  D6,D4
9:000008  4A3 0001                        TST.B   1
9:00000C  6730                            BEQ.S   NTRP1A
9:00000E  48E FFFE                        MOVEM.L D0-D7/A0-A6,-(SP)
9:000012  41F 00000000                    LEA.L   GERADE,A0
9:000018  3E2 0020                        MOVE.W  OLD_RASTER(A5),D7
9:00001C  4447                            NEG.W   D7
9:00001E  DE6 0024                        ADD.W   LN_EM_Y(A5),D7
9:000022  30C7                            MOVE.W  D7,(A0)+
9:000024  3E2 0022                        MOVE.W  OLD_INTERCEPT(A5),D7
9:000028  DE6 0026                        ADD.W   LN_EM_X(A5),D7
9:00002C  30C7                            MOVE.W  D7,(A0)+
9:00002E  3E04                            MOVE.W  D4,D7
9:000030  4447                            NEG.W   D7
9:000032  DE6 0024                        ADD.W   LN_EM_Y(A5),D7
9:000036  30C7                            MOVE.W  D7,(A0)+
9:000038  3E03                            MOVE.W  D5,D7
9:00003A  DE6 0026                        ADD.W   LN_EM_X(A5),D7
9:00003E  3087                            MOVE.W  D7,(A0)
9:000040  4EB 00000000                    JSR     VEKTOR
9:000046  4CD 7FFF                        MOVEM.L (SP)+,D0-D7/A0-A6
9:00004A  302 0020                NTRP1A  MOVE.W  OLD_RASTER(A5),D0
9:00004E  9040                            SUB.W   D0,D4
9:000050  6642                            BNE.S   NTRP_4
9:000052  BA6 0022                        CMP.W   OLD_INTERCEPT(A5),D5
9:000056  6738                            BEQ.S   NTRP_0
9:000058  5EC7                            SGT     D7
9:00005A  BE2 002F                        CMP.B   INIT_COLOR(A5),D7
9:00005E  56C7                            SNE     D7
9:000060  BE2 002E                        CMP.B   COLOR(A5),D7
9:000064  6728                            BEQ.S   NTRP_3
9:000066  1807                            MOVE.B  D7,D4
9:000068  322 0022                        MOVE.W  OLD_INTERCEPT(A5),D1
9:00006C  D241                +           ADD.W   D1,D1
9:00006E  4A2 002E            +           TST.B   COLOR(A5)
9:000072  6702                +           BEQ.S   *+4
9:000074  5241                +           ADDQ.W  #1,D1
9:000076  4EB 00000000        +           JSR     PLOT_INSERT
9:00007C  1B41 002E                       MOVE.B  D4,COLOR(A5)
9:000080  6003                            BRA.S   NTRP_3
9:000082  3E1F                    NTRP_1  MOVE.W  (SP)+,D7
9:000084  4CD 000C                        MOVEM.L (SP)+,D2/D3
9:000088  D047                    NTRP_2  ADD.W   D7,D0
9:00008A  3B4 0020                        MOVE.W  D0,OLD_RASTER(A5)
9:00008E  3B4 0022                NTRP_3  MOVE.W  D5,OLD_INTERCEPT(A5)
9:000092  4C9 0033                NTRP_0  MOVEM.W (SP)+,D0/D1/D4/D5
9:000096  4E75                            RTS
```

L I N E A R - I N T E R P O L A T O R / EXTENDED PRECISION

```
9:00009B  5EC7                    NTRP_4  SGT     D7
9:00009A  BE2 002E                        CMP.B   COLOR(A5),D7
9:00009E  6714                            BEQ.S   NTRP_5
9:0000A0  322 0022            +           MOVE.W  OLD_INTERCEPT(A5),D1
9:0000A4  D241                +           ADD.W   D1,D1
9:0000A6  4A2 002E            +           TST.B   COLOR(A5)
9:0000AA  6702                +           BEQ.S   *+4
9:0000AC  5241                +           ADDQ.W  #1,D1
9:0000AE  4EB 00000000        +           JSR     PLOT_INSERT
9:0000B4  7E01                    NTRP_5  MOVEQ.L #1,D7
9:0000B6  3C04                            MOVE.W  D4,D6
9:0000B8  5DE 002E                        SLT     COLOR(A5)
```

```
  74  9:0000DC  6C04                          BGE.S   NTRP_6
  75  9:0000DE  4446                          NEG.W   D6
  76  9:0000C0  7EFF                          MOVEQ.L #-1,D7
  77  9:0000C2  0C43 0001              NTRP_6 CMP.W   #1,D6
  78  9:0000C6  67C8                          BEQ     NTRP_2
  79  9:0000C8  48E7 3000                     MOVEM.L D2/D3,-(SP)
  80  9:0000CC  3F07                          MOVE.W  D7,-(SP)
  81  9:0000CE  3405                          MOVE.W  D5,D2
  82  9:0000D0  9469 0022                     SUB.W   OLD_INTERCEPT(A5),D2
  83  9:0000D4  48C2                          EXT.L   D2
  84  9:0000D6  3202                          MOVE.W  D2,D1
  85  9:0000D8  6A02                   +      BPL.S   *+4
  85  9:0000DA  4441                   +      NEG.W   D1
  86  9:0000DC  7E04                          MOVEQ.L #4,D7
  87  9:0000DE  7601                          MOVEQ.L #1,D3
  88  9:0000E0  5343                   NTRP_7 SUBQ.W  #1,D3
  89  9:0000E2  6706                          BEQ.S   NTRP_8
  90  9:0000E4  DE47                          ADD.W   D7,D7
  91  9:0000E6  BE41                          CMP.W   D1,D7
  92  9:0000E8  63F6                          BLS     NTRP_7
  93  9:0000EA  0C43 0002              NTRP_8 CMP.W   #2,D6
  94  9:0000EE  671E                          BEQ.S   NTRP_11
  95  9:0000F0  0C43 0004                     CMP.W   #4,D6
  96  9:0000F4  6718                          BEQ.S   NTRP_11
  97  9:0000F6  7E02                          MOVEQ.L #2,D7
  98  9:0000F8  5243                   NTRP_9 ADDQ.W  #1,D3
  99  9:0000FA  0C43 000F                     CMP.W   #15,D3
 100  9:0000FE  6C06                          BGE.S   NTRP_10
 101  9:000100  DE47                          ADD.W   D7,D7
 102  9:000102  BE46                          CMP.W   D6,D7
 103  9:000104  63F2                          BLS     NTRP_9
 104  9:000106  E7A2                   NTRP_10 ASL.L  D3,D2
 105  9:000108  85C7                          DIVS    D6,D2
 106  9:00010A  48C2                          EXT.L   D2
 107  9:00010C  6006                          BRA.S   NTRP_12

L I N E A R - I N T E R P O L A T O R / EXTENDED PRECISION
 109  9:00010E  E7A2                   NTRP_11 ASL.L  D3,D2
 110  9:000110  E246                          ASR.W   #1,D6
 111  9:000112  D646                          ADD.W   D6,D3
 112  9:000114  3C2D 0022              NTRP_12 MOVE.W  OLD_INTERCEPT(A5),D6
 113  9:000118  48C6                          EXT.L   D6
 114  9:00011A  E7A6                          ASL.L   D3,D6
 115  9:00011C  9857                   NTRP_13 SUB.W  (SP),D4
 116  9:00011E  6700FF62                       BEQ     NTRP_1
 117  9:000122  D057                          ADD.W   (SP),D0
 118  9:000124  DCB2                          ADD.L   D2,D6
 119  9:000126  2E06                          MOVE.L  D6,D7
 120  9:000128  E6A7                          ASR.L   D3,D7
 121  9:00012A  3207                   +      MOVE.W  D7,D1
 121  9:00012C  D241                   +      ADD.W   D1,D1
 121  9:00012E  4A2D 002E              +      TST.B   COLOR(A5)
 121  9:000132  6702                   +      BEQ.S   *+4
 121  9:000134  5241                   +      ADDQ.W  #1,D1
 121  9:000136  4EB9 00000000          +      JSR     PLOT_INSERT
 122  9:00013C  60DE                          BRA     NTRP_13
 123
 124                                          END

PLOTQUEUE INSERT, OUTPUT, CLEAR, & CHECK
   2                                  PLOTQ   IDNT    1,0 CURVE FONT RASTER SORTING SYSTEM
   6                                          INCLUDE RCHPAR
   1                                  *   STRUKTUR DES PASCAL-PARAMETERBLOCKS
   2                                  *   ----------------------------------
   3                                  *
   4  00000000                                OFFSET  0
   5  00000000                        RCHPAR  EQU     *
   6  00000000                        CHARJOB DS.W    1          AUFTRAGSART: 0=SYSTEM-INIT,1=JOB-INIT
   7                                  *                                       2=ZEICHEN-INIT
   8  00000002                        JOBPARBL EQU    *                JOB-PARAMETER
   9  00000002                        AUFLX   DS.W    1
  10  00000004                        AUFLY   DS.W    1
  11  00000006                        ZOOMP   DS.W    1
  12                                  *
  13  0000000B                        ZEITAB  EQU     *                ZEICHEN-PARAMETER
  14  0000000B                        C2      DS.W    1
  15  0000000A                        FONADR  DS.L    1
  16  0000000E                        MCBADR  DS.L    1                POINTER AUF MCB
  17  00000012                        ERRORNR DS.W    1                SYSTEM-ERRORNUMMER
  18                                  *
  19                                  *
  20                                  *
  21                                  *  DATENTYPEN FUER MEMO-CONTROL-BLOCK
  22                                  *  ----------------------------------
  23  00000000                                OFFSET  0
  24                                  *
  25  00000000                        MCKENN  EQU     *
  26  00000000                        V90C    DS.B    1
  27  00000001                        EQUCHK  DS.B    1        FUER SCAN
  28  00000002                        CFKENN  DS.W    1        FONTLOC/FORM-KENNUNG
  29  00000004                        FONTNR  DS.W    1        FONTNR/LAUFENDE FORM-NR
  30  00000006                        SG      DS.W    1        SCHRIFTGRAD
  31  0000000B                        CE      DS.W    1        CONDENSED-EXPAND
  32                                  * HIER MUESSEN DANN SLANT_WIN,ROT_WIN REIN
  33                                  *
  34  0000000A                        OPCL    DS.W    1
  35  0000000C                        CHAR_OFF DS.W   1        ABSTAND IN MI'S REL-YNULL->ZEICHENOBERKANTE
  36  0000000E                        BASE_OFF DS.W   1          "      "     ZEICHENOBERKANTE->SCHRIFTLINIE
  37  00000010                        SCANCT  DS.L    1          "      "      "                -> -UNTERKANTE
  38  00000014                        IPADR   DS.L    1        POINTER AUF MEMEO-SEGMENT
  39  0000001B                        SEG_LAEN DS.W   1        MEMOSEGMENT-LAENGE IN WORTEN
  40  0000001A                        MEM_LAEN DS.L   1
  41
  42                                  *       ERROR NUMBERS
  43  0000001E                        BUFOVER SET     30
  44  00000011                        FONTERR SET     17
  45  0000004B                        PARERR  SET     75
  46
```

```
PLOTQUEUE INSERT, OUTPUT, CLEAR, & CHECK
 9                                  +
10  00008000                           END_RASTER      EQU     $8000
11  00000000                           MEMO_II SET     FALSE
13  0000DFFF                           BLANK_RASTER    EQU     $DFFF
14  0000DFFE                           END_MEMO        EQU     $DFFE
19
20  00000000                       +   PQ$V_LINE:        SET   0                LINE NUMBER OF SEGMENT
20  00000008                       +   PQ$S_LINE:        SET   8
20  000000FF                       +   PQ$M_LINE:        SET (1<<8-1)<<0
21  00000008                       +   PQ$V_SGMNT:       SET   PQ$S_LINE                SEGMENT NUMBER FROM RASTER
21  00000008                       +   PQ$S_SGMNT:       SET   (16-PQ$S_LINE)
21  0000FF00                       +   PQ$M_SGMNT:       SET (1<<(16-PQ$S_LINE)-1)<<PQ$S_LINE
22
23  00000000                       +   PQL$V_ENTRIES:    SET   0                * MASK  FOR NUMBER OF LINE ENTRIES
23  00000003                       +   PQL$S_ENTRIES:    SET   3
23  00000007                       +   PQL$M_ENTRIES:    SET (1<<3-1)<<0
24  00000006                           PQL$K_ENTRIES   SET     6
25  7:000000                       +          SECTION $7            * DATA SECTION
26  00000100                           PQQ$K_ENTRIES   SET     1<<PQ$S_SGMNT
27  7:000000  000.000000000000         PQQ$L_SEGMENT   DCB.L   PQQ$K_ENTRIES,0
28  7:000400                           PDON_SP         DS.L    1
29  7:000404                           MEMO_LENGTH     DS.L    1
30
31  00000000                                  OFFSET  0
32  00000100                           PQS$K_ENTRIES   SET     1<<PQ$S_LINE
33  00000000  0000000000000000         PQS$B_COUNT     DCB.B   PQS$K_ENTRIES,0
34  00000100  0000000000000000         PQS$L_LINE      DCB.L   PQS$K_ENTRIES,0
35  00000500                           PQS$K_LENGTH    SET     *
36
37  00000000                                  OFFSET  0
38  00000000  0000.0001                PQL$L_PTR       DC.L    1
39  00000004  0000000000000000         PQL$W_VALUES    DCB.W   PQL$K_ENTRIES,0
40  00000010                           PQL$K_LENGTH    SET     *
```

D E F I N I T I O N S

```
42                                  +
43                                     *       MACROS TO HANDLE SEGMENT TABLES
44                                     *
45                                     THIS_SEGMENT    MACRO
46                                             MOVE.W  D0,D7
47                                             LSR.W   #PQ$V_SGMNT,D7
48                                             INDEX.W LONG,D7
49                                             LEA.L   PQQ$L_SEGMENT,A0
50                                             LEA.L   0(A0,D7.W),A2
51                                             MOVE.L  (A2),D7
52                                             ENDM
53
54                                     THIS_LINE       MACRO           THIS_LINE REG_STORE
55                                             MOVE.W  D0,D7
56                                             ANDI.W  #PQ$M_LINE,D7
57                                             INDEX.W LONG,D7
58                                             IFEQ    PQS$L_LINE&$FFFFFF80
59                                             LEA.L   PQS$L_LINE(A2,D7.W),A0
60                                             MOVE.L  (A0),\1
61                                             MEXIT
62                                             ENDC
63                                             LEA.L   PQS$L_LINE(A2),A0
64                                             LEA.L   0(A0,D7.W),A0
65                                             MOVE.L  (A0),\1
66                                             ENDM
```

M A C R O S

```
68                                     THIS_COUNT      MACRO           THIS_COUNT REGISTER(OPTIONAL)
69                                             MOVE.W  D0,D7
70                                             ANDI.W  #PQ$M_LINE,D7
71                                             INDEX.W BYTE,D7
72                                               IFEQ  PQS$B_COUNT&$FFFFFF80
73                                             LEA.L   PQS$B_COUNT(A2,D7.W),A0
74                                               ENDC
75                                               IFNE  PQS$B_COUNT&$FFFFFF80
76                                             LEA.L   PQS$B_COUNT(A2),A0
77                                             LEA.L   0(A0,D7.W),A0
78                                               ENDC
79                                               IFNC  '\1',''
80                                             MOVE.B  (A0),\1
81                                               ENDC
82                                             ENDM
83
84                                     INTO_MEMO       MACRO           INTO_MEMO VALUE
85                                             ADDQ.L  #1,D5
86                                             SUBQ.L  #SHORT,D6
87                                             IFC     '\0','S'
88                                             BGE.S   *+4
89                                             ENDC
90                                             IFNC    '\0','S'
91                                             BGE.S   *+6
92                                             ENDC
93                                             BSR.\0  MORE_MEMO
94                                             MOVE.W  \1,(A4)+
95                                             ENDM
```

M A C R O S

```
97                                             INCLUDE STORMAC
 1                                     *       M A C R O   F O R   M E M O R Y   A L L O C A T I O N
 2                                     *
 3  00000001                           ONLY1AREA: SET TRUE                    * IF ONLY 1 AREA
 4
 5                                             XREF    AALLOC
 6                                             XREF    AFREE
 7
 8                                     GETMAIN: MACRO                  GETMAIN.QUAL SIZE,<COMMENT>
 9                                             MAINSIZE.\0 \1,<** \2>
10                                             JSR     AALLOC                 * *GET A BLOCK FROM THE POOL
11                                             ENDM
12
13                                     FREEMAIN: MACRO                 FREEMAIN.QUAL SIZE,PTR,<COMMENT>
14                                             IFC     '\2','A0'
15                                     * ADDRESS TO FREE IN LONGWORD A0
16                                             ENDC
17                                             IFNC    '\2','A0'
```

```
 18                                          IFC    '\2','D7'
 19                                        MOVE.L   D7,A0                    ** \3
 20                                          ENDC
 21                                          IFNC   '\2','D7'
 22                                        LEA.L    (\2),A0                  ** \3
 23                                          ENDC
 24                                        ENDC
 25                                        MAINSIZE.\0 \1,(* *)
 26                                        JSR      AFREE                    ** RETURN BLOCK TO POOL
 27                                        ENDM
 28
 29                                 *        .L= LONG REFERENCE       .W= SHORT REFERENCE
 30                                 *        .S= SHORT VALUE IN D7    .= BY VALUE
 31                                 MAINSIZE:        MACRO                    MAINSIZE.QUAL SIZE,<COMMENT>
 32                                        IFC      '\0','S'
 33                                        EXT.L    D7                \2
 34                                        MEXIT
 35                                        ENDC
 36                                        IFC      '\1',''
 37                                 * MEMORY REQUEST LENGTH GIVEN IN LONGWORD D7
 38                                        MEXIT
 39                                        ENDC
 40                                        IFC      '\0',''
 41                                        MOVE.L   #\1,D7   \2
 42                                        MEXIT
 43                                        ENDC
 44                                        IFC      ' ' 'L'
 45                                        MOVE.L                     \2
 46                                        MEXIT
 47                                        ENDC
 48                                        MOVEQ.L #0,D7
 49                                        MOVE.W   \1,D7             \2
 50                                        ENDM
```

PLOT CHECK

```
 99                                 *        P L O T _ C H E C K
100                                 *
101                                          XDEF     PLOT_CHECK
102  9:000000                    +           SECTION  $9                * CODE SECTION
103  9:000000                                PLOT_CHECK EQU  *
104  9:000000  4852                           PEA      (A2)
105  9:000002  3E00              +            MOVE.W   D0,D7
105  9:000004  E04F              +            LSR.W    #PQS$V_SGMNT,D7
105  9:000006  E54F              +            LSL.W    #2,D7
105  9:000008  41F900000000      +            LEA.L    PQQ$L_SEGMENT,A0
105  9:00000E  45F07000          +            LEA.L    0(A0,D7.W),A2
105  9:000012  2E12              +            MOVE.L   (A2),D7
106  9:000014  6714                           BEQ.S    PCHK_1
107  9:000016  2447                           MOVE.L   D7,A2
108  9:000018  3E00              +            MOVE.W   D0,D7
108  9:00001A  024700FF          +            ANDI.W   #PQS$M_LINE,D7
108                              +       * D7 ALREADY INDEX TO CHAR
108  9:00001E  41F27000          +            LEA.L    PQS$B_COUNT(A2,D7.W),A0
109  9:000022  08100000                       BTST     #0,(A0)
110  9:000026  6702                           BEQ.S    PCHK_1
111  9:000028  6104                           BSR.S    PLOT_INSERT
112  9:00002A  245F                  PCHK_1   MOVE.L   (SP)+,A2
113  9:00002C  4E75                           RTS
```

PLOT INSERT

```
115                                 *        P L O T _ I N S E R T
116                                 *
117                                          XDEF     PLOT_INSERT
118  9:00002E                    +           SECTION  $9                * CODE SECTION
119  9:00002E                                PLOT_INSERT EQU *
120  9:00002E  48E70030                       MOVEM.L A3/A2,-(SP)
121  9:000032  48A73000                       MOVEM.W D2/D3,-(SP)
122  9:000036  41E801A                        LEA.L    MIN_INTERCEPT(A5),A0
123  9:00003A  B250                           CMP.W    (A0),D1
124  9:00003C  6C02                           BGE.S    PINS_1
125  9:00003E  3081                           MOVE.W   D1,(A0)
126  9:000040                        PINS_1   EQU      *
127  9:000040  5881              +            ADDQ.L   #MAX_INTERCEPT-MIN_INTERCEPT,A0
128  9:000042  B250                           CMP.W    (A0),D1
129  9:000044  6F02                           BLE.S    PINS_2
130  9:000046  3081                           MOVE.W   D1,(A0)
131  9:000048                        PINS_2   EQU      *
132  9:000048  5D88              +            SUBQ.L   #-(MIN_RASTER-MAX_INTERCEPT),A0
133  9:00004A  B050                           CMP.W    (A0),D0
134  9:00004C  6C02                           BGE.S    PINS_3
135  9:00004E  3080                           MOVE.W   D0,(A0)
136  9:000050                        PINS_3   EQU      *
137  9:000050  5888              +            ADDQ.L   #MAX_RASTER-MIN_RASTER,A0
138  9:000052  B050                           CMP.W    (A0),D0
139  9:000054  6F02                           BLE.S    PINS_4
140  9:000056  3080                           MOVE.W   D0,(A0)
141  9:000058                        PINS_4   EQU      *
142  9:000058  3E00              +            MOVE.W   D0,D7
142  9:00005A  E04F              +            LSR.W    #PQS$V_SGMNT,D7
142  9:00005C  E54F              +            LSL.W    #2,D7
142  9:00005E  41F900000000      +            LEA.L    PQQ$L_SEGMENT,A0
142  9:000064  45F07000          +            LEA.L    0(A0,D7.W),A2
142  9:000068  2E12              +            MOVE.L   (A2),D7
143  9:00006A  6612                           BNE.S    PINS_6
144  9:00006C  2F3C00000500      +            MOVE.L   #PQS$K_LENGTH,D7          **
144  9:000072  4EB800000000      +            JSR      AALLOC                    * *GET A BLOCK FROM THE POOL
145  9:000078  2487                           MOVE.L   D7,(A2)
146  9:00007A  2047                           MOVE.L   D7,A0
147  9:00007C  343C0500                       MOVE.W   #PQS$K_LENGTH,D2
148  9:000080  4298                           CLR.L    (A0)+
149  9:000082  5942                           SUBQ.W   #LONG,D2
150  9:000084  66FA                           BNE      *-4
```

PLOT INSERT

```
152  9:000086  2447                  PINS_6   MOVE.L   D7,A2
153  9:000088  3E00              +            MOVE.W   D0,D7
153  9:00008A  024700FF          +            ANDI.W   #PQS$M_LINE,D7
153                              +       * D7 ALREADY INDEX TO CHAR
153  9:00008E  41F27000          +            LEA.L    PQS$B_COUNT(A2,D7.W),A0
153  9:000092  1410              +            MOVE.B   (A0),D2
154  9:000094  4850                           PEA      (A0)
```

```
155  9:000096  3E00          +        MOVE.W  D0,D7
155  9:000098  024700FF      +        ANDI.W  #PQ$M_LINE,D7
155  9:00009C  E54F          +        LSL.W   #2,D7
155  9:00009E  41EA0100      +        LEA.L   PQS$L_LINE(A2),A0
155  9:0000A2  41F07000      +        LEA.L   0(A0,D7.W),A0
155  9:0000A6  2650          +        MOVE.L  (A0),A3
156  9:0000AB  3602                   MOVE.W  D2,D3
157  9:0000AA  02430007               ANDI.W  #PQL$M_ENTRIES,D3
158  9:0000AE  670E                   BEQ.S   PINS_7
159  9:0000B0  D643          +        ADD.W   D3,D3
160  9:0000B2  41F53004               LEA.L   PQL$W_VALUES(A3,D3.W),A0
161  9:0000B6  0B00 0001              BTST    #1,D3
162  9:0000BA  6712                   BEQ.S   PINS_8
163  9:0000BC  6020                   BRA.S   PINS_9
164
165  9:0000BE  2443                   PINS_7  MOVE.L  A0,A2
166  9:0000C0  7E10          +        MOVE.L  #PQL$K_LENGTH,D7        ** ALLOCATE NEW LINE
166  9:0000C2  4EB900000000  +        JSR     AALLOC                  * *GET A BLOCK FROM THE POOL
167  9:0000C8  CF8B                   EXG     D7,A3
169  9:0000CA  2687                   MOVE.L  D7,(A3)
174  9:0000CC  248B                   MOVE.L  A3,(A2)
175  9:0000CE  3430000E               MOVE.W  #1<<PQL$S_ENTRIES+PQL$K_ENTRIES,D2
176  9:0000D2  41EB0010               LEA.L   PQL$K_ENTRIES*SHORT+PQL$W_VALUES(A3),A0
177  9:0000D6  3E01                   PINS_8  MOVE.W  D1,D7
178  9:0000D8  5247                   ADDQ.W  #1,D7
179  9:0000DA  3147FFFC               MOVE.W  D7,-2*SHORT(A0)
180  9:0000DE  3101                   PINS_9  MOVE.W  D1,-(A0)
181  9:0000E0  205F                   MOVE.L  (SP)+,A0
182  9:0000E2  5302                   SUBQ.B  #1,D2
183  9:0000E4  1082                   MOVE.B  D2,(A0)
184  9:0000E6  4C9F000C               MOVEM.W (SP)+,D2/D3
185  9:0000EA  4CDF0C00               MOVEM.L (SP)+,A3/A2
186  9:0000EE  4E75                   RTS

P L O T   D O N E
188                                   *       P L O T _ D O N E
189                                   *
190                                           XDEF    PLOT_DONE
191                                           XREF    MEWA,M_NEXT,M_KILL,PCHPAR,PASCAL_REGISTERS
192  9:0000F0                +                SECTION $9              * CODE SECTION
193  9:0000F0                              PLOT_DONE EQU   *
194  9:0000F0  48E7067A                    MOVEM.L D5/D6/A6/A2/A3/A4/A1,-(SP)
195  9:0000F4  48A7FB00                    MOVEM.W D2/D3/D1/D0/D4,-(SP)
196  9:0000FB  23CF00000400                MOVE.L  SP,PDON_SP
197  9:0000FE  4A2A002D                    TST.B   LOOP_NOT_CLOSED(A5)
198  9:000102  6600 01FA                   BNE     PDON_30
199  9:000106  4285                        CLR.L   D5
200  9:00010B  9DCE                        SUB.L   A6,A6
201  9:00010A  2879 00000000               MOVE.L  PCHPAR,A4
202  9:000110  286C 000E                   MOVE.L  MCBADR(A4),A4
203  9:000114  4286                        CLR.L   D6
204  9:000116  3C2C0018                    MOVE.W  SEG_LAEN(A4),D6
205  9:00011A  5386                        SUBQ.L  #1,D6
206  9:00011C  DC86          +             ADD.L   D6,D6
207  9:00011E  23C6 00000404               MOVE.L  D6,MEMO_LENGTH
208  9:000124  286C0014                    MOVE.L  IPADR(A4),A4
209  9:00012B  302D001C                    MOVE.W  MAX_RASTER(A5),D0
210  9:00012C  3800                        MOVE.W  D0,D4
211  9:00012E  5240                        ADDQ.W  #1,D0
212  9:000130  5340                        PDON_1  SUBQ.W  #1,D0
213  9:000132  B06D0018                    CMP.W   MIN_RASTER(A5),D0
214  9:000136  6D1A                        BLT.S   PDON_2
215  9:00013B  3E00          +             MOVE.W  D0,D7
215  9:00013A  E04F          +             LSR.W   #PQ$V_SGMNT,D7
215  9:00013C  E54F          +             LSL.W   #2,D7
215  9:00013E  41F30000000   +             LEA.L   PQQ$L_SEGMENT,A0
215  9:000144  45F07000      +             LEA.L   0(A0,D7.W),A2
215  9:00014B  2E12          +             MOVE.L  (A2),D7
216  9:00014A  6660                        BNE.S   PDON_5
217  9:00014C  0240FF00                    ANDI.W  #PQ$M_SGMNT,D0
218  9:000150  60DE                        BRA     PDON_1

P L O T   D O N E
220                                   ***STO-A
221                                   ***PDON_2  MOVE.W  D4,MIN_RASTER(A5)
222  9:000152                         PDON_2  EQU     *
223                                   ***STO-E
225  9:000152  5486                        ADDQ.L  #SHORT,D6
226  9:000154  5285          +             ADDQ.L  #1,D5
226  9:000156  5586          +             SUBQ.L  #SHORT,D6
226  9:000158  6C04          +             BGE.S   *+6
226  9:00015A  6100 016B     +             BSR.L   MORE_MEMO
226  9:00015E  38FC DFFE     +             MOVE.W  #END_MEMO,(A4)+
232  9:000162  6100 01E4                   BSR     RELEASE_QUEUE
233                                   ***STO-A
234  9:000166  3B40 0018                   MOVE.W  D4,MIN_RASTER(A5)
235                                   ***STO-E
236  9:00016A  E0E0 001A                   ASR.W   MIN_INTERCEPT(A5)
237  9:00016E  6404                        BCC.S   PDON_3
238  9:000170  536A 001E                   SUBQ.W  #1,MAX_INTERCEPT(A5)
239  9:000174  E0E8 001E                   PDON_3  ASR.W   MAX_INTERCEPT(A5)
240  9:000178  2079 00000000               MOVE.L  PCHPAR,A0
241  9:00017E  206B 000E                   MOVE.L  MCBADR(A0),A0
242  9:000182  2143 001A                   MOVE.L  D5,MEM_LAEN(A0)
243  9:000186  3E2D0024                    MOVE.W  LN_EM_Y(A5),D7
244  9:00018A  9E6D001C                    SUB.W   MAX_RASTER(A5),D7
245  9:00018E  3147000C                    MOVE.W  D7,CHAR_OFF(A0)
246  9:000192  3E2D001C                    MOVE.W  MAX_RASTER(A5),D7
247  9:000196  3147000E                    MOVE.W  D7,BASE_OFF(A0)
248  9:00019A  3C2D0018                    MOVE.W  MIN_RASTER(A5),D6
249  9:00019E  48C7                        EXT.L   D7
250  9:0001A0  48C6                        EXT.L   D6
251  9:0001A2  9E86                        SUB.L   D6,D7
252  9:0001A4  2147 0010                   MOVE.L  D7,SCANCT(A0)
253  9:0001A8  2E7900000400                PDON_4  MOVE.L  PDON_SP,SP
254  9:0001AE  4C9F001F                    MOVEM.W (SP)+,D2/D3/D1/D0/D4
255  9:0001B2  4CDF3E60                    MOVEM.L (SP)+,D5/D6/A6/A2/A3/A4/A1
256  9:0001B6  4E75                        RTS
```

Copyright (c) 1983 Allied Corporation All Rights Reserved
Module -V-

```
P L O T   D O N E
  258  9:0001B8  2447                    PDON_5  MOVE.L  D7,A2
  259  9:0001BA  3E00              +             MOVE.W  D0,D7
  259  9:0001BC  024000FF            +             ANDI.W  #PQ$M_LINE,D7
  259                               +     * D7 ALREADY INDEX TO CHAR
  259  9:0001C0  41F07000            +             LEA.L   PQS$B_COUNT(A2,D7.W),A0
  259  9:0001C4  1410                +             MOVE.B  (A0),D2
  260  9:0001C6  6700FF68                          BEQ     PDON_1
  261  9:0001CA  3E00              +             MOVE.W  D0,D7
  261  9:0001CC  024700FF            +             ANDI.W  #PQ$M_LINE,D7
  261  9:0001D0  E54F                +             LSL.W   #2,D7
  261  9:0001D2  41E80100            +             LEA.L   PQS$L_LINE(A2),A0
  261  9:0001D6  41F07000            +             LEA.L   0(A0,D7.W),A0
  261  9:0001DA  2650                +             MOVE.L  (A0),A3
  262                                         ***STO-A
  263  9:0001DC  4290                            CLR.L   (A0)
  264                                         ***STO-E
  265  9:0001DE  4243                            CLR.W   D3
  266  9:0001E0  02420006                       ANDI.W  #PQL$M_ENTRIES&-2,D2
  267  9:0001E4  D442                +             ADD.W   D2,D2
  268  9:0001E6  45F02004                        LEA.L   PQL$W_VALUES(A3,D2.W),A2
  269  9:0001EA  04420000C                       SUBI.W  #PQL$K_ENTRIES*SHORT,D2
  270  9:0001EE  9642                            SUB.W   D2,D3
  271  9:0001F0  2F1A                            MOVE.L  (A2)+,-(SP)
  272  9:0001F2  5842                            ADDQ.W  #LONG,D2
  273  9:0001F4  66FA                            BNE.S   *-4
  274  9:0001F6                           PDON_6  EQU     *
  276  9:0001F6  2453                            MOVE.L  (A3),A2
  281  9:0001F8  41D3                +             LEA.L   (A3),A0                 **
  281  9:0001FA  7E10                +             MOVE.L  #PQL$K_LENGTH,D7        * *
  281  9:0001FC  4EB900000000        +             JSR     AFREE                   ** RETURN BLOCK TO POOL
  282  9:000202  2E03                            MOVE.L  A2,D7
  283  9:000204  6712                            BEQ.S   PDON_7
  284  9:000206  2647                            MOVE.L  D7,A3
  285  9:000208  45E80004                        LEA.L   PQL$W_VALUES(A3),A2
  286  9:00020C  0643000C                        ADDI.W  #PQL$K_ENTRIES*SHORT,D3
  294  9:000210  2F1A                            MOVE.L  (A2)+,-(SP)
  295  9:000212  2F1A                            MOVE.L  (A2)+,-(SP)
  298  9:000214  2F1A                            MOVE.L  (A2)+,-(SP)
  300  9:000216  60DE                            BRA     PDON_6
  301  9:000218  224F                   PDON_7  MOVE.L  SP,A1
  302  9:00021A  3E03                            MOVE.W  D3,D7
  303  9:00021C  5547                            SUBQ.W  #SHORT,D7
  304  9:00021E  3F07                            MOVE.W  D7,-(SP)
  305  9:000220  4267                            CLR.W   -(SP)
  306  9:000222  6100FFBE                       BSR     QUICK_SORT
  307  9:000226  588F                +             ADDQ.L  #2*SHORT,SP
  308  9:00022B  3227901A                        MOVE.W  MIN_INTERCEPT(A5),D1
  310  9:00022C  02410001                       AND.W   #1,D1
  312  9:000230                           PDON_8  EQU     *
  313  9:000230  3E1F                            MOVE.W  (SP)+,D7
  314  9:000232  9E41                            SUB.W   D1,D7
  315  9:000234  E247                            ASR.W   #1,D7
  316  9:000236  6404                            BCC.S   PDON_9

P L O T   D O N E
  317  9:000238  5342                            SUBQ.W  #1,D2
  318  9:00023A  6004                            BRA.S   PDON_11

P L O T   D O N E
  320  9:00023C  4A42                   PDON_9  TST.W   D2
  321  9:00023E  6602                            BNE.S   PDON_10
  322  9:000240  3447                            MOVE.W  D7,A2
  323  9:000242  5242                   PDON_10 ADDQ.W  #1,D2
  324  9:000244                          PDON_11 EQU     *
  325  9:000244  3E1F                            MOVE.W  (SP)+,D7
  326  9:000246  9E41                            SUB.W   D1,D7
  327  9:000248  E247                            ASR.W   #1,D7
  328  9:00024A  6504                            BCS.S   PDON_12
  329  9:00024C  5242                            ADDQ.W  #1,D2
  330  9:00024E  6031                            BRA.S   PDON_15
  331  9:000250  5342                   PDON_12 SUBQ.W  #1,D2
  332  9:000252  6636                            BNE.S   PDON_15
  333  9:000254  BE41                            CMP.W   A2,D7
  334  9:000256  6F32                            BLE.S   PDON_15
  335  9:000258  3407                            MOVE.W  D7,D2
  336  9:00025A  B041                            CMP.W   D4,D0
  337  9:00025C  6714                            BEQ.S   PDON_14
  349  9:00025E  5344                   PDON_13 SUBQ.W  #1,D4
  350  9:000260  B041                            CMP.W   D4,D0
  351  9:000262  670E                            BEQ.S   PDON_14
  352  9:000264  5285                +             ADDQ.L  #1,D5
  352  9:000266  5586                +             SUBQ.L  #SHORT,D6
  352  9:000268  6C02                +             BGE.S   *+4
  352  9:00026A  6150                +             BSR.S   MORE_MEMO
  352  9:00026C  38FCDFFF            +             MOVE.W  #BLANK_RASTER,(A4)+
  353  9:000270  60E0                            BRA     PDON_13

P L O T   D O N E
  356  9:000272                          PDON_14 EQU     *
  357  9:000272  5285                +             ADDQ.L  #1,D5
  357  9:000274  5586                +             SUBQ.L  #SHORT,D6
  357  9:000276  6C02                +             BGE.S   *+4
  357  9:00027B  6143                +             BSR.S   MORE_MEMO
  357  9:00027A  38CA                +             MOVE.W  A2,(A4)+
  358  9:00027C  5285                +             ADDQ.L  #1,D5
  358  9:00027E  5586                +             SUBQ.L  #SHORT,D6
  358  9:000280  6C02                +             BGE.S   *+4
  358  9:000282  6143                +             BSR.S   MORE_MEMO
  358  9:000284  38C2                +             MOVE.W  D2,(A4)+
  359  9:000286  2C43                            MOVE.L  A4,A6
  360  9:000288  4242                            CLR.W   D2
  361  9:00028A  5945                   PDON_15 SUBQ.W  #2*SHORT,D3
  362  9:00028C  66A2                            BNE     PDON_8
  363  9:00028E  2E0E                            MOVE.L  A6,D7
  364  9:000290  6724                            BEQ.S   PDON_18
  365  9:000292  41EBFFFE                       LEA     -SHORT(A6),A0
```

```
367  9:000296  3E3C:E000                    MOVE.W  #$E000,D7
368  9:00029A  C059                         AND.W   (A0),D7
369  9:00029C  0C47C000                     CMPI.W  #END_MEMO8$E000,D7
370  9:0002A0  6706                         BEQ.S   PDON_16
371  9:0002A2  6298                         BHI.S   PDON_17
373  9:0002A4  0057 8000                    ORI.W   #END_RASTER,(A0)
374  9:0002A8  6600FED6            PDON_16  BRA     PDON_1
376  9:0002AC                      PDON_17  EQU     *
377  9:0002AC  5285                +        ADDQ.L  #1,D5
377  9:0002AE  5586                +        SUBQ.L  #SHORT,D6
377  9:0002B0  6C02                +        BGE.S   *+4
377  9:0002B2  6119                +        BSR.S   MORE_MEMO
377  9:0002B4  38F0DFFF            +        MOVE.W  #BLANK_RASTER,(A4)+
378  9:0002B8  2C40                         MOVE.L  A4,A6
379  9:0002BA  60EC                         BRA     PDON_16
381  9:0002BC  5344                PDON_18  SUBQ.W  #1,D4
382  9:0002BE  3B4D001C                     MOVE.W  D4,MAX_RASTER(A5)
383  9:0002C2  60E4                         BRA     PDON_16

M O    R E   M E M O                 *        M O R E _ M E M O
385                                  *
386
387
388  9:0002C4  38F0DFFE            MORE_MEMO MOVE.W  #END_MEMO,(A4)+
389  9:0002C8  2C40                         MOVE.L  A4,A6
390  9:0002CA  5285                         ADDQ.L  #1,D5
391  9:0002CC  48E7FFF6                     MOVEM.L D0-D7/A0-A3/A5-A6,-(SP)
392  9:0002D0  598F                         SUBQ.L  #LONG,SP
393  9:0002D2  4857                         PEA     (SP)
394  9:0002D4  4CF9280000000000             MOVEM.L PASCAL_REGISTERS,PSCL_RGLST
395  9:0002DC  4EB900000000                 JSR     M_NEXT
396  9:0002E2  48F9280000000000             MOVEM.L PSCL_RGLST,PASCAL_REGISTERS
397  9:0002EA  285F                         MOVE.L  (SP)+,A4
398  9:0002EC  4CDF6FFF                     MOVEM.L (SP)+,D0-D7/A0-A3/A5-A6
399  9:0002F0  7CFE                         MOVEQ.L #-SHORT,D6
400  9:0002F2  DCB90000404                  ADD.L   MEMO_LENGTH,D6
401  9:0002F8  2E00                         MOVE.L  A4,D7
402  9:0002FA  6740                         BEQ.S   PDON_31
403  9:0002FC  4E75                         RTS
404
405  9:0002FE  48E7FFFE            PDON_30  MOVEM.L D0-D7/A0-A6,-(SP)
406  9:000302  598F                         SUBQ.L  #LONG,SP
407  9:000304  4879C0011                    PEA     FONTERR
408  9:00030B  486F0004                     PEA     LONG(SP)
409  9:00030C  4EB900300000                 JSR     MEWA
410  9:000312  2E83                         MOVE.L  A0,(SP)
411  9:000314  207900000000                 MOVE.L  PCHPAR,A0
412  9:00031A  317C00110012                 MOVE.W  #FONTERR,ERRORNR(A0)
413  9:000320  2E2A000E                     MOVE.L  MCBADR(A0),D7
414  9:000324  205F                         MOVE.L  (SP)+,A0
415  9:000326  2F07                         MOVE.L  D7,-(SP)
416  9:000328  4CF9280000000000             MOVEM.L PASCAL_REGISTERS,PSCL_RGLST
417  9:000330  4EB900000000                 JSR     M_KILL
418  9:000336  48F9280000000000             MOVEM.L PSCL_RGLST,PASCAL_REGISTERS
419  9:00033E  4CDF7FFF                     MOVEM.L (SP)+,D0-D7/A0-A6
420  9:000342  6148                PDON_31  BSR.S   PLOT_CLEAR
421  9:000344  600FFE62                     BRA     PDON_4

R E L E A S E   Q U E U E            *        R E L E A S E _ Q U E U E
423                                  *
424
425
426  9:000348                      +        SECTION $9              * CODE SECTION
427  9:000348                      RELEASE_QUEUE EQU       *
428  9:000348  4852                         PEA     (A2)
429  9:00034A  3F07                         MOVE.W  D0,-(SP)
430  9:00034C  303C0100                     MOVE.W  #1<<PQ$S_SGMNT,D0
431  9:000350  247C00000000                 MOVE.L  #PQQ$L_SEGMENT,A2
432  9:000356  2E12                RELQ_1   MOVE.L  (A2),D7
433  9:000358  670E                         BEQ.S   RELQ_2
434  9:00035A  2047                +        MOVE.L  D7,A0                   ** RELEASE THIS SEGMENT
434  9:00035C  2E3C00000500        +        MOVE.L  #PQS$K_LENGTH,D7        * *
434  9:000362  4EB900000000        +        JSR     AFREE                   ** RETURN BLOCK TO POOL
435  9:000368  429A                RELQ_2   CLR.L   (A2)+
436  9:00036A  5347                         SUBQ.W  #1,D0
437  9:00036C  66E6                         BNE     RELQ_1
438  9:00036E  301F                         MOVE.W  (SP)+,D0
439  9:000370  245F                         MOVE.L  (SP)+,A2
440  9:000372  4E75                         RTS

P L O T   C L E A R                  *        P L O T _ C L E A R
442                                  *
443
444                                          XDEF    PLOT_CLEAR
445  9:000374                      +        SECTION $9              * CODE SECTION
446  9:000374  61D2                PCLR_0   BSR     RELEASE_QUEUE
448  9:000376  2B7C7FFF7FFF0018             MOVE.L  #$7FFF7FFF,MIN_Y(A5)
449  9:00037E  2B7C80008000001C             MOVE.L  #$80008000,MAX_Y(A5)
455  9:000386  301F                         MOVE.W  (SP)+,D0
456  9:000388  245F                         MOVE.L  (SP)+,A2
457  9:00038A  4E75                         RTS
458  9:00038C                      PLOT_CLEAR EQU  *
459  9:00038C  4852                         PEA     (A2)
460  9:00038E  3F00                         MOVE.W  D0,-(SP)
461  9:000390  422D002D                     CLR.B   LOOP_NOT_CLOSED(A5)
462  9:000394  302D001C                     MOVE.W  MAX_RASTER(A5),D0
463  9:000398  5240                         ADDQ.W  #1,D0
464  9:00039A  5340                PCLR_1   SUBQ.W  #1,D0
465  9:00039C  B06D0018                     CMP.W   MIN_RASTER(A5),D0
466  9:0003A0  6DD2                         BLT     PCLR_0
467  9:0003A2  3E00                +        MOVE.W  D0,D7
467  9:0003A4  E04F                +        LSR.W   #PQ$V_SGMNT,D7
467  9:0003A6  E54F                +        LSL.W   #2,D7
467  9:0003A8  41F900000000        +        LEA.L   PQQ$L_SEGMENT,A0
467  9:0003AE  45F07000            +        LEA.L   0(A0,D7.W),A2
467  9:0003B2  2E12                +        MOVE.L  (A2),D7
468  9:0003B4  6606                         BNE.S   PCLR_2
469  9:0003B6  024CFF00                     ANDI.W  #PQ$M_SGMNT,D0
470  9:0003BA  60DE                         BRA     PCLR_1
471  9:0003BC  2447                PCLR_2   MOVE.L  D7,A2
472  9:0003BE  3E00                +        MOVE.W  D0,D7
```

```
472  9:0003C0  02470FFF          +          ANDI.W  #PQS$L_LINE,D7
472  9:0003C4  E54F              +          LSL.W   #2,D7
472  9:0003C6  41E[illegible]0100 +         LEA.L   PQS$L_LINE(A2),A0
472  9:0003CA  41F[illegible]7000 +         LEA.L   0(A0,D7.W),A0
472  9:0003CE  2050              +          MOVE.L  (A0),A0
473  9:0003D0  2E0[illegible]                PCLR_3  MOVE.L  A0,D7
474  9:0003D2  67C[illegible]                BEQ     PCLR_1
476  9:0003D4  245[illegible]                MOVE.L  (A0),A2
481                              +          * ADDRESS TO FREE IN LONGWORD A0
481  9:0003D6  7E10              +          MOVE.L  #PQL$K_LENGTH,D7        * *
481  9:0003D8  4EB[illegible]00000000 +     JSR     AFREE                   ** RETURN BLOCK TO POOL
482  9:0003DE  204[illegible]                MOVE.L  A2,A0
483  9:0003E0  60E[illegible]                BRA     PCLR_3
```

Copyright (c) 1983 Allied Corporation All Rights Reserved
Module -V-

QUICK SORT

```
485                                         *       Q U I C K _ S O R T
486                                         *
487                                         *CALL FRAME
488  00000008                               OFFSET  2*SHORT+LONG            * AREA FOR OLD I, J, PC
489  00000008                               LEFT    DS.W    1               * BYTE OFFSET FOR LEFT END
490  0000000A                               RIGHT   DS.W    1               * BYTE OFFSET FOR RIGHT END
491  9:0003E2                    +          SECTION $9              * CODE SECTION
492  9:0003E2                               QUICK_SORT EQU  *
493  9:0003E2  48A73000                     MOVEM.W D2/D3,-(SP)
494  9:0003E6  342F0008                     MOVE.W  LEFT(SP),D2
495  9:0003EA  362F000A                     MOVE.W  RIGHT(SP),D3
496  9:0003EE  3E02                         MOVE.W  D2,D7
497  9:0003F0  DE43                         ADD.W   D3,D7
498  9:0003F2  E44F                         LSR.W   #2,D7
499  9:0003F4  DE47              +          ADD.W   D7,D7
500  9:0003F6  3E317000                     MOVE.W  0(A1,D7.W),D7
501  9:0003FA  BE712000                     QSRT_1  CMP.W   0(A1,D2.W),D7
502  9:0003FE  6F04                         BLE.S   QSRT_2
503  9:000400  5442                         ADDQ.W  #SHORT,D2
504  9:000402  60F6                         BRA     QSRT_1
505  9:000404  BE713000                     QSRT_2  CMP.W   0(A1,D3.W),D7
506  9:000408  6C04                         BGE.S   QSRT_3
507  9:00040A  5543                         SUBQ.W  #SHORT,D3
508  9:00040C  60F6                         BRA     QSRT_2
509  9:00040E  B642                         QSRT_3  CMP.W   D2,D3
510  9:000410  6D13                         BLT.S   QSRT_5
511  9:000412  670E                         BEQ.S   QSRT_4
512  9:000414  3F312000                     MOVE.W  0(A1,D2.W),-(SP)
513  9:00041B  33B130002000                 MOVE.W  0(A1,D3.W),0(A1,D2.W)
514  9:00041E  3391 3000                    MOVE.W  (SP)+,0(A1,D3.W)
515  9:000422  5442                         QSRT_4  ADDQ.W  #SHORT,D2
516  9:000424  5543                         SUBQ.W  #SHORT,D3
517  9:000426  B642                         CMP.W   D2,D3
518  9:000428  6CD[illegible]               BGE     QSRT_1
519  9:00042A  3E2F0008                     QSRT_5  MOVE.W  LEFT(SP),D7
520  9:00042E  B647                         CMP.W   D7,D3
521  9:000430  6F03                         BLE.S   QSRT_6
522  9:000432  3F03                         MOVE.W  D3,-(SP)
523  9:000434  3F07                         MOVE.W  D7,-(SP)
524  9:000436  61AA                         BSR     QUICK_SORT
525  9:000438  588F              +          ADDQ.L  #2*SHORT,SP
526  9:00043A  3E2F000A                     QSRT_6  MOVE.W  RIGHT(SP),D7
527  9:00043E  BE42                         CMP.W   D2,D7
528  9:000440  6F03                         BLE.S   QSRT_7
529  9:000442  3F07                         MOVE.W  D7,-(SP)
530  9:000444  3F02                         MOVE.W  D2,-(SP)
531  9:000446  619A                         BSR     QUICK_SORT
532  9:000448  588F              +          ADDQ.L  #2*SHORT,SP
533  9:00044A  4C9[illegible]000C           QSRT_7  MOVEM.W (SP)+,D2/D3
534  9:00044E  4E75                         RTS
```

CL EAR_SEGMENT

```
536                                         XDEF CLEAR_SEGMENT
537  9:000450                               CLEAR_SEGMENT EQU       *
538  9:000450  4850                         PEA     (A0)
539  9:000452  41F[illegible]00000000       LEA.L   PQQ$L_SEGMENT,A0
540  9:00045B  3E3[illegible]0100           MOVE.W  #1<<PQ$S_SGMNT,D7
541  9:00045C  4293                         CLR.L   (A0)+
542  9:00045E  5947                         SUBQ.W  #LONG,D7
543  9:000460  66FA                         BNE     *-4
544  9:000462  205F                         MOVE.L  (SP)+,A0
545  9:000464  4E75                         RTS
546
547                                         END
```

DYNAMIC STORAGE ALLOCATION & FREE

```
2                                           STORAGE IDNT 1,0 CURVE FONT MEMORY MANAGER
7    00001000                               HUNK    SET     $1000           * 4K BYTE CHUNKS
8
9                                           *       FREE HOLE STRUCTURE
10                                          *
11   00000000                               OFFSET  0
12   00000000                               FREE$L_PTR: DS.L        1
13   00000004                               FREE$L_SIZE: DS.L       1
14   00000008                               FREE$K_LENGTH: EQU      *
15
16                                          XDEF    AALLOC,AFREE,STOR_INIT,STOR_FINAL
17                                          XDEF    PLOT_AREA,FIRST_SEGMENT,FIRST_LENGTH
18                                          XREF    PASCAL_REGISTERS,FETCH_MEM,DISP_MEM,MEWA,PCHPAR,CRV_ERROR
19                                          XREF    M_KILL
20   7:000000                   +          SECTION $7              * DATA SECTION
21   7:000000  0000[illegible]000           PLOT_AREA: DC.L         0
22   7:000004  0000[illegible]000           FIRST_SEGMENT DC.L      0
23   7:000008  0000[illegible]000           FIRST_LENGTH DC.L       0
24   7:00000C                   +          DS.W    0
```

```
A A L L O C
                                    *CALL FRAME
                                    * D7(0:31)=      NUMBER OF BYTES NEEDED
                                    *
                                    *RETURN FRAME
                                    * D7(0:31)=      --) TO BASE OF HOLE
                                    *
                                    *REGISTERS DESTROYED    -       NONE

  9:000000                    +             SECTION #9                  * CODE SECTION
  9:000000                          AALLOC: EQU     *
  9:000000  48E780C0                        MOVEM.L D0/A0/A1,-(SP)          * SAVE REGISTERS
  9:000004  7008                            MOVEQ.L #FREE$K_LENGTH,D0
  9:000006  BE80                            CMP.L   D0,D7
  9:00000B  6306                            BLS.S   ALC8_1                    * REQUEST IS TO SMALL
  9:00000A  5287                            ADDQ.L  #1,D7
  9:00000C  70FE                            MOVEQ.L #-2,D0
  9:00000E  C087                            AND.L   D7,D0
  9:000010  2079 00000000           ALC8_1: MOVE.L  PLOT_AREA,A0
  9:000016  2248                            MOVE.L  A0,A1
  9:00001B  2E08                    ALC8_2: MOVE.L  A0,D7
  9:00001A  6730                            BEQ.S   ALC8_7                    * END OF CHAIN GET MORE MEMORY
  9:00001C  2E28 0004                       MOVE.L  FREE$L_SIZE(A0),D7
  9:000020  9E80                            SUB.L   D0,D7
  9:000022  6704                            BEQ.S   ALC8_3                    * EXACT FIT
  9:000024  5187                            SUBQ.L  #FREE$K_LENGTH,D7
  9:000026  6C14                            BGE.S   ALC8_5                    * LARGE ENOUGH
  9:00002B  2248                            MOVE.L  A0,A1
  9:00002A  2050                            MOVE.L  (A0),A0
  9:00002C  60E4                            BRA.S   ALC8_2
  9:00002E  B1C9                    ALC8_3: CMP.L   A1,A0
  9:000030  6606                            BNE.S   ALC8_4                    * NOT TOP TO LIST
  9:000032  43F9 00000000                   LEA.L   PLOT_AREA,A1
  9:00003B  2290                    ALC8_4: MOVE.L  (A0),(A1)                   * REMOVE THIS CHUNK FROM LIST
  9:00003A  6008                            BRA.S   ACL8_6
  9:00003C  91A8 0004               ALC8_5: SUB.L   D0,FREE$L_SIZE(A0)    * DECREASE THIS HOLE BY LENGTH
  9:000040  D1E8 0004                       ADD.L   FREE$L_SIZE(A0),A0        * P --) FREE HOLE
  9:000044  2E08                    ACL8_6: MOVE.L  A0,D7
  9:000046  4CDF 0301                       MOVEM.L (SP)+,D0/A0/A1        * RESTORE REGISTERS
  9:00004A  4E75                            RTS

A A L L O C
  9:00004C  43F8 0FF8               ALC8_7: LEA.L   HUNK-FREE$K_LENGTH,A1
  9:000050  B083                            CMP.L   A1,D0
  9:000052  6504                    +       BCS.S   ALC8_8            * LOWER
  9:000054  2240                            MOVE.L  D0,A1
  9:000056  6002                            BRA.S   ALC8_9
  9:00005B  5089                    ALC8_8: ADDQ.L  #FREE$K_LENGTH,A1
  9:00005A  2E09                    ALC8_9: MOVE.L  A1,D7
  9:00005C  0687 000003FF                   ADD.L   #1023,D7
  9:000062  E08F                            LSR.L   #8,D7
  9:000064  E48F                            LSR.L   #10-8,D7
  9:000066  48E7FF7E                        MOVEM.L D0-D7/A1-A6,-(SP)
  9:00006A  598F                            SUBQ.L  #LONG,SP                  * MAKE ROOM FOR POINTER TO NEW
  9:00006C  4857                            PEA.L   (SP)                      *\
  9:00006E  2F07                            MOVE.L  D7,-(SP)                  * >GET NEW MEMORY
  9:000070  4CF9 280000000000               MOVEM.L PASCAL_REGISTERS,PSCL_RGLST
  9:00007B  4EB9 00000000                   JSR     FETCH_MEM                 */
  9:00007E  48F9 280000000000               MOVEM.L PSCL_RGLST,PASCAL_REGISTERS
  9:000086  205F                            MOVE.L  (SP)+,A0
  9:000088  4CDF 7EFF                       MOVEM.L (SP)+,D0-D7/A1-A6
  9:00008C  2E09                            MOVE.L  A1,D7                     * LENGTH OF THIS HOLE
  9:00008E  51E8 002C                       SF      USED_1_SEGMENT(A5)
  9:000092  6100                            BSR.S   AFRE_0
  9:000094  6000 FF7A                       BRA     ALC8_1

A F R E E
                                    *CALL FRAME
                                    * D7(00:31)=SIZE OF HOLE
                                    * P(A0)--) HOLE
                                    *
                                    *RETURN FRAME
                                    *
                                    *REGISTERS DESTROYED    -       D7

  9:000098                    +             SECTION #9                  * CODE SECTION
  9:000098  4A2D 002C               AFREE:  TST.B   USED_1_SEGMENT(A5)
  9:00009C  6702                            BEQ.S   AFRE_0
  9:00009E  4E75                            RTS
  9:0000A0  48E78060                AFRE_0: MOVEM.L D0/A1/A2,-(SP)
  9:0000A4  7008                            MOVEQ.L #FREE$K_LENGTH,D0
  9:0000A6  BE80                            CMP.L   D0,D7
  9:0000A8  6306                            BLS.S   AFRE_1
  9:0000AA  5287                            ADDQ.L  #1,D7
  9:0000AC  70FE                            MOVEQ.L #-2,D0
  9:0000AE  C087                            AND.L   D7,D0
  9:0000B0  2479 00000000           AFRE_1: MOVE.L  PLOT_AREA,A2
  9:0000B6  2241                            MOVE.L  A2,A1
  9:0000B8  2E09                    AFRE_2: MOVE.L  A2,D7
  9:0000BA  6702                            BEQ.S   AFRE_3                    * END OF CHAIN
  9:0000BC  B1C9                            CMP.L   A2,A0
  9:0000BE  6306                            BLS.S   AFRE_3                    * FOUND WHERE IT GOES
  9:0000C0  2241                            MOVE.L  A2,A1
  9:0000C2  2452                            MOVE.L  (A2),A2
  9:0000C4  60F2                            BRA     AFRE_2
  9:0000C6  2E09                    AFRE_3: MOVE.L  A1,D7
  9:0000C8  6704                            BEQ.S   AFRE_4                    * 1ST HOLE
  9:0000CA  B1C9                            CMP.L   A1,A0
  9:0000CC  6206                            BHI.S   AFRE_5                    * NOT NEW TOP
  9:0000CE  23C0 00000000           AFRE_4: MOVE.L  A0,PLOT_AREA              * SET NEW TOP
  9:0000D4  2E09                    AFRE_5: MOVE.L  D0,D7
  9:0000D6  DE83                            ADD.L   A0,D7
  9:0000D8  B5C7                            CMP.L   D7,A2
  9:0000DA  6604                            BNE.S   AFRE_6                    * COLLAPSE FORWARD HOLE
  9:0000DC  2092                            MOVE.L  (A2),(A0)
  9:0000DE  D0A8 0004                       ADD.L   FREE$L_SIZE(A2),D0
  9:0000E2  6004                            BRA.S   AFRE_8
```

A F R E E

```
9:0000E4  6204                AFRE_6: BHI.S    AFRE_7
9:0000E6  2E01                        MOVE.L   A2,D7
9:0000E8  6623                        BNE.S    AFRE_20                 * TRAP ON TROUBLE
9:0000EA  2081                AFRE_7: MOVE.L   A2,(A0)                   * INSERT THIS HOLE
9:0000EC  2E09                AFRE_8: MOVE.L   A1,D7
9:0000EE  6718                        BEQ.S    AFRE_10
9:0000F0  B1C9                        CMP.L    A1,A0
9:0000F2  6314                        BLS.S    AFRE_10
9:0000F4  DEA8 0004                   ADD.L    FREE$L_SIZE(A1),D7
9:0000F8  B1C7                        CMP.L    D7,A0
9:0000FA  6603                        BNE.S    AFRE_9                  * NO COLLAPSE BACKWARD
9:0000FC  2290                        MOVE.L   (A0),(A1)
9:0000FE  D1A8 0004                   ADD.L    D0,FREE$L_SIZE(A1)
9:000102  6000                        BRA.S    AFRE_11
9:000104  630C                AFRE_9: BLS.S    AFRE_20                 * TRAP ON TROUBLE
9:000106  2283                        MOVE.L   A0,(A1)                   * PREVIOUS LINK TO NEW
9:00010B  2140 6004           AFRE_10 MOVE.L   D0,FREE$L_SIZE(A0)
9:00010C  4CDF 0601           AFRE_11 MOVEM.L  (SP)+,D0/A1/A2
9:000110  4E75                        RTS

9:000112  207C 00000000       AFRE_20 MOVE.L   PCHPAR,A0
9:00011B  317C 004B0012               MOVE.W   #PAREER,ERRORNR(A0)
9:00011E  598F                        SUBQ.L   #LONG,SP
9:000120  487B 004B                   PEA      PAREER
9:000124  4868 0004                   PEA      LONG(SP)
9:000128  4EB9 00000000               JSR      MEWA
9:00012E  207C 00000000               MOVE.L   PCHPAR,A0
9:000134  2F28 000E                   MOVE.L   MCBADR(A0),-(SP)
9:00013B  4CF9 2B0000000000           MOVEM.L  PASCAL_REGISTERS,PSCL_RGLST
9:000140  4EB9 00000000               JSR      M_KILL
9:000146  48F9 2B0000000000           MOVEM.L  PSCL_RGLST,PASCAL_REGISTERS
9:00014E  4EF9 00000000               JMP      CRV_ERROR
```

I N I T I A L I Z A T I O N

```
9:000154  4A28 002C           STOR_FINAL TST.B USED_1_SEGMENT(A5)
9:00015B  6702                        BEQ.S    *+4
9:00015A  6052                        BRA.S    STOR_INIT
9:00015C  48E7 0380                   MOVEM.L  D6/D7/A0,-(SP)
9:000160  207C 00000000       STFIN_1 MOVE.L   PLOT_AREA,A0
9:000166  2E18                        MOVE.L   (A0)+,D7
9:00016B  674C                        BEQ.S    STFIN_2
9:00016A  23C7 00000000               MOVE.L   D7,PLOT_AREA
9:000170  BEB8 00000004               CMP.L    FIRST_SEGMENT,D7
9:000176  67E8                        BEQ.S    STFIN_1
9:00017B  48E7 FEFE                   MOVEM.L  D0-D6/A0-A6,-(SP)
9:00017C  2F07                        MOVE.L   D7,-(SP)
9:00017E  4857                        PEA      (SP)
9:000180  2E10                        MOVE.L   (A0),D7                 * LENGTH OF PARTITION
9:000182  0287 000003FF               AND.L    #1023,D7
9:000188  6688                        BNE      AFRE_20                 * PARTITION WAS NOT CLOSED
9:00018A  2E10                        MOVE.L   (A0),D7
9:00018C  0687 000003FF               ADD.L    #1023,D7
9:000192  E08F                        LSR.L    #8,D7
9:000194  E48F                        LSR.L    #10-8,D7
9:000196  2F07                        MOVE.L   D7,-(SP)
9:000198  4CF9 2B0000000000           MOVEM.L  PASCAL_REGISTERS,PSCL_RGLST
9:0001A0  4EB9 00000000               JSR      DISP_MEM
9:0001A6  48F9 2B0000000000           MOVEM.L  PSCL_RGLST,PASCAL_REGISTERS
9:0001AE  588F                        ADDQ.L   #LONG,SP
9:0001B0  4CDF 7F7F                   MOVEM.L  (SP)+,D0-D6/A0-A6
9:0001B4  60A4                        BRA      STFIN_1
9:0001B6  4CDF 01C0           STFIN_2 MOVEM.L  (SP)+,D6/D7/A0

9:0001BA  4857                STOR_INIT PEA    (A0)
9:0001BC  2E39 00000004       STINT_1 MOVE.L   FIRST_SEGMENT,D7
9:0001C2  6718                        BEQ.S    STINT_2
9:0001C4  2047                        MOVE.L   D7,A0
9:0001C6  23C8 00000000               MOVE.L   A0,PLOT_AREA
9:0001CC  4298                        CLR.L    (A0)+
9:0001CE  20B8 00000008               MOVE.L   FIRST_LENGTH,(A0)
9:0001D4  50E8 002C                   ST.B     USED_1_SEGMENT(A5)
9:0001D8  205F                        MOVE.L   (SP)+,A0
9:0001DA  4E75                        RTS
9:0001DC  48E7 FFFE           STINT_2 MOVEM.L  D0-D7/A0-A6,-(SP)
9:0001E0  4879 00000004               PEA.L    FIRST_SEGMENT
9:0001E6  48780014                    PEA      20
9:0001EA  4CF9 2B0000000000           MOVEM.L  PASCAL_REGISTERS,PSCL_RGLST
9:0001F2  4EB9 00000000               JSR      FETCH_MEM
9:0001F8  48F9 2B0000000000           MOVEM.L  PSCL_RGLST,PASCAL_REGISTERS
9:000200  4CDF 7FFF                   MOVEM.L  (SP)+,D0-D7/A0-A6
9:000204  23FC 00050000 0000          MOVE.L   #20*1024,FIRST_LENGTH
9:00020E  60AC                        BRA      STINT_1

                                      END
```

T R I G  F U N C T I O N S

```
                              TRIC     IDNT 1,0 CURVE FONT ARCTANGENT/SINE/COSINE FUNCTIONS
                              *        ANGULAR CONSTANTS
000000A0                      HDEG_80:         SET      80*2
000000B3                      HDEG_89P5:       SET      89*2+1
000000B4                      HDEG_90:         SET      90*2
0000016B                      HDEG_180:        SET      HDEG_90*2
000002D0                      HDEG_360:        SET      HDEG_180*2
```

A R C T A N G E N T

```
                              *        A R C T A N
                              *
                              *CALL FRAME
                              * D7(16:31)= DELTA Y
                              * D7(00:15)= DELTA X
                              *
                              *RETURN FRAME
                              * D7(00:31)= ARCTANGENT ANGLE IN 1/2 DEGREES
                              *
                              *REGISTERS DESTROYED     -        NONE
                              *REGISTERS USED          -        DELTA_Y(D0)/D7/A0
                              *
                              *FUNCTION
                              * GIVEN DELTA_Y AND DELTA_X A ANGLE IN 1/2 DEGREES IS RETURNED BY TAKING
                              * THE SLOPE (IE ABS(DELTA_Y)/ABS(DELTA_X)) AND LOOKING IT UP INTO A TABLE.
```

```
                                  * THE TABLES ARE BROKEN INTO 3 PARTS.
                                  * 1)    ARCTANGENT(SLOPE) 0<=SLOPE<2 BY 1/128S
                                  * 2)    ARCTANGENT(SLOPE) 2<=SLOPE<6 BY 1/64S
                                  * 3)    TANGENT(THETA) 80<=THETA<=89 BY 1/2DEGS
                                  * FINALLY THE SIGNS OF DELTA_X AND DELTA_Y ARE USED TO SET THE QUADRANT
                                  * OF THE RETURN VALUE
                                  *
                                  *REGISTERS
                                  *DELTA_Y          SET     D0
                                  *DELTA_Y.W        SET     D0.W

                                          XDEF    ARCTAN                  * ARCTANGENT FUNCTION
                                          XREF    ATN_0_2,ATN_2_6,TAN_80_89       * FROM TABLES
9:000000                          +       SECTION #9                * CODE SECTION
9:000000                          ARCTAN: EQU     *
9:000000  48E7 8080                       MOVEM.L D0/A0,-(SP)
9:000004  2007                            MOVE.L  D7,D0                   * D7=X
9:000006  4840                            SWAP    D0                * DELTA_Y=Y
9:000008  2F00                            MOVE.L  D0,-(SP)          * PUSH ON DELTA_X/DELTA_Y
9:00000A  48C0                            EXT.L   D0
9:00000C  6612                            BNE.S   ARCTN_3                 * THERE IS A Y
9:00000E  7E00                            MOVEQ.L #0,D7
9:000010  4A5F                    ARCTN_1 TST.W   (SP)+                   * IS X<0
9:000012  6A06                            BPL.S   ARCTN_2
9:000014  4447                            NEG.W   D7
9:000016  0647 0168                       ADDI.W  #HDEG_180,D7
9:00001A  4A5F                    ARCTN_2 TST.W   (SP)+                   * IS Y<0
9:00001C  6A02                            BPL.S   *+4
9:00001E  4447                            NEG.W   D7
9:000020  4CDF 0101                       MOVEM.L (SP)+,D0/A0
9:000024  48C7                            EXT.L   D7
9:000026  4E75                            RTS
```

Copyright (c) 1983 Allied Corporation All Rights Reserved
Module -VII-

A R C T A N G E N T

```
9:000028                          ARCTN_3 EQU     *
9:000028  6A02                    +       BPL.S   *+4
9:00002A  4480                    +       NEG.L   D0
9:00002C  48C7                            EXT.L   D7
9:00002E  6606                            BNE.S   ARCTN_4
9:000030  3E3C 00B4                       MOVE.W  #HDEG_90,D7
9:000034  60DA                            BRA     ARCTN_1
9:000036                          ARCTN_4 EQU     *
9:000036  6A02                    +       BPL.S   *+4
9:000038  4487                    +       NEG.L   D7
9:00003A  2047                            MOVE.L  D7,A0                   * SAVE X
9:00003C  D1C3                            ADD.L   A0,A0                   * X*2
9:00003E  B1C0                            CMP.L   D0,A0                     * Y < 2*X
9:000040  6312                            BLS.S   ARCTN_6
9:000042  EF80                            ASL.L   #7,D0
9:000044  41FA 00000000                   LEA.L   ATN_0_2,A0
9:00004A  80C7                    ARCTN_5 DIVU    D7,D0
                                  +       * D0 ALREADY INDEX TO CHAR      * OFFSET BY BYTES
9:00004C  7E00                            MOVEQ.L #0,D7
9:00004E  1E30 0000                       MOVE.B  0(A0,D0.W),D7
9:000052  60B2                            BRA     ARCTN_1                 * SET QUADRANT
9:000054  D1C7                    ARCTN_6 ADD.L   D7,A0                   * X*3
9:000056  D1C3                            ADD.L   A0,A0                   * X*6
9:000058  B1C0                            CMP.L   D0,A0                     * Y < 6*X
9:00005A  630A                            BLS.S   ARCTN_7
9:00005C  ED88                            ASL.L   #6,D0                     * Y*64
9:00005E  41FA FFFFFF80                   LEA.L   ATN_2_6-128*CHAR,A0
9:000064  60E4                            BRA     ARCTN_5
9:000066  2047                    ARCTN_7 MOVE.L  D7,A0
9:000068  EF87                            ASL.L   #16-9,D7
9:00006A  BE80                            CMP.L   D0,D7
9:00006C  6316                            BLS.S   ARCTN7A
9:00006E  2E06                            MOVE.L  A0,D7
9:000070  E188                            ASL.L   #8,D0
9:000072  E388                            ASL.L   #9-8,D0
9:000074  80C7                            DIVU    D7,D0
9:000076  690C                            BVS.S   ARCTN7A
9:000078  41FA 00000000                   LEA.L   TAN_80_89,A0
9:00007E  B06A 0024                       CMP.W   18*SHORT(A0),D0
9:0000B2  6506                    +       BCS.S   ARCTN_8           * LOWER
9:0000B4  3E3C 00B3               ARCTN7A MOVE.W  #HDEG_89P5,D7
9:0000B8  6086                            BRA     ARCTN_1
9:0000BA  7E12                    ARCTN_8 MOVEQ.L #9*SHORT,D7
9:0000BC  B07A 7800                       CMP.W   0(A0,D7.L),D0
9:000090  6403                    +       BCC.S   ARCTN10           * HIGH OR SAME
9:000092  7EFE                            MOVEQ.L #-SHORT,D7
9:000094  5487                    ARCTN_9 ADDQ.L  #SHORT,D7
9:000096  B07A 7800               ARCTN10 CMP.W   0(A0,D7.L),D0
9:0000A0  62F8                            BHI.S   ARCTN_9
9:0000A2  E247                            ASR.W   #1,D7                   * UNDO SHORT INDEX
9:0000A4  0647 00A0                       ADDI.W  #HDEG_80,D7
9:0000A6  6000 FF6C                       BRA     ARCTN_1
```

S I N E / C O S I N E

```
                                  *       S I N E / C O S I N E
                                  *
                                  *CALL FRAME
                                  * D7(0:15)=      +/- THETA IN 1/2 DEGREES
                                  *
                                  *RETURN FRAME
                                  * D7(0:31)=      +/- SINE(THETA)/COSINE(THETA) * 2**-15
                                  *
                                  *REGISTERS DESTROYED    -       NONE
                                  *REGISTERS USED -               D7/A0
                                  *
                                  *FUNCTION
                                  * IF COMPENSATE FOR COSINE               IE. COSINE(THETA)===SINE(THETA+90)
                                  * THE VALUE OF ABS(THETA) MOD 360 IS REDUCED WITHIN RANGE OF (0..90)
                                  * THIS NUMBER IS USED TO LOOKUP INTO A SINE TABLE
                                  * THEN COMPENSATE FOR NEGATIVE THETA     IE. SINE(-THETA)===-SINE(THETA)

                                          XDEF    SINE,COSINE             * SINE / COSINE FUNCTIONS
                                          XREF    SINE_TBL                * FROM TABLES
```

```
133  9:0000A6                          +          SECTION $9                 * CODE SECTION
134  9:0000A6                                COSINE: EQU     *
135  9:0000A6  064700B4                             ADDI.W  #HDEG_90,D7
136  9:0000AA                                SINE:   EQU     *
137  9:0000AA  485Ø                                 PEA.L   (A0)                       * SAVE A0
138  9:0000AC  41F.00000000                         LEA.L   SINE_TBL,A0
139  9:0000B2  48C7                                 EXT.L   D7                         * SET D7(31) TO SIGN OF THETA
140  9:0000B4  6A0.                    +            BPL.S   *+4
140  9:0000B6  4447                    +            NEG.W   D7
141  9:0000B8  044702D0                      SINE_1: SUBI.W  #HDEG_360,D7
142  9:0000BC  64F\                    +            BCC.S   SINE_1             * HIGH OR SAME
143  9:0000BE  064.02D0                             ADDI.W  #HDEG_360,D7
144  9:0000C2  0C470168                             CMPI.W  #HDEG_180,D7
145  9:0000C6  6303                                 BLS.S   SINE_2
146  9:0000CB  04470168                             SUBI.W  #HDEG_180,D7
147  9:0000CC  0B47001F                             BCHG.L  #31,D7
148  9:0000D0  0C4700B4                      SINE_2: CMPI.W  #HDEG_90,D7
149  9:0000D4  6306                                 BLS.S   SINE_3
150  9:0000D6  4447                                 NEG.W   D7
151  9:0000DB  06470168                             ADDI.W  #HDEG_180,D7
152  9:0000DC                                SINE_3: EQU     *
153  9:0000DC  DE47                    +            ADD.W   D7,D7
154  9:0000DE  3E3.7000                             MOVE.W  0(A0,D7.W),D7
155  9:0000E2  205F                                 MOVE.L  (SP)+,A0
156  9:0000E4  4AB7                                 TST.L   D7
157  9:0000E6  6A0.                    +            BPL.S   *+4
157  9:0000E8  4447                    +            NEG.W   D7
158  9:0000EA  48C7                                 EXT.L   D7
159  9:0000EC  4E75                                 RTS
```

F O L D  A N G L E

```
161                                             *       F O L D _ A N G L E
162                                             *
163                                             *CALL FRAME
164                                             * D7=   DELTA_ANGLE = ANGLE2-ANGLE1      ANGLE2.ANGLE1=(-180..+180)
165                                             *
166                                             *RETURN FRAME
167                                             * D7=   DELTA_ANGLE SUCH THAT DELTA_ANGLE=(-180..+180)
168                                             *
169                                             *REGISTERS DESTROYED    -       NONE
170                                             *REGISTERS USED -               D7
171                                             *
172                                             *FUNCTION
173                                             * IF DELTA ANGLE > 180 THEN -360;RETURN
174                                             * IF DELTA ANGLE <-180 THEN +360;RETURN
175
176                                                     XDEF    FOLD_ANGLE
177
178  9:0000EE                          +                SECTION $9                 * CODE SECTION
179  9:0000EE                                FOLD_ANGLE: EQU *
180  9:0000EE  0C470168                             CMPI.W  #HDEG_180,D7
181  9:0000F2  6F06                                 BLE.S   FANG_1
182  9:0000F4  044702D0                             SUBI.W  #HDEG_360,D7
183  9:0000F8  6000                                 BRA.S   FANG_2
184  9:0000FA  0C47FE98                      FANG_1 CMPI.W  #-HDEG_180,D7
185  9:0000FE  6C04                                 BGE.S   FANG_2
186  9:000100  064.02D0                             ADDI.W  #HDEG_360,D7
187  9:000104  48C7                          FANG_2 EXT.L   D7
188  9:000106  4E75                                 RTS
189
190                                                     END
```

R e a d o n l y  T r i g  T a b l e s
A r c t a n g e n t  T a b l e s

```
TRIGTABL     9     A r c t a n g e n t   T a b l e s
TRIGTABL    86     T a n g e n t   T a b l e
TRIGTABL   111     S i n e   T a b l e
TRIGTABL   136     X i   T a b l e
    5                                           xdef    atn_0_2,atn_2_6,atn_026,tan_80_89,atn_tan_tbl
    6                                           xdef    sine_tbl,tan_tbl,xi_tbl
    7
    8  C:000000                          +            section $C                 * Code Section
```

R e a d o n l y  T r i g  T a b l e s
A r c t a n g e n t  T a b l e s

```
   10  C:000000                                tan_80_89: equ  *                  * tangent of 80..89 by 1/2deg
   11  C:000000  0BA.9C480CFF0DCB                  dc.w    2980,3144,3327,3531,3762,4025,4326,4675,5085,5572
   12  C:000014  1B1.1AEA1E842339                  do.w    6162,6890,7812,9017,10659,13031,16758,23465,-26424
   13  C:000026                                atn_0_2: equ    *                  * arctangent of 0..2 by 1/128
   14  C:000026  000.020304040506                  dc.b    0,1,2,3,4,4,5,6
   15  C:00002E  070.090A0B0C0C0D                  dc.b    7,8,9,10,11,12,12,13
   16  C:000036  0E0.10111213141 4                 dc.b    14,15,16,17,18,19,20,20
   17  C:00003E  151.171819 1A1A1B                 do.b    21,22,23,24,25,26,26,27
   18  C:000046  1C1.1E1F1F202122                  do.b    28,29,30,31,31,32,33,34
   19  C:00004E  232.242526272828                  do.b    35,36,36,37,38,39,40,40
   20  C:000056  292.2B2B2C2D2E2F                  do.b    41,42,43,43,44,45,46,47
   21  C:00005E  2F3.313132333434                  do.b    47,48,49,49,50,51,52,52
   22  C:000066  353.373738393 93A                 do.b    53,54,55,55,56,57,57,58
   23  C:00006E  3B3.3C3D3D3E3F3F                  do.b    59,59,60,61,61,62,63,63
   24  C:000076  404.414243434444                  do.b    64,65,65,66,67,67,68,68
   25  C:00007E  454.464747484949                  dc.b    69,70,70,71,71,72,73,73
   26  C:000086  4A4.4B4B4C4D4D4E                  do.b    74,74,75,75,76,77,77,78
   27  C:00008E  4E4.4F5050515152                  dc.b    78,79,79,80,80,81,81,82
   28  C:000096  525.535454555556                  do.b    82,83,83,84,84,85,85,86
   29  C:00009E  565.575858595 95A                 dc.b    86,87,87,88,88,89,89,90
   30  C:0000A6  5A5.5B5B5C5C5D5D                  dc.b    90,90,91,91,92,92,93,93
   31  C:0000AE  5D5.5E5E5F5F606060                dc.b    93,94,94,95,95,96,96,96
   32  C:0000B6  616.626262636363                  dc.b    97,97,98,98,98,99,99,99
   33  C:0000BE  646.656565666666                  dc.b    100,100,101,101,101,102,102,102
   34  C:0000C6  676.6 76B6B6B6969                 dc.b    103,103,103,104,104,104,105,105
   35  C:0000CE  696.6A6A6B6B6B6C                  dc.b    105,106,106,106,107,107,107,108
   36  C:0000D6  6C6.6D6D6D6D6D6E6E                dc.b    108,108,109,109,109,109,110,110
   37  C:0000DE  6E6.6F6F70707070                  dc.b    110,111,111,111,112,112,112,112
   38  C:0000E6  717.171172727273                  dc.b    113,113,113,113,114,114,114,115
   39  C:0000EE  737.787474747475                  dc.b    115,115,115,116,116,116,116,117
   40  C:0000F6  757.757676767676                  dc.b    117,117,117,118,118,118,118,118
   41  C:0000FE  777.777778787878                  dc.b    119,119,119,119,120,120,120,120
   42  C:000106  797.7979797A7A7A                  dc.b    121,121,121,121,121,122,122,122
   43  C:00010E  7A7.7B7B7B7B7B7C                  dc.b    122,122,123,123,123,123,123,124
   44  C:000116  7C7.7C7C7D7D7D7D                  dc.b    124,124,124,124,125,125,125,125
   45  C;00011E  7D7.7E7E7E7E7E7F7F                dc.b    125,126,126,126,126,126,127,127
```

```
 47  C:000026                          atn_026: set atn_0_2     * atn_0_2 is followed by atn_2_6
 49  C:000026                          atn_tan_tbl: set atn_0_2         * tan_80_90 is -19 shortwords of tan_0_2
 52  C:000126                          atn_2_6: equ     *                * arctangent 2..6 by 1/64
 53  C:000126  7F7F808080818181          dc.b   127,127,-128,-128,-128,-127,-127,-127
 54  C:00012E  828282838383838384        dc.b   -126,-126,-126,-125,-125,-125,-125,-124
 55  C:000136  848485858586868686        dc.b   -124,-124,-123,-123,-123,-122,-122,-122
 56  C:00013E  868787878788888888        dc.b   -122,-121,-121,-121,-121,-120,-120,-120
 57  C:000146  888989898989A8A8A8        dc.b   -120,-119,-119,-119,-119,-118,-118,-118
 58  C:00014E  A8A8B8B8B8B8B8C8C8        dc.b   -118,-117,-117,-117,-117,-117,-116,-116
 59  C:000156  8C8C8C8D8D8D8D8D8D        dc.b   -116,-116,-116,-115,-115,-115,-115,-115
 60  C:00015E  8E8E8E8E8E8E8F8F8F        dc.b   -114,-114,-114,-114,-114,-113,-113,-113
 61  C:000166  8F8F8F9090909090          dc.b   -113,-113,-113,-112,-112,-112,-112,-112
 62  C:00016E  919191919191919192        dc.b   -111,-111,-111,-111,-111,-111,-111,-110
 63  C:000176  929292929293939393        dc.b   -110,-110,-110,-110,-110,-109,-109,-109
 64  C:00017E  939393939494949494        dc.b   -109,-109,-109,-109,-108,-108,-108,-108
 65  C:000186  949494959595959595        dc.b   -108,-108,-108,-107,-107,-107,-107,-107
 66  C:00018E  959595969696969696        dc.b   -107,-107,-107,-106,-106,-106,-106,-106

A r c t a n g e n t   T a b l e s
 67  C:000196  969696969797979797        dc.b   -106,-106,-106,-106,-105,-105,-105,-105
 68  C:00019E  979797979798989898        dc.b   -105,-105,-105,-105,-105,-104,-104,-104
 69  C:0001A6  989898989898989999        dc.b   -104,-104,-104,-104,-104,-104,-103,-103
 70  C:0001AE  999999999999999999        dc.b   -103,-103,-103,-103,-103,-103,-103,-103
 71  C:0001B6  9A9A9A9A9A9A9A9A9A        dc.b   -102,-102,-102,-102,-102,-102,-102,-102
 72  C:0001BE  9A9A9A9B9B9B9B9B9B        dc.b   -102,-102,-102,-101,-101,-101,-101,-101
 73  C:0001C6  9B9B9B9B9B9B9B9B9C        dc.b   -101,-101,-101,-101,-101,-101,-101,-100
 74  C:0001CE  9C9C9C9C9C9C9C9C9C        dc.b   -100,-100,-100,-100,-100,-100,-100,-100
 75  C:0001D6  9C9C9C9C9D9D9D9D9D        dc.b   -100,-100,-100,-100,-99,-99,-99,-99
 76  C:0001DE  9D9D9D9D9D9D9D9D9D        dc.b   -99,-99,-99,-99,-99,-99,-99,-99
 77  C:0001E6  9D9D9E9E9E9E9E9E9E        dc.b   -99,-99,-98,-98,-98,-98,-98,-98
 78  C:0001EE  9E9E9E9E9E9E9E9E9E        dc.b   -98,-98,-98,-98,-98,-98,-98,-98
 79  C:0001F6  9E9E9F9F9F9F9F9F9F        dc.b   -98,-98,-97,-97,-97,-97,-97,-97
 80  C:0001FE  9F9F9F9F9F9F9F9F9F        dc.b   -97,-97,-97,-97,-97,-97,-97,-97
 81  C:000206  9F9FA0A0A0A0A0A0A0        dc.b   -97,-97,-96,-96,-96,-96,-96,-96
 82  C:00020E  A0A0A0A0A0A0A0A0A0        dc.b   -96,-96,-96,-96,-96,-96,-96,-96
 83  C:000216  A0A0A0A0A0A1A1A1A1        dc.b   -96,-96,-96,-96,-96,-95,-95,-95
 84  C:00021E  A1A1A1A1A1A1A1A1A1        dc.b   -95,-95,-95,-95,-95,-95,-95,-95
 85  C:000226                      +     ds.w   0
 86                                +
 87  C:000226                          tan_tbl:       equ *            * tangent of 0..90 degrees by 1/2 binary(15,8)
 88  C:000226  000200020004000 7        dc.w   0,2,4,7,9,11,13,16
 89  C:000236  001200140016001 9        dc.w   18,20,22,25,27,29,31,34
 90  C:000246  002100260029002B         dc.w   36,38,41,43,45,47,50,52
 91  C:000256  003600390038003D         dc.w   54,57,59,61,64,66,69,71
 92  C:000266  004700400050051          dc.w   73,76,78,81,83,86,88,91
 93  C:000276  005900600062006 5        dc.w   93,96,98,101,103,106,109,111
 94  C:000286  007200750077007A         dc.w   114,117,119,122,125,128,130,133
 95  C:000296  008300880089009 1        dc.w   136,139,142,145,148,151,154,157
 96  C:0002A6  00A300A300A600A9         dc.w   160,163,166,169,173,176,179,183
 97  C:0002B6  00B200BD00C100C4         dc.w   186,189,193,196,200,204,207,211
 98  C:0002C6  00D200DB00DF00E2         dc.w   215,219,223,226,231,235,239,243
 99  C:0002D6  00F700FC0100010 5        dc.w   247,252,256,261,265,270,275,279
100  C:0002E6  011 012101260126 2C      dc.w   284,289,294,300,305,311,316,322
101  C:0002F6  0143014E0154015A         dc.w   328,334,340,346,352,359,366,372
102  C:000306  017 018301800192         dc.w   380,387,394,402,410,418,426,435
103  C:000316  01BL01C401CE01D7         dc.w   443,452,462,471,481,492,502,513
104  C:000326  020 021902250232         dc.w   525,537,549,562,575,589,603,618
105  C:000336  027 028A029B02AD         dc.w   634,650,667,685,703,723,743,765
106  C:000346  0314032C03450360         dc.w   788,812,837,864,893,923,955,990
107  C:000356  040 0042A04550483        dc.w   1027,1066,1109,1155,1204,1258,1317,1381
108  C:000366  05A 05FA065006B1         dc.w   1452,1530,1616,1713,1822,1945,2085,2247
109  C:000376  09810A630B6E0CB5         dc.w   2436,2659,2926,3253,3661,4186,4885,5863
110  C:000386  1CA 2630394A7297         dc.w   7331,9776,14666,29335,32767
```

Copyright (c) 1983 Allied Corporation All Rights Reserved
Module -VII-

```
R e a d o n l y   T r i g   T a b l e s
S i n e   T a b l e
112  C:000390                          sine_tbl: equ    *        * sine of 0..90 degrees by 1/2 Binary(15,15)
113  C:000390  000 011E023C035A         dc.w   0,286,572,858,1144,1429,1715,2000
114  C:0003A0  08E 0A0B0B280C45         dc.w   2286,2571,2856,3141,3425,3709,3993,4277
115  C:0003B0  11D 12EB14061520         dc.w   4560,4843,5126,5408,5690,5971,6252,6533
116  C:0003C0  1A9 1BB41CCB1DE2         dc.w   6813,7092,7371,7650,7927,8204,8481,8757
117  C:0003D0  234 2451B256C267E        dc.w   9032,9307,9580,9854,10126,10397,10668,10938
118  C:0003E0  2BC 2CD42DDF2EEA         dc.w   11207,11476,11743,12010,12275,12540,12803,13066
119  C:0003F0  341 3515361B371B         dc.w   13328,13589,13848,14107,14365,14621,14876,15131
120  C:000400  3C1 3D143E0E3F0B         dc.w   15384,15636,15886,16136,16384,16631,16877,17121
121  C:000410  43D 444C645B746A6        dc.w   17364,17606,17847,18086,18324,18560,18795,19028
122  C:000420  4B3 4C234D0B4DEC         dc.w   19261,19491,19720,19948,20174,20399,20622,20843
123  C:000430  524 532153FA54D1        dc.w   21063,21281,21498,21713,21926,22138,22348,22556
124  C:000440  58E 59B75A825B4C         dc.w   22763,22967,23170,23372,23571,23769,23965,24159
125  C:000450  5F1 5FDE609A6155         dc.w   24351,24542,24730,24917,25102,25285,25466,25645
126  C:000460  64D 65BD663A66E5         dc.w   25822,25997,26170,26341,26510,26677,26842,27005
127  C:000470  6A1 6ABD6B5A6BF4         dc.w   27166,27325,27482,27636,27789,27939,28088,28234
128  C:000480  6ED 6F686FF4707D         dc.w   28378,28320,28660,28797,28932,29066,29197,29325
129  C:000490  730 738B7402747A         dc.w   29452,29576,29698,29818,29935,30050,30163,30274
130  C:0004A0  76A 771B778077E5         dc.w   30382,30488,30592,30693,30792,30888,30983,31075
131  C:0004B0  79B 7A137A687ABB         dc.w   31164,31251,31336,31419,31499,31576,31651,31724
132  C:0004C0  7C3 7C777CB87CF7         dc.w   31795,31863,31928,31991,32052,32110,32166,32219
133  C:0004D0  7E0 7E3F7E6D7E9B         dc.w   32270,32319,32365,32408,32449,32488,32524,32557
134  C:0004E0  7F4 7F697F837F9B         dc.w   32588,32617,32643,32667,32688,32707,32723,32737
135  C:0004F0  7FE 7FF57FFB7FFF         dc.w   32748,32757,32763,32767,32767
136                                +
137  C:0004FA                          xl_tbl: equ      *        * (1+abs(cos(theta)))*sin(theta)/2 0..45 by 1/2
138  C:0004FA  000 011E023C035A         dc.w   0,286,572,858,1143,1429,1714,1999
139  C:00050A  08E 0A070B220C3D         dc.w   2283,2567,2850,3133,3416,3698,3979,4259
140  C:00051A  11B 12D113E614FB         dc.w   4538,4817,5094,5371,5647,5921,6195,6467
141  C:00052A  1A5 1B601C6D1D78         dc.w   6738,7008,7277,7544,7810,8074,8336,8598
142  C:00053A  229 239B249B259A         dc.w   8857,9115,9371,9626,9878,10129,10378,10624
143  C:00054A  2A7 2B682C592D48         dc.w   10869,11112,11353,11592,11828,12063,12295,12524
144  C:00055A  31D 32B13390346C         dc.w   12752,12977,13200,13420,13638,13853,14066,14276
145  C:00056A  389 39603A2A3AF2         dc.w   14483,14688,14890,15090,15286,15480,15671,15860
146  C:00057A  3EA 3F64401740C8         dc.w   16045,16228,16407,16584,16757,16928,17095,17260
147  C:00058A  440 44AC454745DF         dc.w   17421,17580,17735,17887,18036,18181,18324,18463
148  C:00059A  4BA 492C49AD4A2B         dc.w   18599,18732,18861,18987,19110,19230,19346,19459
149  C:0005AA  4C7 4CDA4D41             dc.w   19568,19674,19777
150
151  C:0005B0                          total_tables:   set      *
152                                                   end
```

I claim:

1. A method for linear interpolation of coordinate points between first and second end points, to produce coordinates on a straight line outline and where said coordinates are located on a coordinate system having a first coordinate direction and second coordinate direction and encoded in machine readable data words of radix "r", corresponding to the order of values for designated positions in said data words, comprising the steps of:

(a) encoding a first data word of "N" positions corresponding to the distance between the said first and second end points in the said first coordinate direction and placing said first data word into a first machine location, (b) encoding a second data word of "M" bits corresponding to the distance between said first and second end points in said second coordinate direction and placing said second data word into a second machine location, (c) determining the number of available positions, between the most significant position of said first data word and the most significant position of said first machine location, available for shifting said first data word in a first direction of the most significant positions of said first machine location, (d) shifting said first data word by a maximum number of positions, equal to the said number of available positions in said first direction and the number of positions corresponding to the number of significant positions used to encode said second data word, and increasing the scale of said first data word by a scale factor related to the number of said positions shifted, (e) deriving a third data word indicative of said second data word in said second machine location divided into said first data word shifted according to step (d), (f) encoding data words indicative of the coordinate of said straight line in said second coordinate direction, (g) for respective ones of said data words encoded according to step (f) encoding multiples of said third data word, which are related to a respective coordinate in said first coordinate direction, on said straight line, (h) reducing the scale of said multiples of said third data words produced in step (g) to the scale of the first data word of step (a), prior to said shifting of step (d)

(i) encoding said third data words produced in step (h) with respective coordinates in said second coordinate direction to produce said coordinates on said straight line.

2. The method of claim 1, wherein said step (h) of reducing the scale includes the step (j) of truncating said data words of step (g).

3. The method of claim 1, wherein said step (i) of reducing the scale (i) includes the step (k) of rounding said data words of step (h).

4. The method of claim 2, wherein said step (j) of truncating includes the step (l) of shifting said data words of step (h) by the number of positions shifted in step (d).

5. The method of claim 3, wherein said step (k) includes the step (m) of shifting said data words of step (h) by the number of positions shifted in step (d), less one position, to reduce the scale of said words and adding a data word corresponding to a rounding value, to said respective data words and shifting said respective data words an additional position to round said data words to the scale of the first data word of step (a), prior to said shifting of step (d).

6. The method of claim 1, including the step (n) of producing a set of values corresponding to the radix values of the positions of the said first machine location, and in a first order ranging either from the higher to the lower or in a second order ranging from the lower to the higher of said radix values, attaching index values to said set of values, related to said radix values and the said number of available positions available for shifting, sequentially comparing the said first data word in said first machine location to each of said set of values, (i) in the said first order and providing an indication when said first data word is less than a compared value, or (ii) in the said second order and providing an indication when said first data word is greater than a compared value, responsive to said respective indication, identifying the said index value for said compared value and the number of positions in said first machine location available for said shifting.

7. The method of claim 1, wherein said step (d) includes the step (o) of enlarging the size of the said first machine location by a number of positions at least equal to the number of positions used to encode said second data word.

8. The method of claim 1, wherein said step (g) of encoding multiples of said third data word includes the step (p) of incrementing said third data word by itself to produce a cumulative data word and iteratively incrementing said cumulative data word by said third data word to produce said multiples of said third data words.

9. The method of claim 1, wherein said step (h) includes the step (g) of reducing the scale of said multiples of said third data word relative to the inverse of the said scale factor, according to step (d).

10. A system for linear interpolation of coordinate points between first and second end points, to produce coordinates on a straight line outline and where said coordinates are located on a coordinate system having a first coordinate direction and second coordinate direction and encoded in machine readable data words of a radix "r", corresponding to the order of values for designated positions in said data words, comprising:

(a) means for encoding a first data word of "N" positions corresponding to the distance between the said first and second end points in the said first coordinate direction and placing said first data word into a first machine location, (b) means for encoding a second data word of "M" positions corresponding to the distance between said first and second end points in said second coordinate direction and placing said second data word into a second machine location, (c) means for determining the number of available positions, between the most significant position of said first data word and the most significant position of said first machine location, available for shifting said first data word in a first direction of the most significant positions of said first machine location, (d) means for shifting said first data word by a maximum number of positions, equal to the said number of available positions in said first direction and the number of positions corresponding to the number of significant positions used to encode said second data word, and increasing the scale of said first data word by a scale factor related to the number of said positions shifted, (e) means for deriving a third data word indicative of said second data word in said second machine location divided into said shifted first data word, (f) means for encoding data words indicative of the coordinate of said straight line in said second coordinate direction, (g) for respective ones of said data words encoded by said means (f), means for encoding multiples of said third data word, indicative of respective coordinates in said first coordinate direction and corresponding to the said coordinates in said second direction, (h) means for reducing the scale of said multiples of said third data words produced by said means (g), to the scale of the said first data word prior to said shifting by said means (d), (i) means for encoding said third data words produced by said means (h) with respective coordinates in said second coordinate direction to produce said coordinates on said straight line.

11. The system of claim 10, wherein said means (h) for reducing the scale includes (i) means for truncating the said multiples of said third data word.

12. The system of claim 10, wherein said means (h) for reducing the scale includes (k) means for rounding said multiples of said data word.

13. The system of claim 11, wherein said means (j) for truncating includes (l) means for shifting said multiples of said third data word by the number of positions shifted by said means (d).

14. The system of claim 13, wherein said means (k) includes (m) means for shifting said multiples of said third data word by the number of positions shifted by means (d), less one position, to reduce the scale of said words and adding a data word corresponding to a rounding value, to said respective data words and shifting said respective data words an additional position to round said data words to the scale of the first data word encoded by said means (a), prior to said shifting by said means (d).

15. The system of claim 10, including means (n) of producing a set of values corresponding to the radix order of values for the positions of the said first machine location, and in a first direction ranging either from the higher to the lower or in a second direction ranging from the lower to the higher of said radix values, (o) means for attaching index values to said set of values, related to the said radix values and the said number of available positions available for shifting, relative to each of said radix values, (p) means for sequentially comparing the said first data word in said first machine location to each of said set of values, (i) in the said first direction and providing an indication when said first data word is less than a compared value in said set of values or (ii) in the said second direction and providing an indication when said first data word is greater than a compared value in said set of values, (q) means responsive to said indication produced by means (p) for identifying the said index value for said compared value and the number of positions in said first machine location, available for said shifting.

16. The system of claim 15, wherein said means (d) includes the means (r) for enlarging the size of the said first machine location by a number of positions at least equal to the number of positions used to encode said second data word.

17. The system of claim 1, wherein said means (g) for encoding multiples of said third data word includes the step means (t) for of incrementing said third data word by itself to produce a cumulative data word and iteratively incrementing said cumulative data word by said third data word to produce said multiples of said third data words.

18. The system of claim 1, wherein said means (h) includes means (i) for reducing the scale of said multiples of said third data word relative to the inverse of the said scale factor by which said scale of said first data word was increased, by means (d).

* * * * *